US007251950B2

(12) United States Patent
Matsumoto et al.

(10) Patent No.: US 7,251,950 B2
(45) **Date of Patent: *Aug. 7, 2007**

(54) HEATING/COOLING SYSTEM

(75) Inventors: Kenzo Matsumoto, Gunma-ken (JP); Yoshio Watabe, Gunma-ken (JP); Shigeya Ishigaki, Gunma-ken (JP); Hiroshi Nishikawa, Tatehayashi (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 194 days.

This patent is subject to a terminal disclaimer.

(21) Appl. No.: 11/040,017

(22) Filed: Jan. 24, 2005

(65) Prior Publication Data

US 2005/0166626 A1 Aug. 4, 2005

(30) Foreign Application Priority Data

Jan. 30, 2004 (JP) ..... 2004-024289
Jan. 30, 2004 (JP) ..... 2004-024295
Jan. 30, 2004 (JP) ..... 2004-024308
Jan. 30, 2004 (JP) ..... 2004-024313

(51) Int. Cl.
*F25B 13/00* (2006.01)

(52) U.S. Cl. ..... 62/324.1; 62/324.6

(58) Field of Classification Search ..... 62/159, 62/160, 324.1, 324.6
See application file for complete search history.

(56) References Cited

U.S. PATENT DOCUMENTS 6,230,506 B1 * 5/2001 Nishida et al. ..... 62/223
6,584,796 B2 * 7/2003 Itoh et al. ..... 62/324.1
6,619,066 B1 * 9/2003 Kaneo ..... 62/324.2
6,625,994 B2 * 9/2003 Kakehashi et al. ..... 62/129
6,675,609 B2 * 1/2004 Takeuchi et al. ..... 62/500
6,840,058 B2 * 1/2005 Suzuki et al. ..... 62/474
2002/0078702 A1 * 6/2002 Makizono et al. ..... 62/271
2003/0037562 A1 * 2/2003 Honda et al. ..... 62/324.1
2003/0061827 A1 * 4/2003 Sakakibara ..... 62/224
2004/0079096 A1 * 4/2004 Itoh et al. ..... 62/223
2004/0123608 A1 * 7/2004 Kamimura et al. ..... 62/114

FOREIGN PATENT DOCUMENTS

JP 6-18156 1/1994
JP 2002-316531 A * 10/2002

* cited by examiner

*Primary Examiner*—Mohammad M. Ali
(74) *Attorney, Agent, or Firm*—Armstrong, Kratz, Quintos, Hanson & Brooks, LLP

(57) ABSTRACT

There is provided a heating/cooling system capable of reducing power consumption. The heating/cooling system has a receiving room capable of using hot air and cold air in a switching manner, and comprises a refrigerant circuit which comprises a compressor, a gas cooler, a radiator, an expansion valve, an evaporator, and the like, in which carbon dioxide is sealed as a refrigerant, and whose high pressure side becomes supercritical pressure. The inside of the receiving room is heated by the radiator and cooled by the evaporator.

12 Claims, 35 Drawing Sheets

HEATING/COOLING SYSTEM

BACKGROUND OF THE INVENTION

The present invention relates to a heating/cooling system comprising a receiving room in which hot air and cold air can be switched to be used.

As shown in FIG. 35, a heating/cooling system of this type has conventionally comprised a storage room 101 partitioned into a cooling chamber 102 and a heating chamber 103 by an insulated wall, and a machine room 109 arranged below the storage room 101. The machine room 109 accommodates a compressor 111, a gas cooler 112, a capillary tube 116 as pressure reducing means, and the like, which constitute a refrigerant circuit 110 with an evaporator 117. An electric heater 180 is installed in the heating chamber 103. Air heated by the electric heater 180 is blown into the heating chamber 103 by a fan 128, whereby the heating chamber 103 is heated.

Now, referring to FIG. 35, an operation of a conventional heating/cooling system 400 will be described. The fan 128 is started by a control device (not shown). When power is supplied to the electric heater 180, air heated by the electric heater 180 is circulated in the heating chamber 103 by the fan 128. Accordingly, the inside of the heating chamber 103 is heated.

The control device starts running of a fan 127, and simultaneously starts a driving element (not shown) of the compressor 111. Thus, a low-pressure refrigerant gas is sucked into a cylinder of a compression element (not shown) of the compressor 111 and compressed to become a high-temperature and high-pressure refrigerant gas, and discharged to the gas cooler 112.

After heat is released from the refrigerant gas by the gas cooler 112, the refrigerant gas passes through an internal heat exchanger 145 to enter the capillary tube 116. The pressure thereof is reduced through the tube, and the refrigerant gas flows into the evaporator 117. A refrigerant is evaporated here, and absorbs heat from ambient air to exhibit a cooling effect. It should be noted that the air cooled by the evaporation of the refrigerant at the evaporator 117 is circulated in the cooling chamber 102 by running the fan 127 to cool the inside of the cooling chamber 102. Thus, according to the conventional heating/cooling system, the inside of the heating chamber 103 is heated by the electric heater 180, and the cooling chamber 102 is cooled by the evaporator 117 of the refrigerant circuit 110 (e.g., see Japanese Patent Application Laid-Open No. 6-18156).

Furthermore, a heating/cooling system capable of using hot air and cold air in a switching manner has recently been developed, which comprises both of a heating element such as an electric heater and an evaporator installed in one receiving room, runs the heater to heat the receiving room when the receiving room is heated, stops running of the electric heater when the receiving room is cooled, starts running of a compressor, and evaporating a refrigerant by the evaporator to cool the receiving room. However, because the heating of the receiving room is carried out by the heating element such as an electric heater as described above, there is a problem that power consumption is considerably increased.

SUMMARY OF THE INVENTION

The present invention has been developed to solve the aforementioned conventional technical problems, and it is an object of the invention to reduce power consumption in a heating/cooling system capable of using hot air and cold air in a switching manner.

A heating/cooling system of the invention has a receiving room capable of using hot air and cold air in a switching manner, and comprises a refrigerant circuit which comprises a compressor, a radiator, a pressure reducing device, an evaporator, and the like, in which carbon dioxide is sealed as a refrigerant, and whose high pressure side becomes supercritical pressure. The inside of the receiving room is heated by the radiator and cooled by the evaporator.

According to the heating/cooling system of the invention, by using carbon dioxide of good heating characteristics for a refrigerant, the inside of the receiving room can be heated by the radiator and cooled by the evaporator.

Thus, heating/cooling of the receiving room can be performed by the refrigerant circuit, and it is possible to heat the inside of the receiving room without using any heating elements such as electric heaters.

Moreover, even in the case of using a heating element such as an electric heater, a capacity of the heating element can be reduced. Thus, it is possible to reduce power consumption.

The heating/cooling system of the invention further comprises a plurality of receiving rooms, pluralities of radiators and evaporators for heating and cooling the receiving rooms, and flow path control means for controlling refrigerant circulation for the radiators and the evaporators.

According to the invention, the refrigerant circulation is controlled for the radiators and the evaporators by the flow path control means. Thus, the plurality of receiving rooms can be used by switching between hot air and cold air.

Moreover, hot air and cold air can be freely switched in each receiving room by the flow path control means. Thus, it is possible to improve convenience of the heating/cooling system.

A heating/cooling system of the invention has a receiving room capable of using hot air and cold air in a switching manner, and comprises a refrigerant circuit which comprises a compressor, a radiator, a pressure reducing device, an evaporator, and the like, in which carbon dioxide is sealed as a refrigerant, and whose high pressure side becomes supercritical pressure. The inside of the receiving room is heated by the radiator and cooled by the evaporator. The refrigerant circuit further comprises a gas cooler disposed separately from the radiator to release heat from the refrigerant, an auxiliary evaporator disposed separately from the evaporator to evaporate the refrigerant, and flow path control means for controlling refrigerant circulation for the radiator, the evaporator, the gas cooler, and the auxiliary evaporator.

According to the heating/cooling system of the invention, by using carbon dioxide of good heating characteristics for a refrigerant, the inside of the receiving room can be heated by the radiator and cooled by the evaporator. Thus, it is possible to heat the inside of the receiving room without using any heating elements such as electric heaters.

Even in the case of using a heating element such as an electric heater, a capacity of the heating element can be reduced. Thus, it is possible to reduce power consumption.

Moreover, the gas cooler is disposed separately from the radiator for heating the receiving room to release heat from the refrigerant, the auxiliary evaporator is disposed separately from the evaporator for cooling the receiving room to evaporate the refrigerator, and the refrigerant circulation is controlled for the radiator, the evaporator, the gas cooler and the auxiliary evaporator by the flow path control means. Thus, it is possible to realize continuous heating running by the radiator during the heating of the receiving room and continuous cooling running by the evaporator during the cooling of the receiving room.

As a result, it is possible to improve reliability and convenience of the heating/cooling system.

According to the heating/cooling system of the invention, the auxiliary evaporator is arranged on a leeward side of the gas cooler.

If the auxiliary evaporator is arranged on the leeward side of the gas cooler as in the case of the invention, air heat-exchanged with the refrigerant by the gas cooler and heated can be blown to the auxiliary evaporator. Thus, it is possible to effectively evaporate the refrigerant by the auxiliary evaporator.

Moreover, the refrigerant evaporated at the auxiliary evaporator is sufficiently heated by heat from the gas cooler. Thus, it is possible to prevent a liquid-back, i.e., suction of a liquid refrigerant into the compressor.

A heating/cooling system of the invention has a receiving room capable of using hot air and cold air in a switching manner, and comprises a refrigerant circuit which comprises a 2-stage compression type compressor having first and second compression elements, a radiator, a pressure reducing device, an evaporator, and the like, in which carbon dioxide is sealed as a refrigerant, and whose high pressure side becomes supercritical pressure. The inside of the receiving room is heated by the radiator and cooled by the evaporator. An intermediate cooling circuit is provided to cool a refrigerant compressed by the first compression element of the compressor and to suck the refrigerant into the second compression element. When the inside of the receiving room is heated by the radiator, the cooling of the refrigerant by the intermediate cooling circuit is made substantially invalid.

According to the heating/cooling system of the invention, by using carbon dioxide of good heating characteristics for a refrigerant, the inside of the receiving room can be heated by the radiator and cooled by the evaporator. Thus, it is possible to heat the inside of the receiving room without using any heating elements such as electric heaters.

Even in the case of using a heating element such as an electric heater, a capacity of the heating element can be reduced. Thus, it is possible to reduce power consumption.

The refrigerant compressed by the first compression element is cooled by the intermediate cooling circuit, and then sucked into the second compression element. Accordingly, a temperature of a refrigerant gas discharged from the second compression element of the compressor can be reduced. As a result, it is possible to increase a cooling efficiency.

Moreover, in the case of heating the inside of the receiving room by the radiator, the cooling of the refrigerant by the intermediate cooling circuit is made substantially invalid. Accordingly, the refrigerant gas discharged from the second compression element of the compressor can be maintained at a high temperature. As a result, it is possible to increase a heating efficiency of the radiator.

The heating/cooling system of the invention further comprises a gas cooler disposed separately from the radiator to release heat from the refrigerant, an auxiliary evaporator disposed separately from the evaporator to evaporate the refrigerant, a heat exchanger which releases heat from the refrigerant at the intermediate cooling circuit, a bypass pipe which bypasses the heat exchanger, and flow path control means for controlling refrigerant circulation for the radiator, the evaporator, the gas cooler, the auxiliary evaporator, the heat exchanger and the bypass pipe.

According to the invention, in addition to the foregoing, the gas cooler is disposed separately from the radiator for heating the receiving room to release heat from the refrigerant, the auxiliary evaporator is disposed separately from the evaporator for cooling the receiving room to evaporate the refrigerant, and the flow path control means controls the refrigerant circulation for the radiator, the evaporator, the gas cooler and the auxiliary evaporator. Thus, it is possible to freely switch heating/cooling of the receiving room.

Moreover, the heat exchanger is provided to release heat from the refrigerant at the intermediate cooling circuit, and the bypass pipe which bypasses this heat exchanger is provided. In the case of heating the inside of the receiving room by the radiator, the refrigerant is supplied through the bypass pipe by the flow path control means. In the case of cooling the inside of the receiving room, the refrigerant is supplied to the heat exchanger. Accordingly, cooling of the refrigerant compressed by the first compression element can be controlled by a relatively simple structure.

The heating/cooling system of the invention further comprises a plurality of receiving rooms, pluralities of radiators and evaporators for heating and cooling the receiving rooms.

According to the invention, the plurality of receiving rooms can be used by freely switching between hot air and cold air. Additionally, if the heat is released from the refrigerant at the gas cooler by the flow path control means of the invention, all the receiving rooms can be cooled.

Moreover, if the refrigerant is evaporated at the auxiliary evaporator by the flow path control means, all the receiving rooms can be heated.

As a result, it is possible to further improve convenience of the heating/cooling system.

A heating/cooling system of the invention has a receiving room capable of using hot air and cold air in a switching manner, and comprises a refrigerant circuit which comprises a 2-stage compression type compressor having first and second compression elements, a gas cooler, a pressure reducing device, an evaporator, and the like, in which carbon dioxide is sealed as a refrigerant, and whose high-pressure side becomes supercritical pressure. An intermediate cooling circuit is provided which comprises a heat exchanger to cool a refrigerant compressed by the first compression element of the compressor and then to suck the refrigerant into the second compression element. The inside of the receiving room is heated by heat releasing from the heat exchanger and cooled by the evaporator.

According to the heating/cooling system of the invention, by using carbon dioxide of good heating characteristics for a refrigerant, the inside of the receiving room can be heated by the radiator and cooled by the evaporator. Thus, it is possible to heat the inside of the receiving room without using any heating elements such as electric heaters. Even in the case of using a heating element such as an electric heater, a capacity of the heating element can be reduced. Thus, it is possible to reduce power consumption.

The refrigerant compressed by the first compression element is cooled by the intermediate cooling circuit, and then sucked into the second compression element. Accordingly, a temperature of a refrigerant gas discharged from the second compression element of the compressor can be reduced. As a result, it is possible to increase a cooling efficiency.

Moreover, the inside of the receiving room is heated by heat released from the intermediate-pressure refrigerant compressed by the first compression element. As a result, it is possible to heat the receiving room to an optimal temperature.

The heating/cooling system of the invention further comprises a radiator disposed in the intermediate cooling circuit, and flow path control means for controlling flowing of the refrigerant discharged from the first compression element to the heat exchanger or the radiator.

According to the invention, in addition to the foregoing, refrigerant circulation can be controlled for the heat exchanger and the radiator by the flow path control means. Thus, in the case of heating the receiving room, by the flow path control means, the refrigerant is supplied to the heat exchanger without flowing to the radiator. As a result, since heat is released from the refrigerant from the first compression element at the heat exchanger, it is possible to heat the receiving room.

In the case of cooling the receiving room, by the flow path control means, the refrigerant is supplied to the radiator without flowing to the heat exchanger. Accordingly, the refrigerant compressed by the first compression element can be cooled and then sucked into the second compression element. As a result, it is possible to evaporate the refrigerant at a lower temperature by the evaporator.

According to the heating/cooling system of the invention, the radiator is constituted integrally with the gas cooler.

According to the invention, since the radiator is constituted integrally with the gas cooler, it is possible to reduce an installation space.

The heating/cooling system of the invention further comprises an evaporator which evaporates the refrigerant, and flow path control means for controlling refrigerant circulation for both of the evaporators.

According to the invention, by the flow path control means, the refrigerant is evaporated by the evaporator different from the evaporator for cooling the receiving room. Thus, it is possible to freely switch heating and cooling.

The heating/cooling system of the invention further comprises an electric heater which heats the inside of the receiving room.

According to the invention, even when the receiving room cannot be sufficiently heated only by heating of the radiator at a low outside temperature or the like, in addition to the heating by the radiator, the receiving room can be heated by the electric heater. As a result, it is possible to effectively heat the receiving room.

DETAILED DESCRIPTION OF THE PREFERRED EMBODIMENTS

Next, the preferred embodiments of the present invention will be described in detail with reference to the accompanying drawings.

Embodiment 1-1

Figure 1:
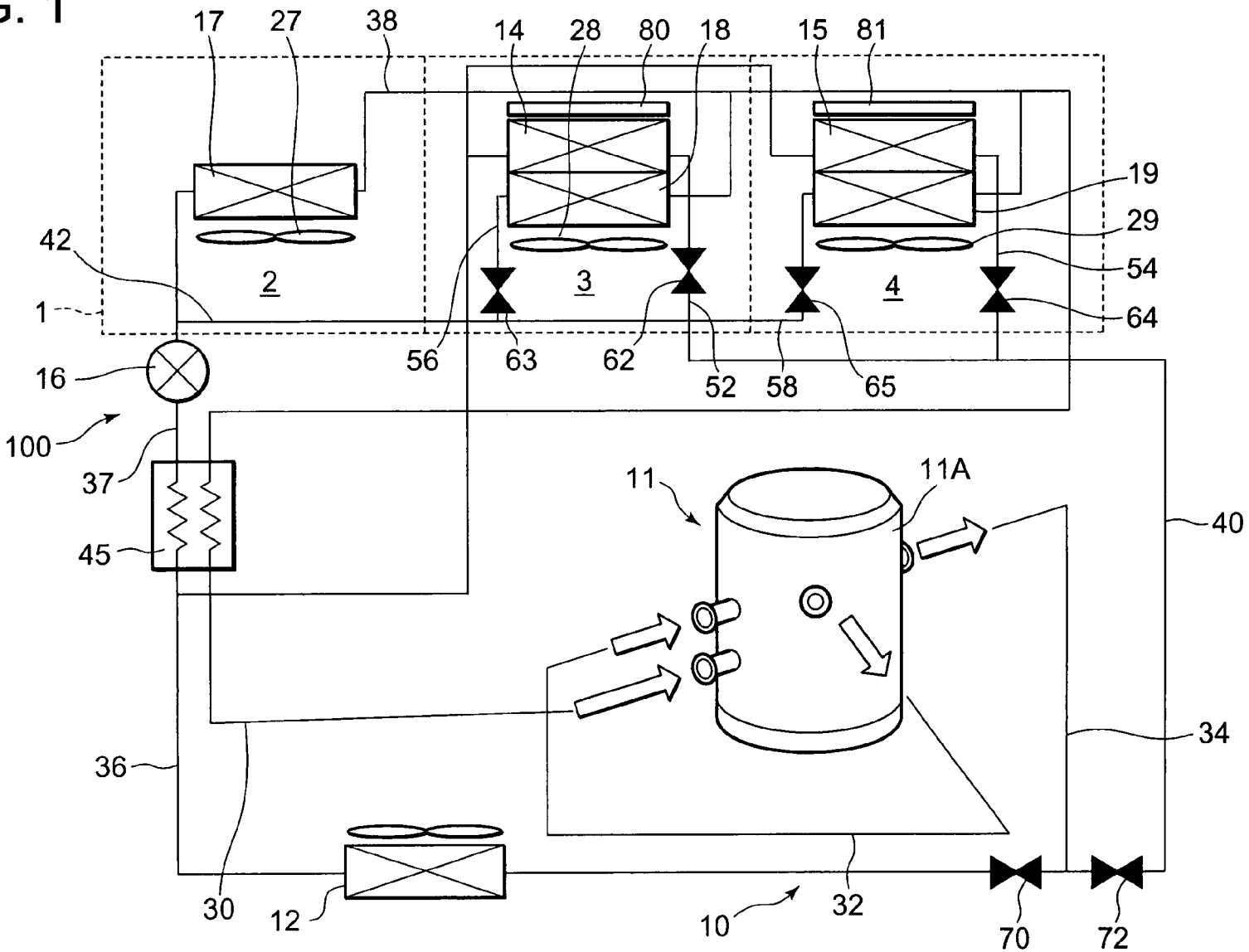
FIG. 1 is a refrigerant circuit diagram of a heating/cooling system according to an embodiment of the present invention (Embodiment 1-1)

FIG. 1 is a refrigerant circuit diagram showing a heating/cooling system 100 according to an embodiment of the invention. It should be noted that the heating/cooling system of the invention can be used for a showcase, an automatic vending machine, an air conditioner, a cooling/heating cabinet or the like.

In FIG. 1, a reference numeral 1 denotes a storage room of the heating/cooling system 100. In this storage room 1, a cooling chamber 2, and receiving rooms 3 and 4 are disposed to cool articles, and surrounded with insulating members.

In the cooling chamber 2, an evaporator 17 and a fan 27 for blowing (circulating) air heat-exchanged with the evaporator 17 are installed.

In the receiving room 3, a radiator 14 and an electric heater 80 as an auxiliary heater for heating the receiving room 3, an evaporator 18 for cooling the receiving room 3, and a fan 28 for blowing (circulating) air heat-exchanged with the radiator 14 or the evaporator 18 or air heated by the electric heater 80 into the receiving room 3 are installed.

Similarly, in the receiving room 4, a radiator 15 and an electric heater 81 as an auxiliary heater for heating the receiving room 4, an evaporator 19 for cooling the receiving room 4, and a fan 29 for blowing (circulating) air heat-exchanged with the radiator 15 or the evaporator 19 or air heated by the electric heater 81 into the receiving room 4 are installed.

Additionally, in FIG. 1, a reference numeral 10 denotes a refrigerant circuit constituted by sequentially connecting a compressor 11, a gas cooler 12, the radiators 14 and 15, an expansion valve 16 as a pressure reducing device, and the evaporators 17, 18 and 19, and the like in an annular form through pipes. The gas cooler 12 is provided to cause heat releasing from a refrigerant.

A refrigerant discharge pipe 34 of the compressor 11 is connected to an inlet of the gas cooler 12. Here, the compressor 11 of the embodiment is a 2-stage compression type which comprises a driving element disposed in a sealed container 11A, and first and second compression elements driven by the driving element.

In the drawing, a reference numeral 30 denotes a refrigerant introduction pipe for introducing a refrigerant into a cylinder of the first compression element (not shown) of the compressor 11. One end of this refrigerant introduction pipe 30 is communicated with the cylinder of the first compression element (not shown). The other end of the refrigerant introduction pipe 30 is connected to an outlet of an internal heat exchanger 45 described below.

A refrigerant introduction pipe 32 is a refrigerant pipe for introducing a refrigerant compressed by the first compression element into the second compression element. The refrigerant discharge pipe 34 is a refrigerant pipe for discharging a refrigerant compressed by the second compression element to the gas cooler 12.

A refrigerant pipe 36 connected to an outlet side of the gas cooler 12 passes through the internal heat exchanger 45. It should be noted that the internal heat exchanger 45 is designed to exchange heat between high-pressure side and low-pressure side refrigerants.

A refrigerant pipe 37 connected to the outlet of the internal heat exchanger 45 is connected through the expansion valve 16 to an inlet of the evaporator 17 of the cooling chamber 2.

Here, a first bypass circuit 40 is branched and connected to the midway of the refrigerant discharge pipe 34. This first bypass circuit 40 is further branched into pipes 52 and 54, and then combined together to be connected to the refrigerant pipe 36. In the first bypass circuit 40 and the refrigerant discharge pipe 34, solenoid valves 70, 72 are installed as flow path control means for controlling flowing of a high-temperature and high-pressure refrigerant compressed by the second compression element of the compressor 11 through the refrigerant discharge pipe 34 to the gas cooler 12 or the first bypass circuit 40.

The pipe 52 is disposed to pass through the radiator 14 installed in the receiving room 3. In the pipe 52 of the inlet side of the radiator 14, a solenoid valve 62 is installed as flow path control means for controlling refrigerant circulation for the radiator 14.

The pipe 54 is disposed to pass through the radiator 15 installed in the receiving room 4. In the pipe 54 of the inlet side of the radiator 15, a solenoid valve 64 is installed as flow path control means for controlling refrigerant circulation for the radiator 15.

A second bypass circuit 42 is branched and connected to the midway of the refrigerant pipe 37 out of the expansion valve 16. This second bypass circuit 42 is further branched into pipes 56 and 58, and then combined with a pipe 38 out of the evaporator 17.

The pipe 56 is disposed to pass through the evaporator 18 installed in the receiving room 3. In the pipe 56 of the inlet side of the evaporator 18, a solenoid valve 63 is installed as flow path control means for controlling refrigerant circulation for the evaporator 18.

The pipe 58 is disposed to pass through the evaporator 19 installed in the receiving room 4. In the pipe 58 of the inlet side of the evaporator 19, a solenoid valve 65 is installed as flow path control means for controlling refrigerant circulation for the evaporator 58.

Here, as a refrigerant sealed in the refrigerant circuit 10, carbon dioxide ($CO_2$) which is a natural refrigerant kind to a global environment is used in consideration of combustibility, toxicity, and the like.

Opening/closing of each of the solenoid valves 62, 63, 64, 65, 70, and 72 is controlled by a control device (not shown). The control device controls refrigerant circulation by the solenoid valves 62, 63, 64, 65, 70, and 72 to enable switching between hot air and cold air in the receiving rooms 3 and 4. It should be noted that the control device is control means in charge of controlling the heating/cooling system 100, and controls running or the like of the compressor 11 and the fans 27, 28, and 29.

(1) Mode of using receiving rooms 3 and 4 as cooling chambers

Figure 2:
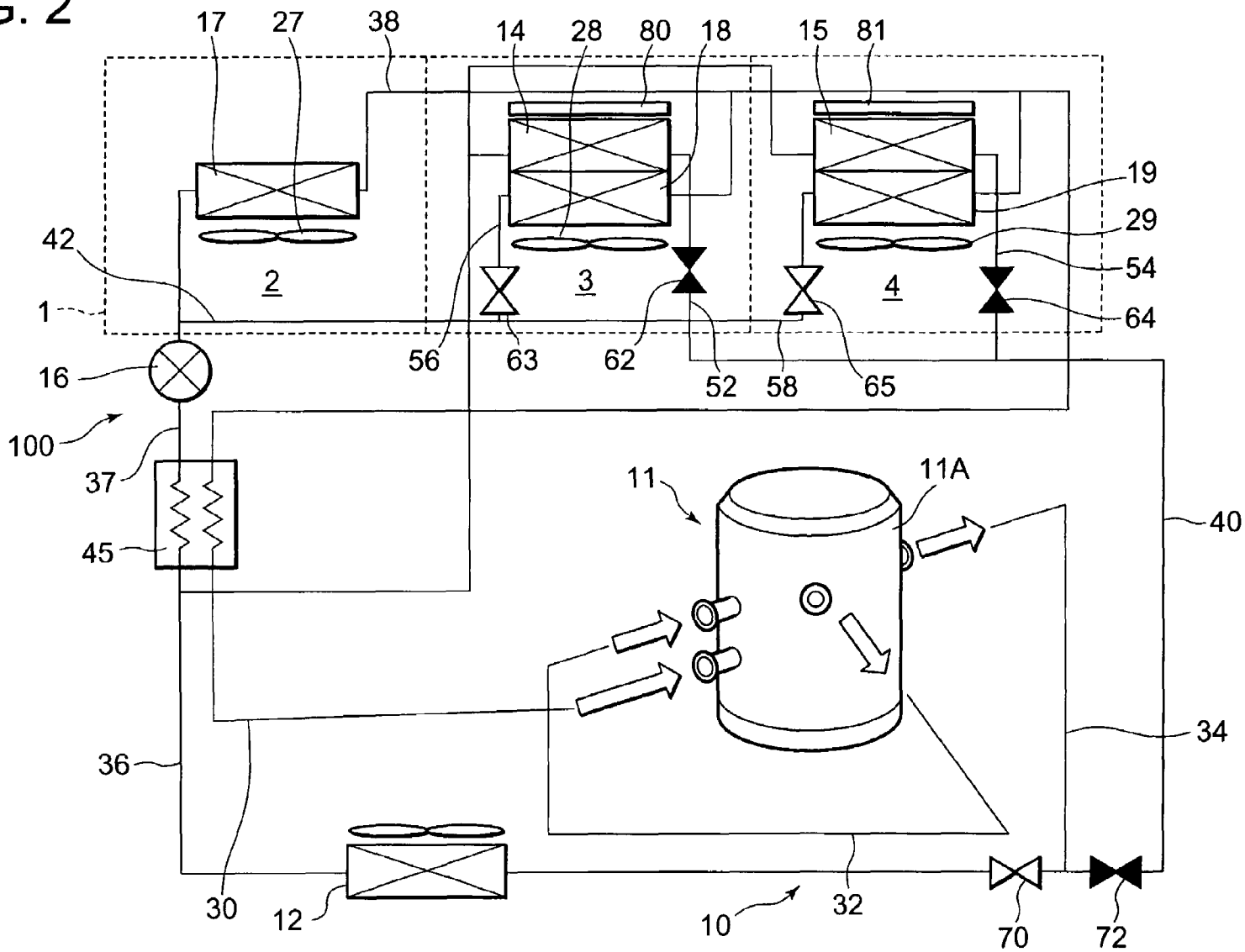
FIG. 2 is a refrigerant circuit diagram of FIG. 1 showing a flow of a refrigerant on a mode of using receiving rooms 3 and 4 as cooling chambers.

Next, an operation of the heating/cooling system 100 of the invention configured in the aforementioned manner will be described. To begin with, referring to FIG. 2, the mode of using the receiving rooms 3 and 4 as cooling chambers for cooling articles will be described. FIG. 2 is a refrigerant circuit diagram showing a flow of a refrigerant on this mode. The solenoid valve 70 is opened by the control device (not shown), while the solenoid valve 72 is closed to fully close the first bypass circuit 40. Accordingly, refrigerants discharged from the compressor 11 all flow from the refrigerant discharge pipe 34 to the gas cooler 12.

The control device closes the solenoid valves 62 and 64 to close the refrigerant pipes 52 and 54, while it opens the solenoid valves 63 and 65 to open the pipes 56, 58. Accordingly, refrigerants from the second bypass circuit 42 flow through the pipes 56 and 58. It should be noted that white solenoid valves indicate states of valves opened by the control device and black solenoid valves indicate states of valves closed by the control device in the drawing.

The control device starts running of the fans 27, 28 and 29 installed in the cooling chamber 2 and the receiving rooms 3 and 4, and drives the driving element of the compressor 11. Accordingly, a low pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container 11A, the refrigerant gas is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows through the refrigerant discharge pipe 34 into the gas cooler 12 because the solenoid valve 70 is opened while the solenoid valve 72 is closed, as described above.

Here, the high-temperature and high-pressure refrigerant compressed by the compressor 11 is not condensed, but the fans are run in the supercritical state of the refrigerant gas. The high-temperature and high-pressure refrigerant gas passes through the internal heat exchanger 45 after heat is released therefrom by the gas cooler 12. There, the heat of the refrigerant is drawn by low-pressure side refrigerants out of the evaporators 17, 18 and 19, and the refrigerant is further cooled. The presence of the internal heat exchanger 45 causes the low-pressure side refrigerant to draw the heat from the refrigerant which goes out of the gas cooler 12 and passes through the internal heat exchanger 45. A supercooling degree of the refrigerant is increased by a corresponding amount. Thus, cooling efficiencies of the evaporators 17, 18, and 19 are increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state flows into the evaporator 17 installed in the cooling chamber 2. The refrigerant is evaporated there, and absorbs heat from ambient air to exhibit a cooling effect. It should be noted that the air cooled by the evaporation of the refrigerant at the evaporator 17 is circulated in the cooling chamber 2 by running the fan 27 to cool the inside thereof. Subsequently, the refrigerant flows out of the evaporator 17 and enters the refrigerant pipe 38.

Meanwhile, a part of the refrigerant reduced in pressure by the expansion valve 16 enters the second bypass circuit 42 branched and connected to the midway of the refrigerant pipe 37 since the solenoid valves 63 and 65 are opened as described above, and the refrigerant is further branched to enter the pipes 56 and 58. The refrigerant that has entered the pipe 56 flows into the evaporator 18 installed in the receiving room 3, evaporates there, and absorbs heat from ambient air to exhibit a cooling effect. The air cooled by the evaporation of the refrigerant at the evaporator 18 is circulated in the receiving room 3 by running the fan 28 to cool the same. Subsequently, the refrigerant flows out of the evaporator 18, and combines with the refrigerant from the evaporator 17 which flows through the refrigerant pipe 38.

On the other hand, the refrigerant that has entered the pipe 58 flows into the evaporator 19 installed in the receiving room 4, evaporates there, and absorbs heat from ambient air to exhibit a cooling effect. The air cooled by the evaporation of the refrigerant at the evaporator 19 is circulated in the receiving room 4 by running the fan 29 to cool the same. Subsequently, the refrigerant out of the evaporator 19 combines with the refrigerants from the evaporators 17 and 18 which flow through the refrigerant pipe 38, and reaches the internal heat exchanger 45.

The refrigerant draws heat from the aforementioned high-pressure side refrigerant to receive a heating effect. Here, the refrigerant evaporated by each of the evaporators 17, 18, and 19 to become low in temperature and fed out therefrom may be set not in a completely gas state but in a liquid mixed state. However, the refrigerant is passed through the internal heat exchanger 45 to be heat-exchanged with the high-pressure side high-temperature refrigerant, thereby being superheated. At this time, a superheating degree of the refrigerant is secured, causing the refrigerant to become a complete gas.

Accordingly, the refrigerant out of each of the evaporators 17, 18, and 19 can be surely gasified, making it possible to assure prevention of a liquid-back, i.e., suction of a liquid refrigerant into the compressor 11, and to prevent a problem of damaging of the compressor 11 by liquid compression without disposing any accumulators on the low-pressure side. Thus, it is possible to improve reliability of the heating/cooling system 100.

It should be noted that the refrigerant heat-exchanged by the internal heat-exchanger 45 repeats a cycle of being sucked though the refrigerant introduction pipe 30 into the first compression element of the compressor 11.

Figure 3:
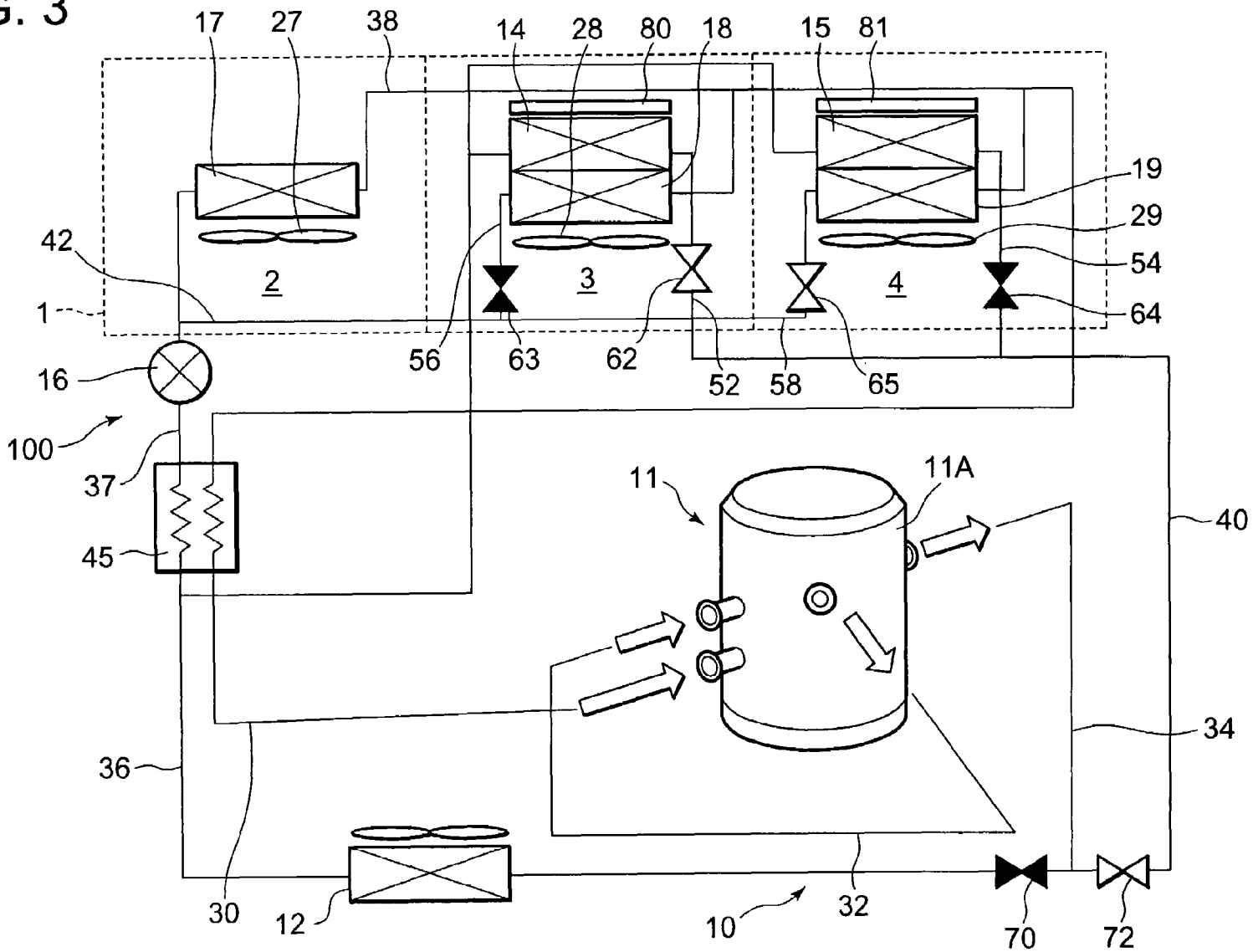
FIG. 3 is a refrigerant circuit diagram of FIG. 1 showing a flow of a refrigerant on a mode of using the receiving room 3 as a heating chamber and the receiving room 4 as a cooling chamber.

(2) Mode of using receiving room 3 as heating chamber and receiving room 4 as cooling chamber Next, referring to FIG. 3, description will be made of an operation of the heating/cooling systems 100 on a mode of using the receiving room 3 as a heating chamber for heating articles and the receiving room 4 as a cooling chamber for cooling articles. FIG. 3 is a refrigerant circuit diagram showing a flow of a refrigerant on this mode.

The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12.

The control device opens the solenoid valve 62 to open the refrigerant pipe 52, while it closes the solenoid valve 64 to close the refrigerant pipe 54. Accordingly, a refrigerant from the first bypass circuit 40 flows through the refrigerant pipe 52. The control device closes the solenoid valve 63 to close the pipe 56, while it opens the solenoid valve 65 to open the pipe 58. Accordingly, a refrigerant from the second bypass circuit 42 flows through the pipe 58.

The control device starts running of the fans 27, 28 and 29 received in the cooling chamber 2 and the receiving rooms 3 and 4, and drives the driving element of the compressor 11. Accordingly, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container 11A, the refrigerant gas is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, as the solenoid valve 62 is opened while the solenoid valve 64 is closed as described above, the refrigerant enters the refrigerant pipe 52 from the first bypass circuit 40, and flows into the radiator 14 installed in the receiving room 3. Here, the high-temperature and high-pressure refrigerant compressed by the compressor 11 is not condensed, but the fans are run in the supercritical state of the refrigerant gas. Heat is released from the high-temperature and high-pressure refrigerant gas by the radiator 14. It should be noted that air heated as a result of heat releasing from the refrigerant by the radiator 14 is circulated in the receiving room 3 to heat the inside thereof by running the fan 28. According to the invention, carbon dioxide is used for the refrigerant. Thus, since the refrigerant is not condensed at the radiator 14, a heat exchanging efficiency of the radiator 14 is extremely high, making it possible to set air to a sufficiently high temperature in the receiving room 3.

Subsequently, the refrigerant enters the refrigerant pipe 36 from the first bypass circuit 40, and passes through the internal heat exchanger 45. There, the heat of the refrigerant is drawn by low-pressure side refrigerants out of the evaporators 17 and 19, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant flows into the evaporator 17 installed in the cooling chamber 2.

The refrigerant is evaporated there, and absorbs heat from ambient air to exhibit a cooling effect. It should be noted that the air cooled by the evaporation of the refrigerant at the evaporator 17 is circulated in the cooling chamber 2 by running the fan 27 to cool the inside thereof. Subsequently, the refrigerant flows out of the evaporator 17 and enters the refrigerant pipe 38.

Meanwhile, a part of the refrigerant reduced in pressure by the expansion valve 16 passes through the second bypass circuit 42 from the midway of the refrigerant pipe 37 since the solenoid valve 65 is opened as described above, and enters the pipe 58. The refrigerant that has entered the pipe 58 flows into the evaporator 19 installed in the receiving room 4, evaporates there, and absorbs heat from ambient air to exhibit a cooling effect. The air cooled by the evaporation of the refrigerant at the evaporator 19 is circulated in the receiving room 4 by running the fan 29 to cool the same. Subsequently, the refrigerant flows out of the evaporator 19, and combines with the refrigerant from the evaporator 17 which flows through the refrigerant pipe 38.

The refrigerants combined through the refrigerant pipe 38 repeat a cycle of passing through the internal heat exchanger 45, drawing heat from the high-pressure side refrigerant, receiving a heating effect to become complete gases, and being sucked through the refrigerant introduction pipe 30 into the first compression element of the compressor 11.

Figure 4:
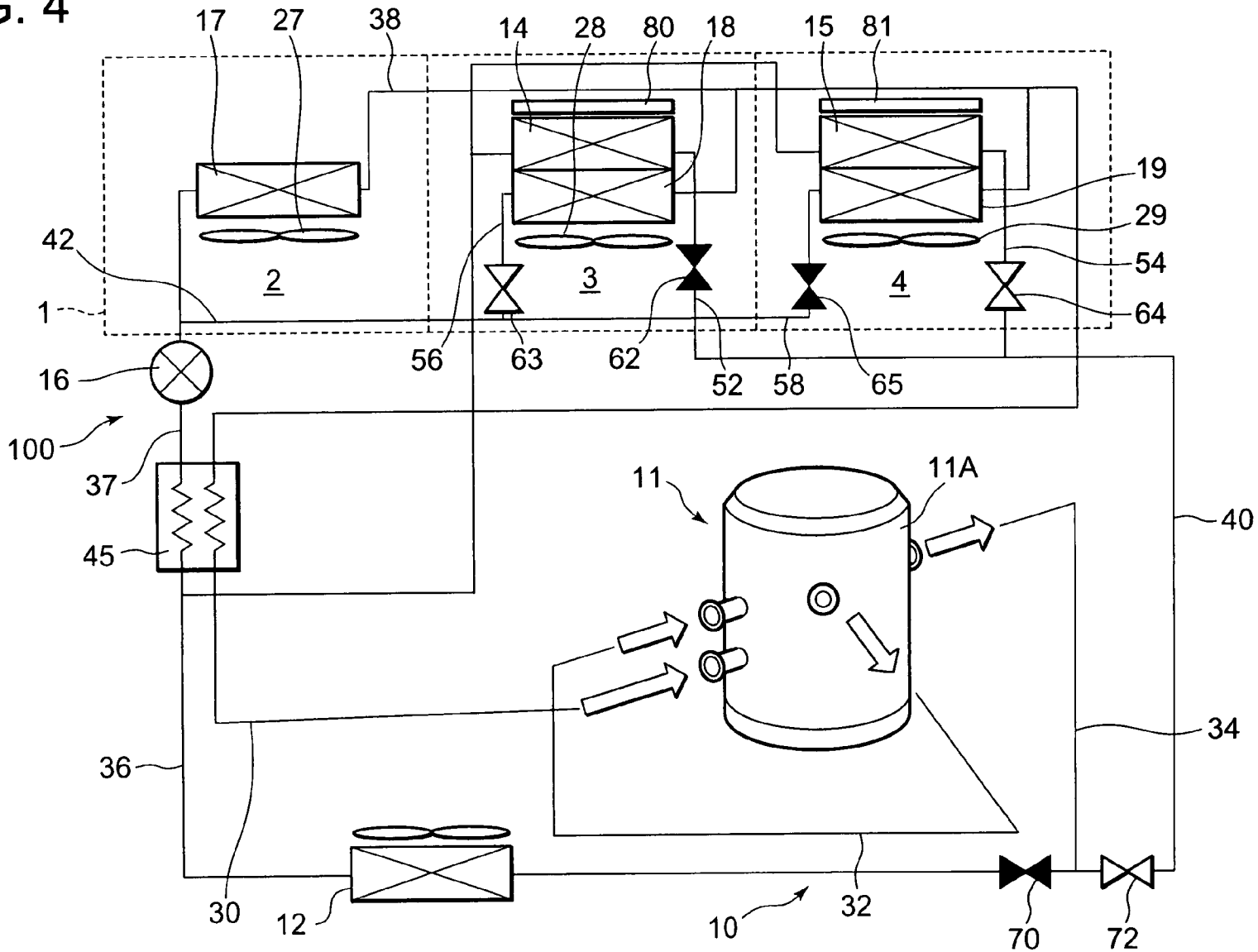
FIG. 4 is a refrigerant circuit diagram of FIG. 1 showing a flow of a refrigerant on a mode of using the receiving room 3 as a cooling chamber and the receiving room 4 as a heating chamber.

(3) Mode of using receiving room 3 as cooling chamber and receiving room 4 as heating chamber Next, referring to FIG. 4, description will be made of an operation of the heating/cooling system 100 on a mode of using the receiving room 3 as a cooling chamber for cooling articles and the receiving room 4 as a heating chamber for heating articles. FIG. 4 is a refrigerant circuit diagram showing a flow of a refrigerant on this mode.

The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12.

The control device closes the solenoid valve 62 to close the refrigerant pipe 52, while it opens the solenoid valve 64 to open the refrigerant pipe 54. Accordingly, a refrigerant from the first bypass circuit 40 flows through the refrigerant pipe 54. The control device opens the solenoid valve 63 to open the pipe 56, while it closes the solenoid valve 65 to close the pipe 58. Accordingly, a refrigerant from the second bypass circuit 42 flows through the pipe 56.

The control device starts running of the fans 27, 28 and 29 received in the cooling chamber 2 and the receiving rooms 3 and 4, and drives the driving element of the compressor 11.

Accordingly, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container 11A, the refrigerant gas is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, as the solenoid valve 62 is closed while the solenoid valve 64 is opened as described above, the refrigerant enters the refrigerant pipe 54 from the first bypass circuit 40, and flows into the radiator 15 installed in the receiving room 4. Here, the high-temperature and high-pressure refrigerant compressed by the compressor 11 is not condensed, but the fans are run in the supercritical state of the refrigerant gas. Heat is released from the high-temperature and high-pressure refrigerant gas by the radiator 15. It should be noted that air heated as a result of heat releasing from the refrigerant by the radiator 15 is circulated in the receiving room 4 to heat the inside thereof by running the fan 29. According to the invention, carbon dioxide is used for the refrigerant. Thus, since the refrigerant is not condensed at the radiator 15, a heat exchanging efficiency of the radiator 15 is extremely high, making it possible to set air to a sufficiently high temperature in the receiving room 4.

Subsequently, the refrigerant enters the refrigerant pipe 36, and passes through the internal heat exchanger 45. There, the heat of the refrigerant is drawn by low-pressure side refrigerants out of the evaporators 17 and 18, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed-state of a gas/a liquid by a drop in pressure of the expansion valve 16. Then, the refrigerant flows into the evaporator 17 installed in the cooling chamber 2.

The refrigerant is evaporated there, and absorbs heat from ambient air to exhibit a cooling effect. It should be noted that the air cooled by the evaporation of the refrigerant at the evaporator 17 is circulated in the cooling chamber 2 by running the fan 27 to cool the inside thereof. Subsequently, the refrigerant flows out of the evaporator 17 and enters the refrigerant pipe 38.

Meanwhile, a part of the refrigerant reduced in pressure by the expansion valve 16 passes through the second bypass circuit 42 from the midway of the refrigerant pipe 37 since the solenoid valve 63 is opened as described above, and enters the pipe 56. The refrigerant that has entered the pipe 56 flows into the evaporator 18 installed in the receiving room 3, evaporates there, and absorbs heat from ambient air to exhibit a cooling effect. The air cooled by the evaporation of the refrigerant at the evaporator 18 is circulated in the receiving room 3 by running the fan 28 to cool the same. Subsequently, the refrigerant flows out of the evaporator 18, and combines with the refrigerant from the evaporator 17 which flows through the refrigerant pipe 38.

The refrigerants combined through the refrigerant pipe 38 repeat a cycle of passing through the internal heat exchanger 45, drawing heat from the high-pressure side refrigerant, receiving a heating effect to become complete gases, and being sucked through the refrigerant introduction pipe 30 into the first compression element of the compressor 11.

(4) Mode of using receiving rooms 3 and 4 as heating chambers

Figure 5:
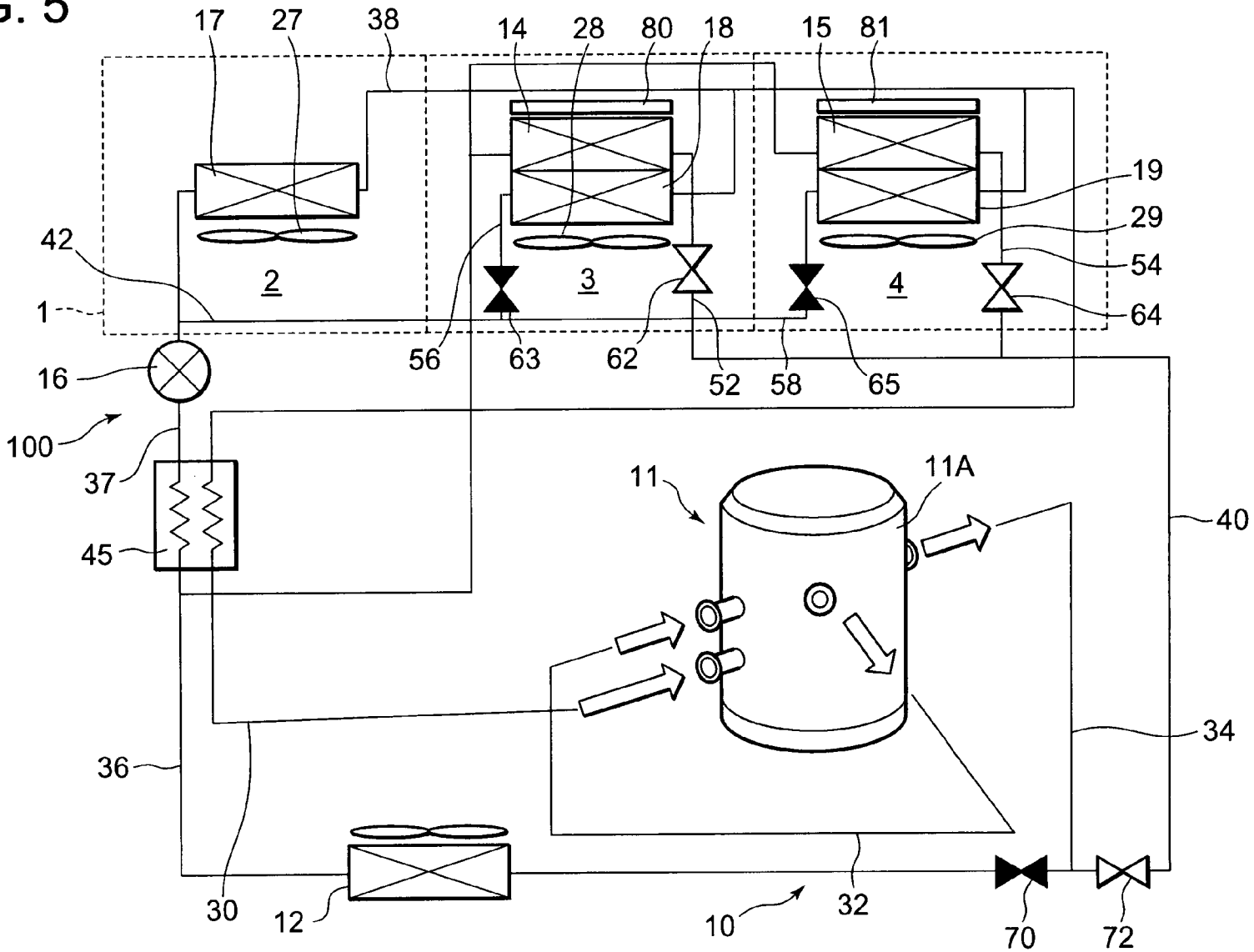
FIG. 5 is a refrigerant circuit diagram of FIG. 1 showing a flow of a refrigerant on a mode of using the receiving rooms 3 and 4 as heating chambers.

Lastly, referring to FIG. 5, description will be made of an operation of the heating/cooling system 100 on a mode of using the receiving rooms 3 and 4 as heating chambers for heating articles. FIG. 5 is a refrigerant circuit diagram showing a flow of a refrigerant on this mode.

The solenoid valve 70 is closed by the control device (not shown), while the solenoid valve 72 is opened to opener the first bypass circuit 40. Accordingly, refrigerants discharged from the compressor 11 all flow from the midway of the refrigerant discharge pipe 34 into the first bypass circuit 40 without flowing to the gas cooler 12.

The control device opens the solenoid valves 62 and 64 to open the refrigerant pipes 52 and 54. Accordingly, a refrigerant from the first bypass circuit 40 is branched to flow through the refrigerant pipes 52 and 54. The control device closes the solenoid valves 63 and 65 to close the pipes 56 and 58. Accordingly, refrigerants reduced in pressure by the expansion valve 16 all flow into the evaporator 17 installed in the cooling chamber 2 without flowing to the second bypass circuit 42.

The control device starts running of the fans 27, 28 and 29 received in the cooling chamber 2 and the receiving rooms 3 and 4, and drives the driving element of the compressor 11. Accordingly, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container 11A, the refrigerant gas is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, a the solenoid valves 62 and 64 are opened, the refrigerant is branched to enter the refrigerant pipes 52 54 from the first bypass circuit 40. The refrigerant that has entered the refrigerant pipe 52 flows into the radiator 14 installed in the receiving room 3, and heat is released from the refrigerant there. Here, the high-temperature and high-pressure refrigerant compressed by the compressor 11 is not condensed, but heat is released in the supercritical state of the refrigerant gas. It should be noted that air heated as a result of heat releasing from the refrigerant by the radiator 14 is circulated in the receiving room 3 to heat the inside thereof by running the fan 28. According to the invention, carbon dioxide is used for the refrigerant. Thus, since the refrigerant is not condensed at the radiator 14, a heat exchanging efficiency of the radiator 14 is extremely high, making it possible to set air to a sufficiently high temperature in the receiving room 3.

Meanwhile, the refrigerant that has entered the refrigerant pipe 54 flows into the radiator 15 installed in the receiving room 4. The high-temperature and high-pressure refrigerant compressed by the compressor 11 is not condensed, but heat is released therefrom in a supercritical state. It should be noted that air heated as a result of heat releasing by the evaporator 15 is circulated in the receiving room 4 to heat the inside thereof by running the fan 29. According to the embodiment, carbon dioxide is used for the refrigerant. Thus, since the refrigerant is not condensed at the radiator 15, a heat exchanging efficiency of the radiator 15 is extremely high, making it possible to set air to a sufficiently high temperature in the receiving room 4.

Subsequently, the refrigerant out of the radiator 14 or 15 combines with the other refrigerant, enters the refrigerant pipe 36 from the first bypass circuit 40, and passes through the internal heat exchanger 45. There, the heat of the refrigerant is drawn by the low-pressure side refrigerant out of the evaporator 17, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant flows into the evaporator 17 installed in the cooling chamber 2.

The refrigerant is evaporated there, and absorbs heat from ambient air to exhibit a cooling effect. It should be noted that the air cooled by the evaporation of the refrigerant at the evaporator 17 is circulated in the cooling chamber 2 by running the fan 27 to cool the inside thereof. Subsequently, the refrigerant flows out of the evaporator 17, enters the refrigerant pipe 38, and reaches the internal heat exchanger 45.

The low-pressure side refrigerant out of the evaporator 17 repeats a cycle of drawing heat from the high-pressure side refrigerant, receiving a heating effect to become a complete gas, and being sucked through the refrigerant introduction pipe 30 into the first compression element of the compressor 11.

As described above, the carbon dioxide of good heating characteristics is used for the refrigerant. Accordingly, the insides of the receiving rooms 3, 4 can be heated by the radiators 14, 15, and cooled by the evaporators 18, 19. Thus, the receiving rooms 3, 4 can be switched between hot air and cool air by the refrigerant circuit 10, and heated without installing any heating elements such as electric heaters or any special heating devices. As a result, it is possible to greatly reduce power consumption of the heating/cooling system 100.

Hot air and cold air can be switched to be used in the receiving rooms 3 and 4 by controlling refrigerant circulation through the solenoid valves 62, 63, 64, 65, 70, and 72 of the aforementioned modes. Thus, by switching opening/closing of each solenoid valve according to a use situation, it is possible to freely control hot air/cold air in the receiving rooms 3 and 4.

It should be noted that in the case of the mode of using the receiving room 3 and/or the receiving room 4 as the heating chamber for heating articles, by running the electric heater 80 or 81 installed therein, heating may be executed by the electric heater 80 or 81 to supplement the heating by the evaporator 14 or 15. In this case, it is possible to prevent a problem that the receiving room 3 or 4 cannot be sufficiently heated due to a shortage of a heating efficiency at a low outside temperature in winter or the like. The electric heater 80 or 81 supplements the heating by the radiator 14 or 15. Accordingly, a capacity of the electric heater 80 or 81 can be reduced. As a result, it is possible to reduce power consumption compared with the case of heating only by the electric heater.

According to the embodiment, the two receiving rooms (receiving rooms 3 and 4) in which hot air and cold air can be switched to be used are disposed. However, the invention is not limited to this embodiment. Hot air and cold air may be switched to be used by disposing a plurality of (3 or more) receiving rooms and pluralities of radiators and evaporators for heating or cooling the receiving rooms, and controlling refrigerant circulation for the radiators and the evaporators by flow path control means.

Furthermore, according to the embodiment, the radiators 14 and 15 and the evaporators 18 and 19 are installed in the receiving rooms 3 and 4, and refrigerant circulation is controlled by opening/closing the solenoid valves 62, 63, 64, 65, 70 and 72, thereby controlling the heating/cooling of the receiving rooms 3 and 4. However, the invention is not limited to this embodiment. For example, a radiators an evaporator, and a fan may be installed outside the receiving room, and fan blowing may be switched to send hot or cold air to the receiving room 3 or 4, whereby the receiving room 3 or 4 may be heated or cooled.

Embodiment 1-2

Figure 6:
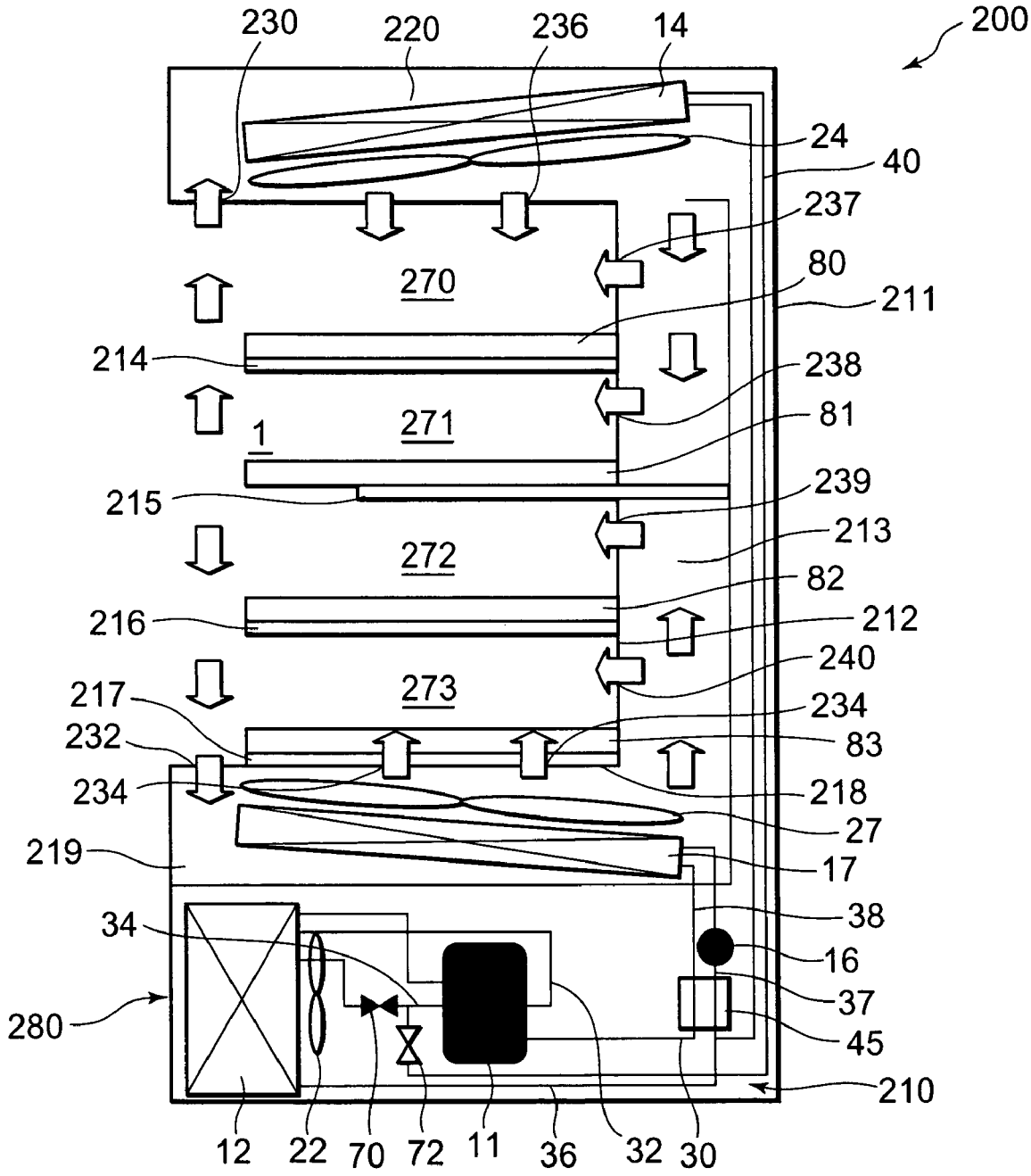
FIG. 6 is an internal configuration diagram of a heating/cooling system according to another embodiment of the invention (Embodiment 1-2)
Figure 7:
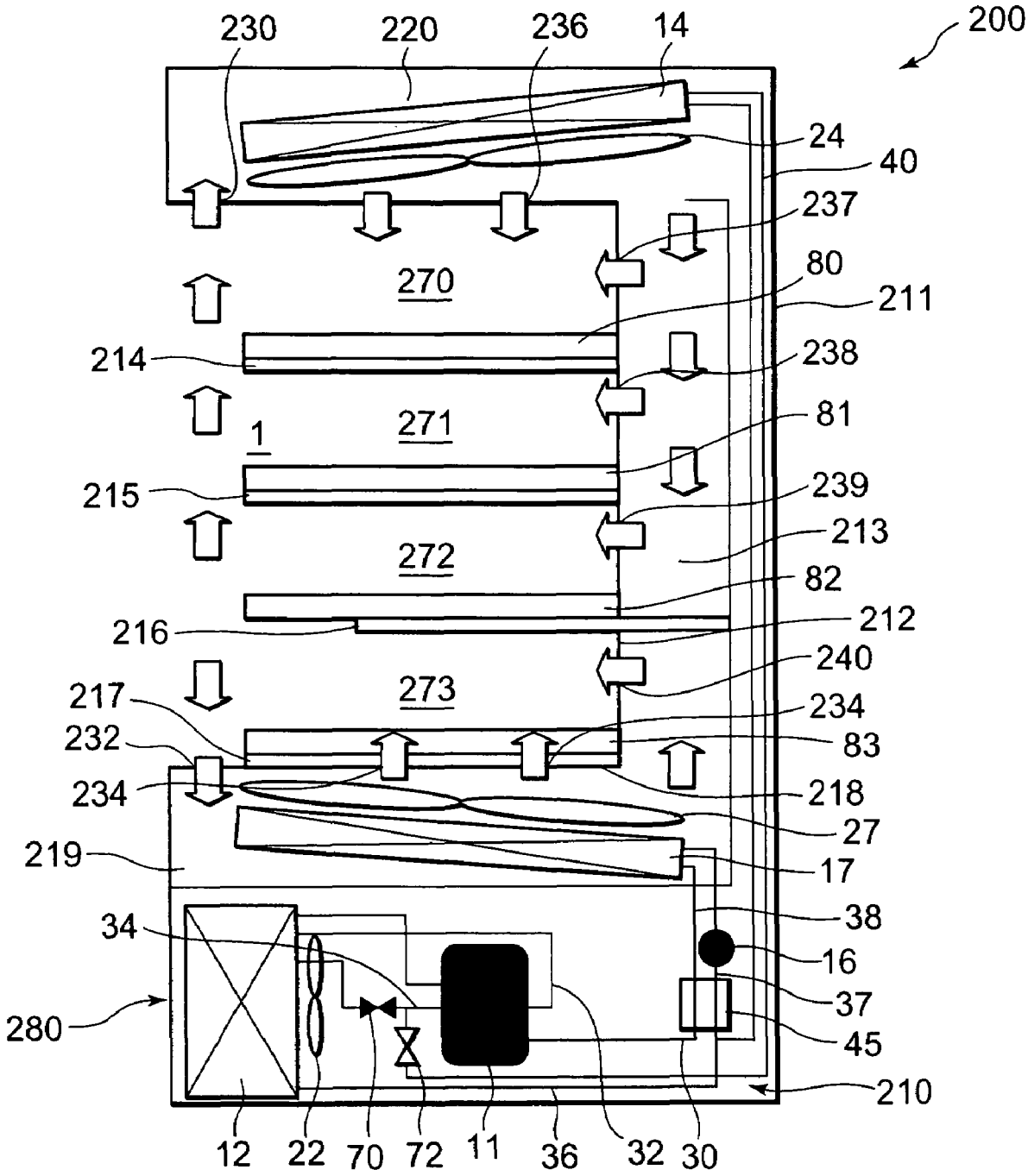
FIG. 7 is another internal configuration diagram of the heating/cooling system of FIG. 6.

Next, referring to FIGS. 6 and 7, description will be made of an embodiment in which the heating/cooling system of the invention is applied to an open showcase 200. FIGS. 6 and 7 are vertical section side diagrams of the open showcase 200. It should be noted that portions of FIGS. 6 and 7 denoted by reference numerals similar to those of FIGS. 1 to 5 exhibit identical or similar effects.

The open showcase 200 of the embodiment is a vertical type open showcase installed in a store such as a supermarket, which comprises an insulated wall 211 formed into a roughly U shape in section, and side plates (not shown) mounted to both sides of the insulated wall. A partition plate 212 is mounted to the inside of the insulated wall 211, a duct 213 is formed between the insulated wall 211 and the partition plate 212, and the inside of the partition plate 212 is a storage room 1.

Plural stages (4 stages in the embodiment) of shelves are installed in the storage room 1. Spaces above the shelves 214 and 215 are set as heating chambers 270 and 271 for heating articles, a space above the shelve 216 is set as a receiving room 272 for receiving articles, and a space above the shelf 217 is set as a cooling chamber 273 for cooling articles. Electric heaters 80, 81, 82 and 83 are mounted on the shelves 214, 215, 216, and 217 as auxiliary heaters to heat the heating chambers 270, 271 and the receiving room 272, and the cooling chamber 273. These electric heaters 80, 81, 82, and 83 are provided to compensate for an efficiency shortage due to heating by a radiator 14 (described later).

Suction ports 230, 232 are formed in upper and lower edges of a front opening of the storage room 1. The suction port 230 is communicated with an upper duct 220 (described later), and the suction port 232 is communicated with a bottom duct 219 (described later).

A deck pan 218 is mounted to a bottom part of the storage room 1. A lower part of the deck pan 218 is the bottom duct 219 communicated with the duct 213. In the bottom duct 219, an evaporator 17 and a fan 27 are installed to cool the receiving room 272 and the cooling chamber 273. In the deck pan 218, holes 234, 234 are formed through the cooling chamber 273 and the bottom duct 219 up and down. Air heat-exchanged with the evaporator 17 is blown through the holes 234, 234 into the cooling chamber 273 by the fan 27.

On the other hand, the upper duct 220 communicated with the dust 213 is similarly formed in the upper part of the storage room 1. In this upper duct 220, a radiator 14 and a fan 24 are installed to heat the heating chambers 270, 271 and the receiving room 272. Holes 236, 236 are formed through the heating chamber 270 and the upper duct 220 up and down. Air heat-exchanged with the radiator 14 is blown through the holes 236, 236 into the heating chamber 270 by the fan 24.

In the partition plate 212, communication holes 237, 238, 239, and 240 are formed to communicate the inside of the duct 213 with the chambers (heating chambers 270, 271, the receiving room 272, and the cooling chamber 273). The air heat-exchanged with the evaporator 17 or the radiator 14 is blown through the communication holes 237, 238, 239, and 240 into the chambers by the fan 27 or 24.

Here, the shelves 215 and 216 can penetrate the duct 213 to partition it into upper and lower parts. That is, holes (not shown) are formed on backsides of the shelves 215, 216 (duct 213 side in FIGS. 6 and 7) to insert the shelves 215, 216 into the duct 213. By inserting the shelf 215 or 216 through the hole into the duct 213, a flow of air in the duct 213 can be cut off, and the duct 213 can be partitioned into upper and lower parts.

On the other hand, a machine room 280 is formed below the bottom duct 219. This machine room 280 accommodates a compressor 11, a gas cooler 12, an internal heat exchanger 45, an expansion valve 16 as a pressure reducing device, and the like which constitute a refrigerant circuit 210 (described later). It should be noted that the compressor 11 used in the embodiment is 2-stage compression type compressor, which comprises a driving element and first and second compression elements driven by the driving element. The gas cooler 12 is designed to release heat from a high-temperature and high-pressure refrigerant discharged from the compressor 11, and a fan 22 is installed near the gas cooler 12.

The refrigerant circuit 210 comprises the compressor 11, the gas cooler 12, the radiator 14, the expansion valve 16, the evaporator 17, and the like. That is, a refrigerant discharge pipe 34 of the compressor 11 is connected to an inlet of the gas cooler 12. A refrigerant pipe 36 connected to an outlet side of the gas cooler 12 passes through the internal heat exchanger 45. It should be noted that the internal heat exchanger 45 is designed to exchange heat between high-pressure side and low-pressure side refrigerants. A refrigerant pipe 37 connected to the outlet of the internal heat exchanger 45 is connected through the expansion valve 16 to an inlet of the evaporator 17 installed in the bottom duct 219. A refrigerant pipe 38 out of the evaporator 17 passes through the internal heat exchanger 45 to be connected to a refrigerant introduction pipe 30. It should be noted that the refrigerant introduction pipe 30 is connected to a first compression element of the compressor 11. A low-pressure refrigerant is sucked through the pipe 30 into the compressor 11.

In FIGS. 6 and 7, a reference numeral 32 denotes a refrigerant introduction pipe for introducing a refrigerant compressed by the first compression element of the compressor 11 into a second compression element.

Here, a first bypass circuit 40 is branched and connected to the midway of the refrigerant discharge pipe 34. An outlet of this first bypass circuit 40 is connected to the midway of the refrigerant pipe 36. The first bypass circuit 40 is provided to pass through the radiator 14 installed in the upper duct 220. In the inlet side of the radiator 14 of the first bypass circuit 40 and the refrigerant discharge pipe 34, solenoid valves 70, 72 are installed as flow path control means for controlling flowing of a high-pressure refrigerant compressed by the second compression element of the compressor 11 through the refrigerant discharge pipe 34 to the gas cooler 12 or the first bypass circuit 40. Opening/closing of these valves is controlled by a control device (not shown).

It should be noted that carbon dioxide is sealed as a refrigerant in the refrigerant circuit 210, and a high-pressure side of the refrigerant circuit 210 becomes supercritical pressure.

(1) Mode of using receiving room 272 as cooling chamber

Next, an operation of the open showcase 200 configured in the aforementioned manner will be described. To begin with, referring to FIG. 6, the mode of using the receiving room 272 as a cooling chamber for cooling articles will be described.

When a worker inserts the shelf 215 into the duct 213 (at this time, the shelf 216 is not inserted into the duct 213), the shelf 215 partitions the duct 213 into upper and lower parts. The control device (not shown) closes the solenoid valve 70, and opens the solenoid valve 72 to open the first bypass circuit 40. Accordingly, refrigerants discharged from the compressor 11 all flow through the refrigerant discharge pipe 34 to the first bypass circuit 40 without flowing to the gas cooler 12.

The control device starts running of the electric heaters 80, 81 installed on the shelves 214, 215 of the heating chambers 270, 271. Accordingly, the heating chambers 270, 271 are heated. Additionally, the control device starts running of the fans 27 and 24 received in the bottom and upper ducts 219 and 220, and drives the driving element of the compressor 11. Thus, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of a sealed container, the refrigerant gas is sucked into the second compression element. The refrigerant sucked into the second compression element is compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure.

The refrigerant gas discharged from the compressor 11 flows from the midway of the refrigerant discharge pipe 34 through the first bypass circuit 40 into the radiator 14 installed in the upper duct 220 since the solenoid valve 70 is closed while the solenoid valve 72 is opened as described above. Here, the high-temperature and high-pressure refrigerant compressed by the compressor 11 is not condensed, but the fans are run in the supercritical state of the refrigerant gas. Heat is released from the high-temperature and high-pressure refrigerant gas by the evaporator 14. It should be noted that ambient air heated as a result of heat releasing from the refrigerant by the evaporator 14 enters the heating chamber 270 through the holes 236, 236 by running the fan 24 to heat the same. The air heated by the evaporator 14 passes through the duct 213 by the fan 24, and enters the heating chambers 270 and 271 through the communication holes 237 and 238 to heat the insides thereof. According to the invention, the carbon dioxide is used for the refrigerant. Thus, since the refrigerant is not condensed at the radiator 14, a heat exchanging efficiency of the evaporator 14 is extremely high, and the insides of the heating chambers 270, 271 can be set to sufficiently high temperatures.

Air (hot air) blown by the fan 24 is not blown to a part below the shelf 215 since the duct 213 is partitioned by the shelf 215 as described above. Accordingly, the heating chambers 270 and 271 above the shelf 215 can be heated.

The air (hot air) blown into the heating chambers 270, 271 repeats a cycle of being sucked through the suction port 230 into the upper duct 220 after heating the heating chambers 270, 271, and being heated again by the evaporator 14.

On the other hand, the refrigerant from which the heat has been released by the evaporator 14 enters the refrigerant pipe 36 from the first bypass circuit 40, and passes through the internal heat exchanger 45. There, the heat of the refrigerant is drawn by a low-pressure side refrigerant out of the evaporator 17, and the refrigerant is further cooled. The presence of the internal heat exchanger 45 causes the low-pressure side refrigerant to draw the heat from the refrigerant which goes out of the evaporator 14 and passes through the internal heat exchanger 45. A supercooling degree of the refrigerant is increased by a corresponding amount. Thus, a cooling efficiency of the evaporator 17 is increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state flows into the evaporator 17 installed in the bottom duct 219. The refrigerant is evaporated there, and absorbs heat from ambient air to exhibit a cooling effect. It should be noted that the air cooled by the evaporation of the refrigerant at the evaporator 17 enters the cooling chamber 273 through the holes 234, 234 by running the fan 27 to cool the inside thereof. Further, the air cooled by the evaporator 17 enters the duct 213 by running the fan 27. The air is then blown through the communication holes 239 and 240 into the receiving room 272 and the cooling chamber 273 to cool the insides thereof.

Here, air (cold air) blown by the fan 27 is not blown to a part above the shelf 215 since the duct 213 is partitioned by the shelf 215 as described above. Accordingly, the receiving room 272 and the cooling chamber 273 below the shelf 215 can be cooled.

It should be noted that the air (cold air) blown into the receiving room 272 and the cooling chamber 273 repeats a cycle of being sucked through the suction port 232 into the bottom duct 219 after cooling the receiving room 272 and the cooling chamber 273, and being cooled again by the evaporator 17.

On the other hand, the refrigerant evaporated at the evaporator 17 flows out thereof, enters the refrigerant pipe 38, and passes through the internal heat exchanger 45. There, the refrigerant repeats a cycle of drawing heat from the high-pressure side refrigerant, receiving a heating effect to become a complete gas, and being sucked through the refrigerant introduction pipe 30 into the first compression element of the compressor 11.

(2) Mode of using receiving room 272 as heating chamber

Next, referring to FIG. 7, description will be made of an operation on a mode of using the receiving room 272 as a heating chamber for heating articles.

When a worker inserts the shelf 216 into the duct 213 (at this time, the shelf 215 is not inserted into the duct 213), the shelf 216 partitions the duct 213 into upper and lower parts. The control device (not shown) closes the solenoid valve 70, and opens the solenoid valve 72 to open the first bypass circuit 40. Accordingly, refrigerants discharged from the compressor 11 all flow through the refrigerant discharge pipe 34 to the first bypass circuit 40 without flowing to the gas cooler 12.

The control device starts running of the electric heaters 80, 81, and 82 installed on the shelves 214, 215, and 216 of the heating chambers 270, 271, and the receiving room 272. Accordingly, the heating chambers 270, 271, and the receiving room 272 are heated. Additionally, the control device starts running of the fans 27 and 24 received in the bottom and upper ducts 219 and 220, and drives the driving element of the compressor 11. Thus, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container, the refrigerant gas is sucked into the second compression element. The refrigerant sucked into the second compression element is compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure.

The refrigerant gas discharged from the compressor 11 flows from the midway of the refrigerant discharge pipe 34 through the first bypass circuit 40 into the radiator 14 installed in the upper duct 220 since the solenoid valve 70 is closed while the solenoid valve 72 is opened as described above. Here, the high-temperature and high-pressure refrigerant compressed by the compressor 11 is not condensed, but the fans are run in the supercritical state of the refrigerant gas. Heat is released from the high-temperature and high-pressure refrigerant gas by the evaporator 14. It should be noted that ambient air heated as a result of heat releasing from the refrigerant by the evaporator 14 enters the heating chamber 270 through the holes 236, 236 by running the fan 24 to heat the inside thereof. The air heated by the evaporator 14 passes through the duct 213 by the fan 24, and enters the heating chambers 270, 271 and the receiving room 272 through the communication holes 237 and 238 to heat the insides thereof. According to the invention, the carbon dioxide is used for the refrigerant. Thus, since the refrigerant is not condensed at the radiator 14, a heat exchanging efficiency of the evaporator 14 is extremely high, and air in the heating chambers 270, 271 and the receiving room 272 can be set to sufficiently high temperatures.

Air (hot air) blown by the fan 24 is not blown to a part below the shelf 216 since the duct 213 is partitioned by the shelf 216 as described above. Accordingly, the heating chambers 270, 271, and the receiving room 272 above the shelf 216 can be heated.

The air (hot air) blown into the heating chambers 270, 271, and the receiving room 272 repeats a cycle of being sucked through the suction port 230 into the upper duct 220 after heating the heating chambers 270, 271 and the receiving room 272, and being heated again by the evaporator 14.

On the other hand, the refrigerant from which the heat has been released by the evaporator 14 enters the refrigerant pipe 36 from the first bypass circuit 40, and passes through the internal heat exchanger 45. There, the heat of the refrigerant is drawn by a low-pressure side refrigerant out of the evaporator 17, and the refrigerant is further cooled. The presence of the internal heat exchanger 45 causes the low-pressure side refrigerant to draw the heat from the refrigerant which goes out of the evaporator 14 and passes through the internal heat exchanger 45. A supercooling degree of the refrigerant is increased by a corresponding amount. Thus, a cooling efficiency of the evaporator 17 is increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state flows into the evaporator 17 installed in the bottom duct 219. The refrigerant is evaporated there, and absorbs heat from ambient air to exhibit a cooling effect. It should be noted that the air cooled by the evaporation of the refrigerant at the evaporator 17 enters the cooling chamber 273 through the holes 234, 234 by running the fan 27 to cool the inside thereof. Further, the air cooled by the evaporator 17 enters the duct 213 by running the fan 27. The air is then blown through the communication hole 240 into the receiving room 273 to cool the inside thereof.

Here, air (cold air) blown by the fan 27 is not blown to a part above the shelf 216 since the duct 213 is partitioned by the shelf 216 as described above. Accordingly, the receiving room 273 only below the shelf 216 can be cooled.

It should be noted that the air (cold air) blown into the cooling chamber 273 repeats a cycle of being sucked through the suction port 232 into the bottom duct 219 after cooling the cooling chamber 273, and being cooled again by the evaporator 17.

On the other hand, the refrigerant evaporated at the evaporator 17 flows out thereof, enters the refrigerant pipe 38, and passes through the internal heat exchanger 45. There, the refrigerant repeats a cycle of drawing heat from the high-pressure side refrigerant, receiving a heating effect to become a complete gas, and being sucked through the refrigerant introduction pipe 30 into the first compression element of the compressor 11.

As described above, according to the embodiment, the radiator 14, the evaporator 17, and the fans 24, 27 for blowing air heat-exchanged with the radiator 14 and the evaporator 17 are installed outside the receiving room 272, and the duct 213 is partitioned by the shelf 215 or 216. Thus, heating/cooling of the receiving room 272 can be switched.

In addition to heating by the radiator 14, by using the electric heaters, it is possible to sufficiently heat the heating chambers 270, 271, and the receiving room 272. In this case, the electric heaters are used to supplement the heating by the radiator 14. Thus, compared with a case of heating each chamber only by the electric heater, a capacity of the electric heater can be reduced. As a result, it is possible to reduce power consumption.

According to the embodiment, it is only the receiving room 272 that can use hot air/cold air in a switching manner. However, the invention is not limited to the embodiment. For example, the shelf 214 is structured to be inserted into the duct 213, and the duct 213 is partitioned into upper and lower parts by the shelf 214. Accordingly, the heating chamber 271 can also be used as a cooling chamber.

Next, referring to FIGS. 8 to 25, embodiments of another invention will be described in detail.

Embodiment 2-1

Figure 8:
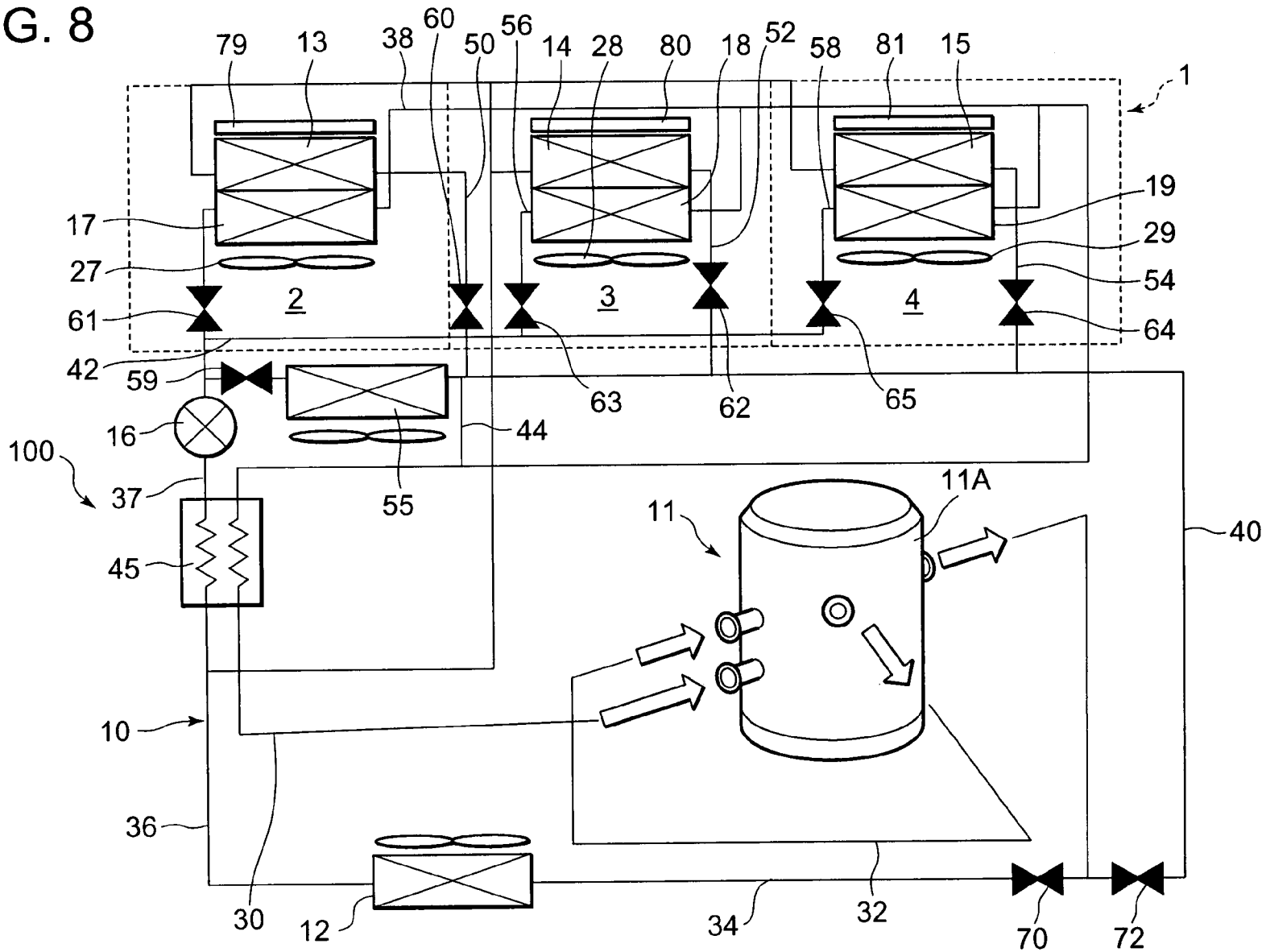
FIG. 8 is a refrigerant circuit diagram of a heating/cooling system according to an embodiment of another invention (Embodiment 2-1)

FIG. 8 is a schematic configuration diagram showing a heating/cooling system 100 according to an embodiment of the invention. It should be noted that the heating/cooling system of the invention can be used for a showcase, an automatic vending machine, an air conditioner a cooling/heating cabinet or the like as in the previous case.

In FIG. 8, a reference numeral 1 denotes a storage room of the heating/cooling system 100. In this storage room 1, receiving rooms 2, 3 and 4 are disposed, and surrounded with insulating members.

In the receiving room 2, a radiator 13 for heating the receiving room 2, an electric heater 79 as an auxiliary heater, an evaporator 17 for cooling the receiving room 2, and a fan 27 for blowing (circulating) air heat-exchanged with the radiator 13 or the evaporator 17, or air heated by the electric heater 79 into the receiving room 2 are installed.

In the receiving room 3, a radiator 14 and an electric heater 80 as an auxiliary heater for heating the receiving room 3, an evaporator 18 for cooling the receiving room 3, and a fan 28 for blowing (circulating) air heat-exchanged with the radiator 14 or the evaporator 18 or air heated by the electric heater 80 into the receiving room 3 are installed.

Similarly, in the receiving room 4, a radiator 15 and an electric heater 81 as an auxiliary heater for heating the receiving room 4, an evaporator 19 for cooling the receiving room 4, and a fan 29 for blowing (circulating) air heat-exchanged with the radiator 15 or the evaporator 19 or air heated by the electric heater 81 into the receiving room 4 are installed.

Additionally, in FIG. 8, a reference numeral 10 denotes a refrigerant circuit which comprises a compressor 11, a gas cooler 12, the radiators 13, 14 and 15, an expansion valve 16 as a pressure reducing device, and the evaporators 17, 18 and 19, and the like. The gas cooler 12 is provided separately from the radiators 13, 14 and 15 installed in the receiving rooms 2, 3 and 4 to cause heat releasing from a refrigerant.

That is a refrigerant discharge pipe 34 of the compressor 11 is connected to an inlet of the gas cooler 12. Here, the compressor 11 of the embodiment is a 2-stage compression type compressor which comprises a driving element disposed in a sealed container 11A, and first and second compression elements driven by the driving element.

In the drawing, a reference numeral 30 denotes a refrigerant introduction pipe for introducing a refrigerant into a cylinder of the first compression element (not shown) of the compressor 11. One end of this refrigerant introduction pipe 30 is communicated with the cylinder of the first compression element (not shown). The other end of the refrigerant introduction pipe 30 is connected to an outlet of an internal heat exchanger 45 described below.

A refrigerant introduction pipe 32 is a refrigerant pipe for introducing a refrigerant compressed by the first compression element into the second compression element. The refrigerant discharge pipe 34 is a refrigerant pipe for discharging a refrigerant compressed by the second compression element to the gas cooler 12.

A refrigerant pipe 36 connected to an outlet side of the gas cooler 12 passes through the internal heat exchanger 45. It should be noted that the internal heat exchanger 45 is designed to exchange heat between high-pressure side and low-pressure side refrigerants.

A refrigerant pipe 37 connected to the outlet of the internal heat exchanger 45 is connected through the expansion valve 16 to an inlet of the evaporator 17 of the receiving room 2.

Here, a first bypass circuit 40 is branched and connected to the midway of the refrigerant discharge pipe 34. This first bypass circuit 40 is further branched into pipes 50, 52 and 54, and then combined together to be connected to the refrigerant pipe 36. In the first bypass circuit 40 and the refrigerant discharge pipe 34, solenoid valves 70, 72 are installed as flow path control means for controlling refrigerant circulation for the first bypass circuit 40 and the gas cooler 12.

The pipe 50 is disposed to pass through the radiator 13 installed in the receiving room 2. In the pipe 50 of the inlet side of the radiator 14, a solenoid valve 60 is installed as flow path control means for controlling refrigerant circulation for the radiator 14.

The pipe 52 is disposed to pass through the radiator 14 installed in the receiving room 3. In the pipe 52 of the inlet side of the radiator 14, a solenoid valve 62 is installed as flow path control means for controlling refrigerant circulation for the radiator 14.

The pipe 54 is disposed to pass through the radiator 15 installed in the receiving room 4. In the pipe 54 of the inlet side of the radiator 15, a solenoid valve 64 is installed as flow path control means for controlling refrigerant circulation for the radiator 15.

A second bypass circuit 42 is branched and connected to the midway of the refrigerant pipe 37 out of the expansion valve 16. This second bypass circuit 42 is further branched into pipes 56 and 58, and then combined with a pipe 38 out of the evaporator 17.

The pipe 56 is disposed to pass through the evaporator 18 installed in the receiving room 3. In the pipe 56 of the inlet side of the evaporator 18, a solenoid valve 63 is installed as flow path control means for controlling refrigerant circulation for the evaporator 18.

The pipe 58 is disposed to pass through the evaporator 19 installed in the receiving room 4. In the pipe 58 of the inlet side of the evaporator 19, a solenoid valve 65 is installed as flow path control means for controlling refrigerant circulation for the evaporator 58.

On a downstream side of the refrigerant pipe 37 to which the second bypass circuit 42 of the inlet side of the evaporator 17 is connected, a solenoid valve 61 is installed as flow path control means for controlling refrigerant circulation for the evaporator 17.

Furthermore, a third bypass circuit 44 is branched and connected to the refrigerant pipe 37 on an upstream side of the branched second bypass circuit 42 on the outlet side of the expansion valve 16. This third bypass circuit is disposed to pass through an auxiliary evaporator 55, and a pipe out of the auxiliary evaporator 55 is combined with the refrigerant pipe 38 out of the evaporator 17. On the inlet side of the auxiliary evaporator 55 of the third bypass circuit 44, a solenoid valve 59 is installed as flow path control means for controlling refrigerant circulation for the auxiliary evaporator 55. It should be noted that the auxiliary evaporator 55 is provided separately from the evaporators 17, 18 and 19 installed in the receiving rooms 2, 3 and 4, and designed to evaporate a refrigerant.

Here, as a refrigerant sealed in the refrigerant circuit 10, carbon dioxide ($CO_2$) which is a natural refrigerant kind to a global environment is used in consideration of combustibility, toxicity, and the like.

Opening/closing of each of the solenoid valves 59, 60, 61, 62, 63, 64, 65, 70, and 72 is controlled by a control device (not shown). The control device controls refrigerant circulation by the solenoid valves 59, 60, 61, 62, 63, 64, 65, 70, and 72 to enable switching between hot air and cold air in the receiving rooms 2, 3 and 4. It should be noted that the control device is control means in charge of controlling the heating/cooling system 100, and controls running or the like of the compressor 11 and the fans 27, 28, and 29.

(1) Mode of using receiving rooms 2, 3 and 4 as cooling chambers

Figure 9:
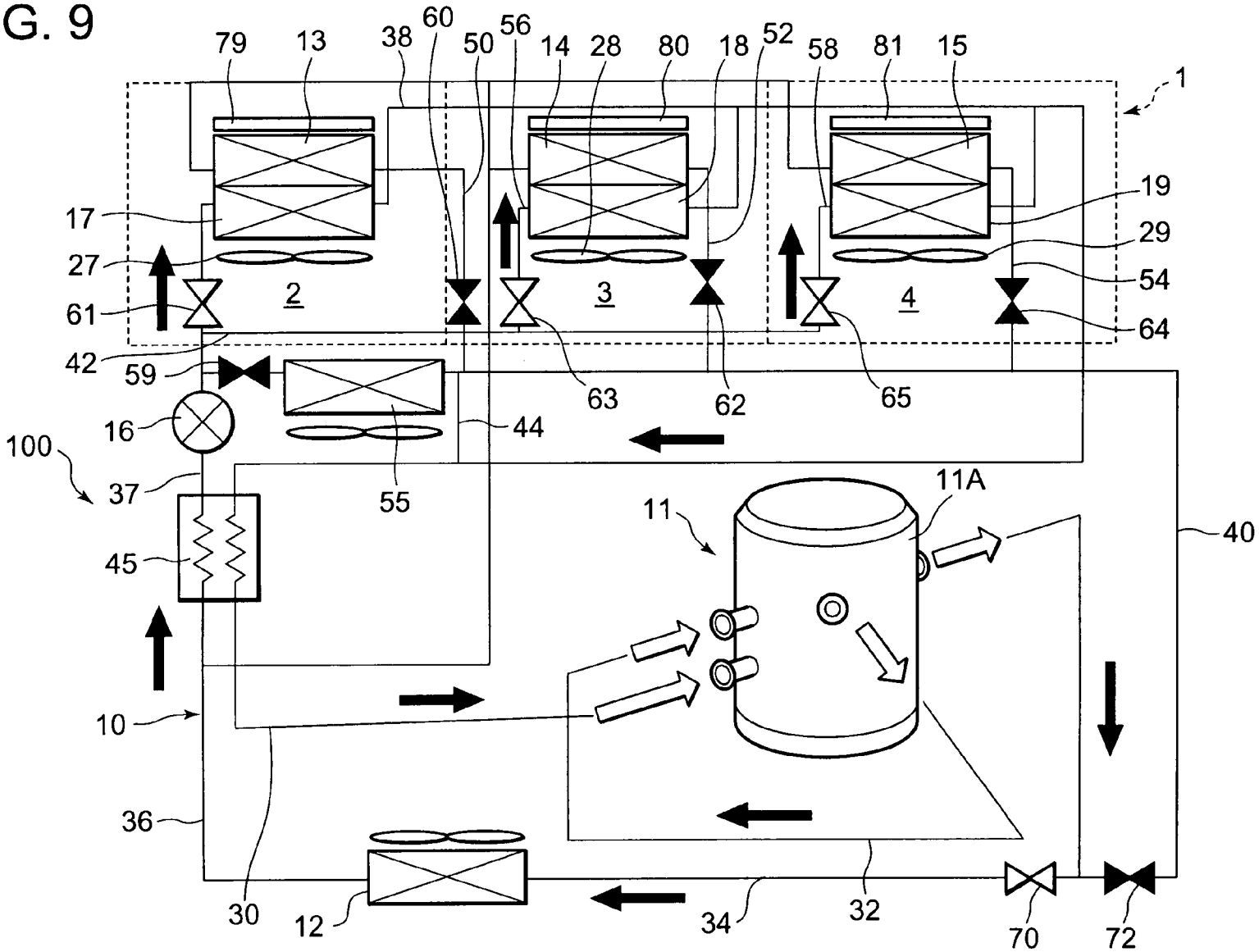
FIG. 9 is a refrigerant circuit diagram of FIG. 8 showing a flow of a refrigerant on a mode of using receiving rooms 2, 3 and 4 as cooling chambers.

Next, an operation of the heating/cooling system 100 of the invention configured in the aforementioned manner will be described. To begin with, referring to FIG. 9, a mode of using the receiving rooms 2, 3 and 4 as cooling chambers for cooling articles will be described. FIG. 9 is a refrigerant circuit diagram showing a flow of a refrigerant on this mode. The solenoid valve 70 is opened by the control device (not shown), while the solenoid valve 72 is closed to close the first bypass circuit 40. Accordingly, refrigerants discharged from the compressor 11 all flow through the refrigerant discharge pipe 34 to the gas cooler 12.

The control device closes the solenoid valves 60, 62 and 64 to close the refrigerant pipes 50, 52 and 54, while it opens the solenoid valves 63 and 65 to open the pipes 56, 58. Accordingly, refrigerants from the second bypass circuit 42 flow through the pipes 56 and 58. The control device opens the solenoid valve 61 to allow flowing of a refrigerant from the expansion valve 16 to the evaporator 17, and closes the solenoid valve 59 to close the third bypass circuit 44. It should be noted that white solenoid valves indicate states of valves opened by the control device and black solenoid valves indicate states of valves closed by the control device in FIGS. 9 to 13.

The control device starts running of the fans 27, 28 and 29 installed in the receiving rooms 2, 3 and 4, and drives the driving element of the compressor 11. Accordingly, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container 11A, the refrigerant gas is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows through the refrigerant discharge pipe 34 into the gas cooler 12 since the solenoid valve 70 is opened while the solenoid valve 72 is closed as described above.

Here, the high-temperature and high-pressure refrigerant compressed by the compressor 11 is not condensed, but the fans are run in the supercritical state of the refrigerant gas. The high-temperature and high-pressure refrigerant gas passes through the internal heat exchanger 45 after heat is released therefrom by the gas cooler 12. There, the heat of the refrigerant is drawn by low-pressure side refrigerants out of the evaporators 17, 18 and 19, and the refrigerant is further cooled. The presence of the internal heat exchanger 45 causes the low-pressure side refrigerant to draw the heat from the refrigerant which goes out of the gas cooler 12 and passes through the internal heat exchanger 45. A supercooling degree of the refrigerant is increased by a corresponding amount. Thus cooling efficiencies of the evaporators 17, 18, and 19 are increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state by the expansion valve 16 flows into the evaporator 17 installed in the cooling chamber 2 since the solenoid valve 61 is opened as described above. The refrigerant is evaporated there, and absorbs heat from ambient air to exhibit a cooling effect. It should be noted that the air cooled by the evaporation of the refrigerant at the evaporator 17 is circulated in the receiving room 2 by running the fan 27 to cool the inside thereof. Subsequently, the refrigerant flows out of the evaporator 17 and enters the refrigerant pipe 38.

Meanwhile, a part of the refrigerant reduced in pressure by the expansion valve 16 enters the second bypass circuit 42 branched and connected to the midway of the refrigerant pipe 37 since the solenoid valves 63 and 65 are opened as described above, and the refrigerant is further branched to enter the pipes 56 and 58. The refrigerant that has entered the pipe 56 flows into the evaporator 18 installed in the receiving room 3, evaporates there, and absorbs heat from ambient air to exhibit a cooling effect. The air cooled by the evaporation of the refrigerant at the evaporator 18 is circulated in the receiving room 3 by running the fan 28 to cool the same. Subsequently, the refrigerant flows out of the evaporator 18, and combines with the refrigerant from the evaporator 17 which flows through the refrigerant pipe 38.

On the other hand, the refrigerant that has entered the pipe 58 flows into the evaporator 19 installed in the receiving room 4, evaporates there, and absorbs heat from ambient air to exhibit a cooling effect. The air cooled by the evaporation of the refrigerant at the evaporator 19 is circulated in the receiving room 4 by running the fan 29 to cool the same. Subsequently, the refrigerant out of the evaporator 19 combines with the refrigerants from the evaporators 17 and 18 which flow through the refrigerant pipe 38, and reaches the internal heat exchanger 45.

The refrigerant draws heat from the aforementioned high-pressure side refrigerant to receive a heating effect. Here, the refrigerant evaporated by each of the evaporators 17, 18, and 19 to become low in temperature and fed out therefrom may be set not in a completely gas state but in a liquid mixed state. However, the refrigerant is passed through the internal heat exchanger 45 to be heat-exchanged with the high-pressure side high-temperature refrigerant, thereby being superheated. At this time, a superheating degree of the refrigerant is secured, causing the refrigerant to become a complete gas.

Accordingly, the refrigerant out of each of the evaporators 17, 18, and 19 can be surely gasified, making it possible to assure prevention of a liquid-back, i.e., suction of a liquid refrigerant into the compressor 11, and to prevent a problem of damaging of the compressor 11 by liquid compression without disposing any accumulators or the like on the low-pressure side. Thus, it is possible to improve reliability of the heating/cooling system 100.

It should be noted that the refrigerant heated by the internal heat-exchanger 45 repeats a cycle of being sucked though the refrigerant introduction pipe 30 into the first compression element of the compressor 11.

As described above, the gas cooler 12 is provided separately from the radiators 13, 14 and 15 for heating the receiving rooms 2, 3 and 4, and the heat is released from the refrigerant by the gas cooler 12. Thus, it is possible to use all the receiving rooms 2, 3 and 4 as cooling chambers for cooling articles.

Figure 10:
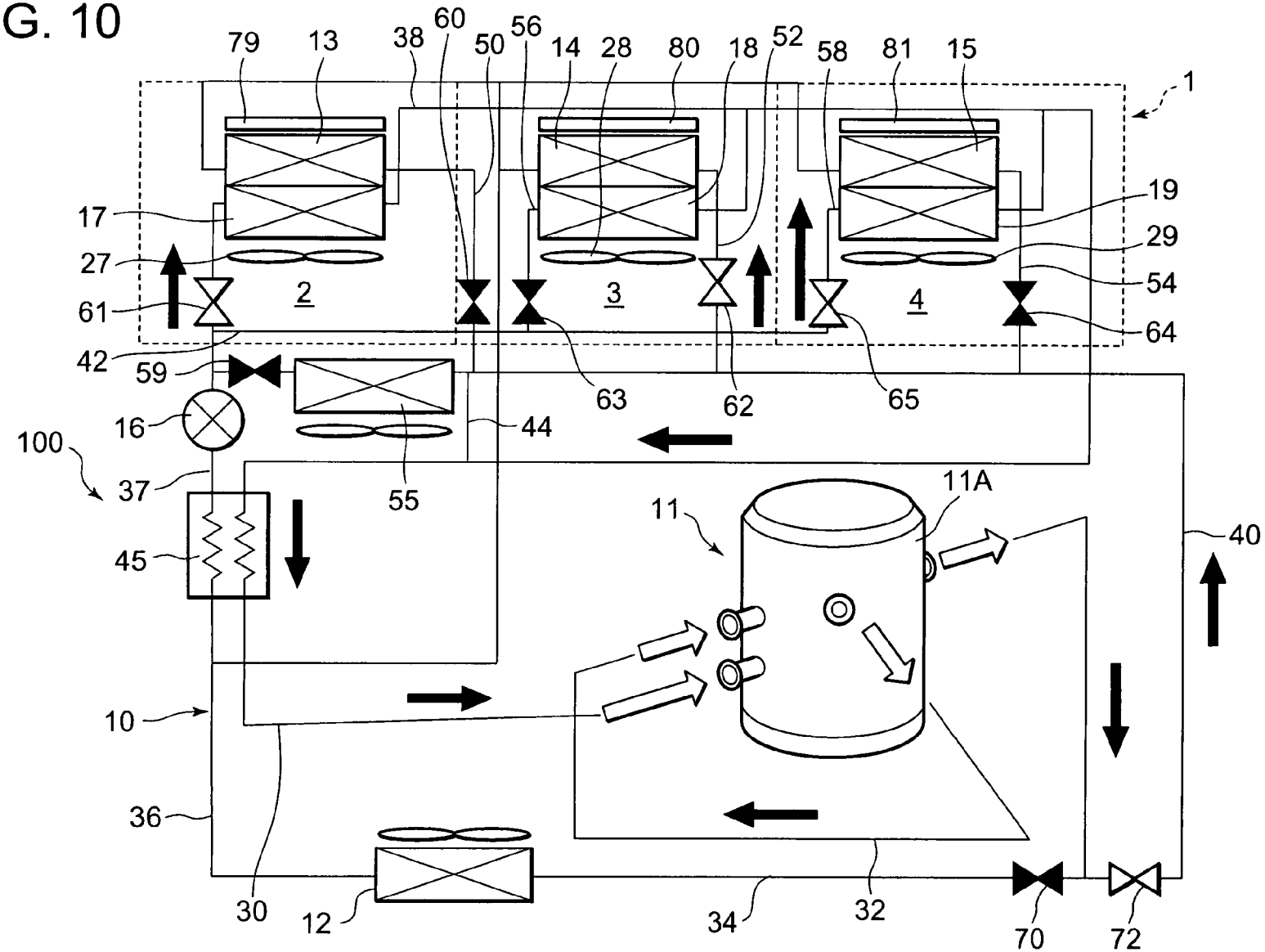
FIG. 10 is a refrigerant circuit diagram of FIG. 8 showing a flow of a refrigerant on a mode of using the receiving rooms 2 and 4 as cooling chambers and the receiving room 3 as a heating chamber.

(2) Mode of using receiving room 2 as cooling chamber, receiving room 3 as heating chamber and receiving room 4 as cooling chamber Next, referring to FIG. 10, description will be made of an operation of the heating/cooling system 100 on a mode of using the receiving room 2 as a cooling chamber for cooling articles, the receiving room 3 as a heating chamber for heating articles and the receiving room 4 as a cooling chamber for cooling articles. FIG. 10 is a refrigerant circuit diagram showing a flow of a refrigerant on this mode.

The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12.

The control device closes the solenoid valves 60 and 64 to close the refrigerant pipes 50 and 54, while it opens the solenoid valve 62 to open the refrigerant pipe 52. Accordingly, a refrigerant from the first bypass circuit 40 flows through the refrigerant pipe 52. The control device closes the solenoid valve 63 to close the pipe 56, while it opens the solenoid valve 65 to open the pipe 58. Accordingly, a refrigerant from the second bypass circuit 42 flows through the pipe 58. Furthermore, the control device closes the solenoid valve 59 to close the third bypass circuit 44, and opens the solenoid valve 61 to allow flowing of a refrigerant from the expansion valve 16 to the evaporator 17 installed in the receiving room 2.

The control device starts running of the fans 27, 28 and 29 received in the receiving rooms 2, 3 and 4, and drives the driving element of the compressor 11. Accordingly, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container 11A, the refrigerant gas is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, as the solenoid valve 62 is opened while the solenoid valve 64 is closed as described above, the refrigerant enters the refrigerant pipe 52 from the first bypass circuit 40, and flows into the radiator 14 installed in the receiving room 3. Here, the high-temperature and high-pressure refrigerant compressed by the compressor 11 is not condensed, but the fans are run in the supercritical state of the refrigerant gas. Heat is released from the high-temperature and high-pressure refrigerant gas by the radiator 14. It should be noted that air heated as a result of heat releasing from the refrigerant by the radiator 14 is circulated in the receiving room 3 to heat the inside thereof by running the fan 28. According to the invention, carbon dioxide is used for the refrigerant. Thus, since the refrigerant is not condensed at the radiator 14, a heat exchanging efficiency of the radiator 14 is extremely high, making it possible to set air to a sufficiently high temperature in the receiving room 3.

Subsequently, the refrigerant enters the refrigerant pipe 36 from the first bypass circuit 40, and passes through the internal heat exchanger 45. There, the heat of the refrigerant is drawn by low-pressure side refrigerants out of the evaporators 17 and 19, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant flows into the evaporator 17 installed in the receiving room 2.

The refrigerant is evaporated there, and absorbs heat from ambient air to exhibit a cooling effect. It should be noted that the air cooled by the evaporation of the refrigerant at the evaporator 17 is circulated in the receiving room 2 by running the fan 27 to cool the inside thereof. Subsequently, the refrigerant flows out of the evaporator 17 and enters the refrigerant pipe 38.

Meanwhile, a part of the refrigerant reduced in pressure by the expansion valve 16 passes through the second bypass circuit 42 from the midway of the refrigerant pipe 37 since the solenoid valve 65 is opened as described above, and enters the pipe 58. The refrigerant that has entered the pipe 58 flows into the evaporator 19 installed in the receiving room 4, evaporates there, and absorbs heat from ambient air to exhibit a cooling effect. The air cooled by the evaporation of the refrigerant at the evaporator 19 is circulated in the receiving room 4 by running the fan 29 to cool the same. Subsequently, the refrigerant flows out of the evaporator 19, and combines with the refrigerant from the evaporator 17 which flows through the refrigerant pipe 38.

The refrigerants combined through the refrigerant pipe 38 repeat a cycle of passing through the internal heat exchanger 45, drawing heat from the high-pressure side refrigerant, receiving a heating effect to become complete gases, and being sucked through the refrigerant introduction pipe 30 into the first compression element of the compressor 11.

Figure 11:
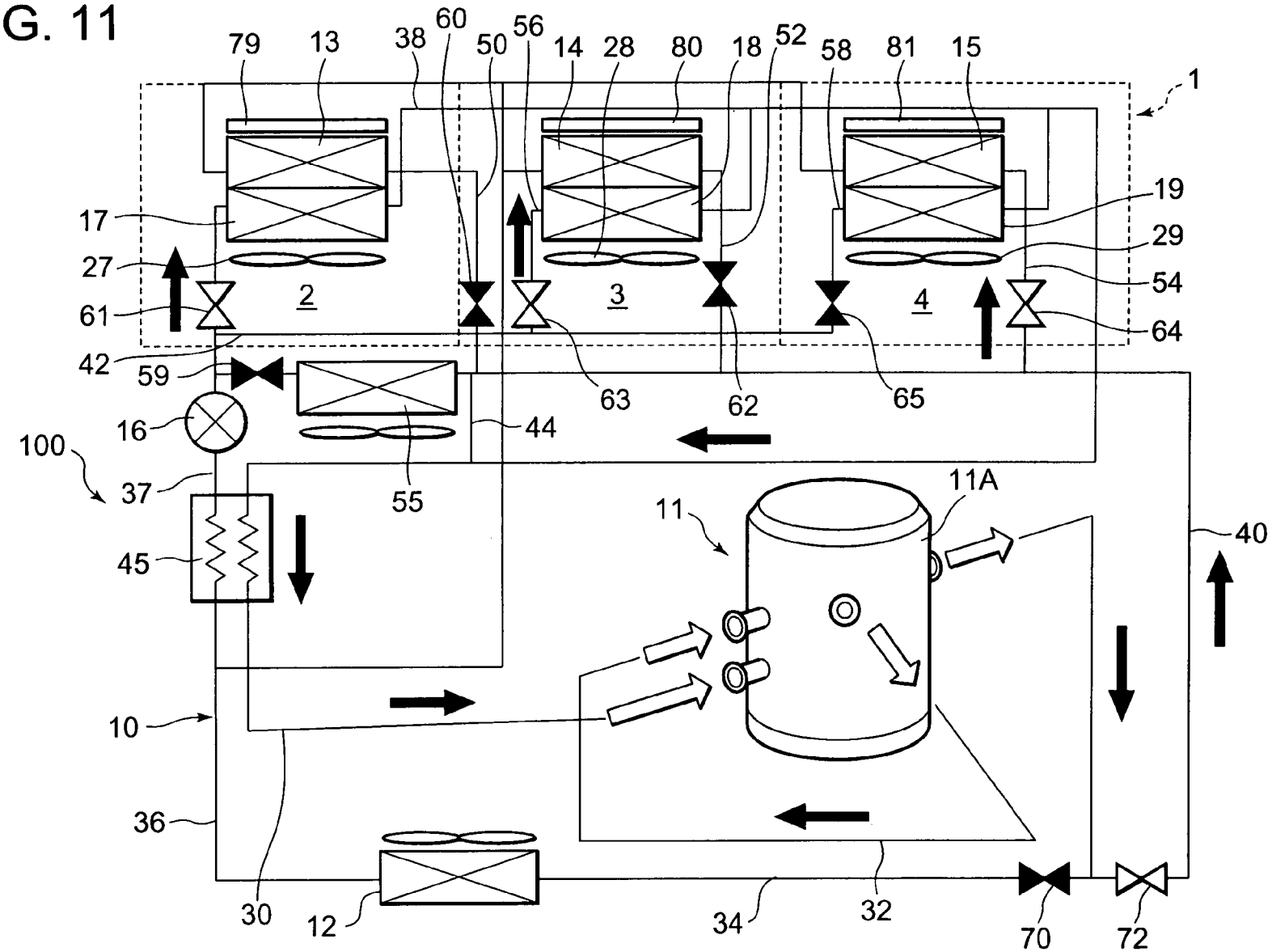
FIG. 11 is a refrigerant circuit diagram of FIG. 8 showing a flow of a refrigerant on a mode of using the receiving rooms 2 and 3 as cooling chambers and the receiving room 4 as a heating chamber.

(3) Mode of using receiving rooms 2 and 3 as cooling chambers and receiving room 4 as heating chamber Next, referring to FIG. 11, description will be made of an operation of the heating/cooling system 100 on a mode of using the receiving rooms 2 and 3 as cooling chambers for cooling articles and the receiving room 4 as a heating chamber for heating articles. FIG. 11 is a refrigerant circuit diagram showing a flow of a refrigerant on this mode.

The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12.

The control device closes the solenoid valves 60 and 62 to close the refrigerant pipes 50 and 52, while it opens the solenoid valve 64 to open the refrigerant pipe 54. Accordingly, a refrigerant from the first bypass circuit 40 flows through the refrigerant pipe 54. The control device opens the solenoid valve 63 to open the pipe 56, while it closes the solenoid valve 65 to close the pipe 58. Accordingly, a refrigerant from the second bypass circuit 42 flows through the pipe 56. Further, the control device opens the solenoid valve 61 to allow flowing of a refrigerant from the expansion valve 16 to the evaporator 17, and closes the solenoid valve 59 to close the third bypass circuit 44.

The control device starts running of the fans 27, 28 and 29 received in the receiving rooms 2, 3 and 4, and drives the driving element of the compressor 11. Accordingly, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container 11A, the refrigerant gas is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, as the solenoid valve 62 is closed while the solenoid valve 64 is opened as described above, the refrigerant enters the refrigerant pipe 54 from the first bypass circuit 40, and flows into the radiator 15 installed in the receiving room 4. Here, the high-temperature and high-pressure refrigerant compressed by the compressor 11 is not condensed, but the fans are run in the supercritical state of the refrigerant gas. Heat is released from the high-temperature and high-pressure refrigerant gas by the radiator 15. It should be noted that air heated as a result of heat releasing from the refrigerant by the radiator 15 is circulated in the receiving room 4 to heat the inside thereof by running the fan 29. According to the invention, carbon dioxide is used for the refrigerant. Thus, since the refrigerant is not condensed at the radiator 15, a heat exchanging efficiency of the radiator 15 is extremely high, making it possible to set air to a sufficiently high temperature in the receiving room 4.

Subsequently, the refrigerant enters the refrigerant pipe 36, and passes through the internal heat exchanger 45. There, the heat of the refrigerant is drawn by low-pressure side refrigerants out of the evaporators 17 and 18, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant flows into the evaporator 17 installed in the receiving room 2.

The refrigerant is evaporated there, and absorbs heat from ambient air to exhibit a cooling effect. It should be noted that the air cooled by the evaporation of the refrigerant at the evaporator 17 is circulated in the receiving room 2 by running the fan 27 to cool the inside thereof. Subsequently, the refrigerant flows out of the evaporator 17 and enters the refrigerant pipe 38.

Meanwhile, a part of the refrigerant reduced in pressure by the expansion valve 16 passes through the second bypass circuit 42 from the midway of the refrigerant pipe 37 since the solenoid valve 63 is opened as described above, and enters the pipe 56. The refrigerant that has entered the pipe 56 flows into the evaporator 18 installed in the receiving room 3, evaporates there, and absorbs heat from ambient air to exhibit a cooling effect. The air cooled by the evaporation of the refrigerant at the evaporator 18 is circulated in the receiving room 3 by running the fan 28 to cool the same. Subsequently, the refrigerant flows out of the evaporator 18, and combines with the refrigerant from the evaporator 17 which flows through the refrigerant pipe 38.

The refrigerants combined through the refrigerant pipe 38 repeat a cycle of passing through the internal heat exchanger 45, drawing heat from the high-pressure side refrigerant, receiving a heating effect to become complete gases, and being sucked through the refrigerant introduction pipe 30 into the first compression element of the compressor 11.

Figure 12:
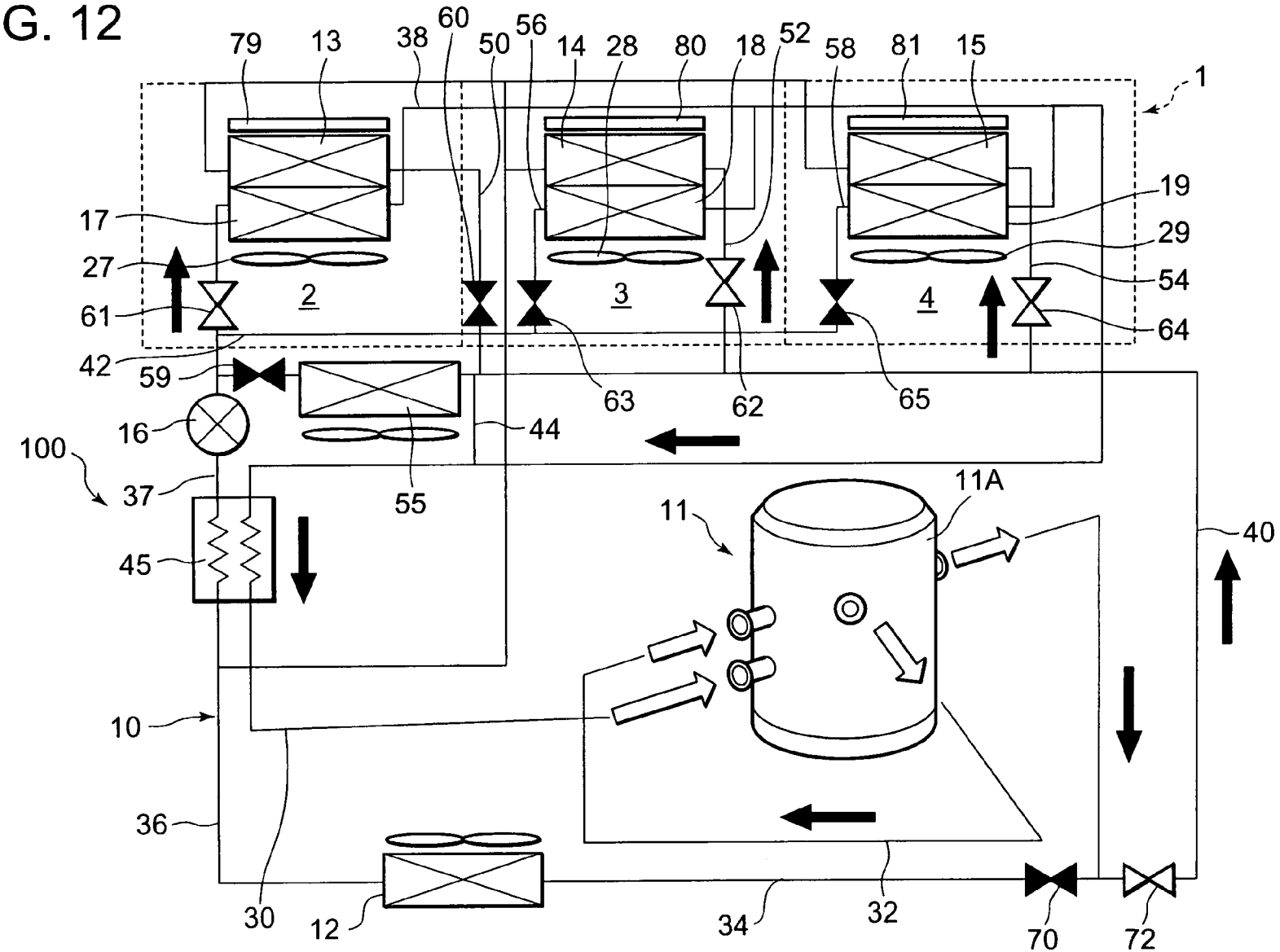
FIG. 12 is a refrigerant circuit diagram of FIG. 8 showing a flow of a refrigerant on a mode of using the receiving room 2 as a cooling chamber and the receiving rooms 3 and 4 as heating chambers.

(4) Mode of using receiving room 2 as cooling chamber and receiving rooms 3 and 4 as heating chambers Next, referring to FIG. 12, description will be made of an operation of the heating/cooling system 100 on a mode of using the receiving room 2 as a cooling chamber for cooling articles and receiving rooms 3 and 4 as heating chambers for heating articles. FIG. 12 is a refrigerant circuit diagram showing a flow of a refrigerant on this mode.

The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12.

The control device closes the solenoid valve 60 to close the refrigerant pipe 50, and opens the solenoid valves 62 and 64 to open the refrigerant pipes 52 and 54. Accordingly, a refrigerant from the first bypass circuit 40 is branched to flow through the refrigerant pipes 52 and 54. The control device opens the solenoid valves 61 and 59, and closes the solenoid valves 63 and 65 to close the pipes 56 and 58. Accordingly, refrigerants from the expansion valve 16 flow into the evaporator 17 installed in the receiving room 2 and the third bypass circuit 44 without flowing to the second bypass circuit 42.

The control device starts running of the fans 27, 28 and 29 received in the receiving rooms 2, 3 and 4, and drives the driving element of the compressor 11. Accordingly, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container 11A, the refrigerant gas is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, as the solenoid valves 62 and 64 are opened, the refrigerant is branched to enter the refrigerant pipes 52 54 from the first bypass circuit 40. The refrigerant that has entered the refrigerant pipe 52 flows into the radiator 14 installed in the receiving room 3, and heat is released therefrom. Here, the high-temperature and high-pressure refrigerant compressed by the compressor 11 is not condensed, but heat is released in the supercritical state of the refrigerant gas. It should be noted that air heated as a result of heat releasing from the refrigerant by the radiator 14 is circulated in the receiving room 3 to heat the inside thereof by running the fan 28. According to the invention carbon dioxide is used for the refrigerant. Thus, since the refrigerant is not condensed at the radiator 14, a heat exchanging efficiency of the radiator 14 is extremely high, making it possible to set air to a sufficiently high temperature in the receiving room 3.

Meanwhile, the refrigerant that has entered the refrigerant pipe 54 flows into the radiator 15 installed in the receiving room 4. The high-temperature and high-pressure refrigerant compressed by the compressor 11 is not condensed, but heat is released therefrom in a supercritical state. It should be noted that air heated as a result of heat releasing by the evaporator 15 is circulated in the receiving room 4 to heat the inside thereof by running the fan 29. According to the embodiment, carbon dioxide is used for the refrigerant. Thus, since the refrigerant is not condensed at the radiator 15, a heat exchanging efficiency of the radiator 15 is extremely high, making it possible to set air to a sufficiently high temperature in the receiving room 4.

Subsequently, the refrigerant out of the radiator 14 or 15 combines with the other refrigerant, enters the refrigerant pipe 36 from the first bypass circuit 40, and passes through the internal heat exchanger 45. There, the heat of the refrigerant is drawn by the low-pressure side refrigerant out of the evaporator 17 and the auxiliary evaporator 55, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant flows into the evaporator 17 installed in the receiving room 2.

The refrigerant is evaporated there, and absorbs heat from ambient air to exhibit a cooling effect. It should be noted that the air cooled by the evaporation of the refrigerant at the evaporator 17 is circulated in the receiving room 2 by running the fan 27 to cool the inside thereof. Subsequently, the refrigerant flows out of the evaporator 17, and enters the refrigerant pipe 38.

Meanwhile, a part of the refrigerant reduced in pressure by the expansion valve 16 enters the third bypass circuit 44, and flows into the auxiliary evaporator 55 installed therein since the solenoid valve 59 is opened as described above. The refrigerant evaporates there and absorbs heat from ambient air to exhibit a cooling effect. Then, the refrigerant combines with the refrigerant from the evaporator 17 which flows through the refrigerant pipe 38, and passes through the internal heat exchanger 45.

There, the refrigerant repeats a cycle of drawing heat from the high-pressure side refrigerant receiving a heating effect to become a complete gas, and being sucked through the refrigerant introduction pipe 30 into the first compression element of the compressor 11.

Thus, even when the receiving rooms 3 and 4 are used as heating chambers for heating articles, by evaporating the refrigerant at the auxiliary evaporator 55 in addition to the evaporator 17, it is possible to sufficiently heat the receiving rooms 3 and 4.

(5) Mode of using receiving rooms 2, 3 and 4 as heating chambers

Figure 13:
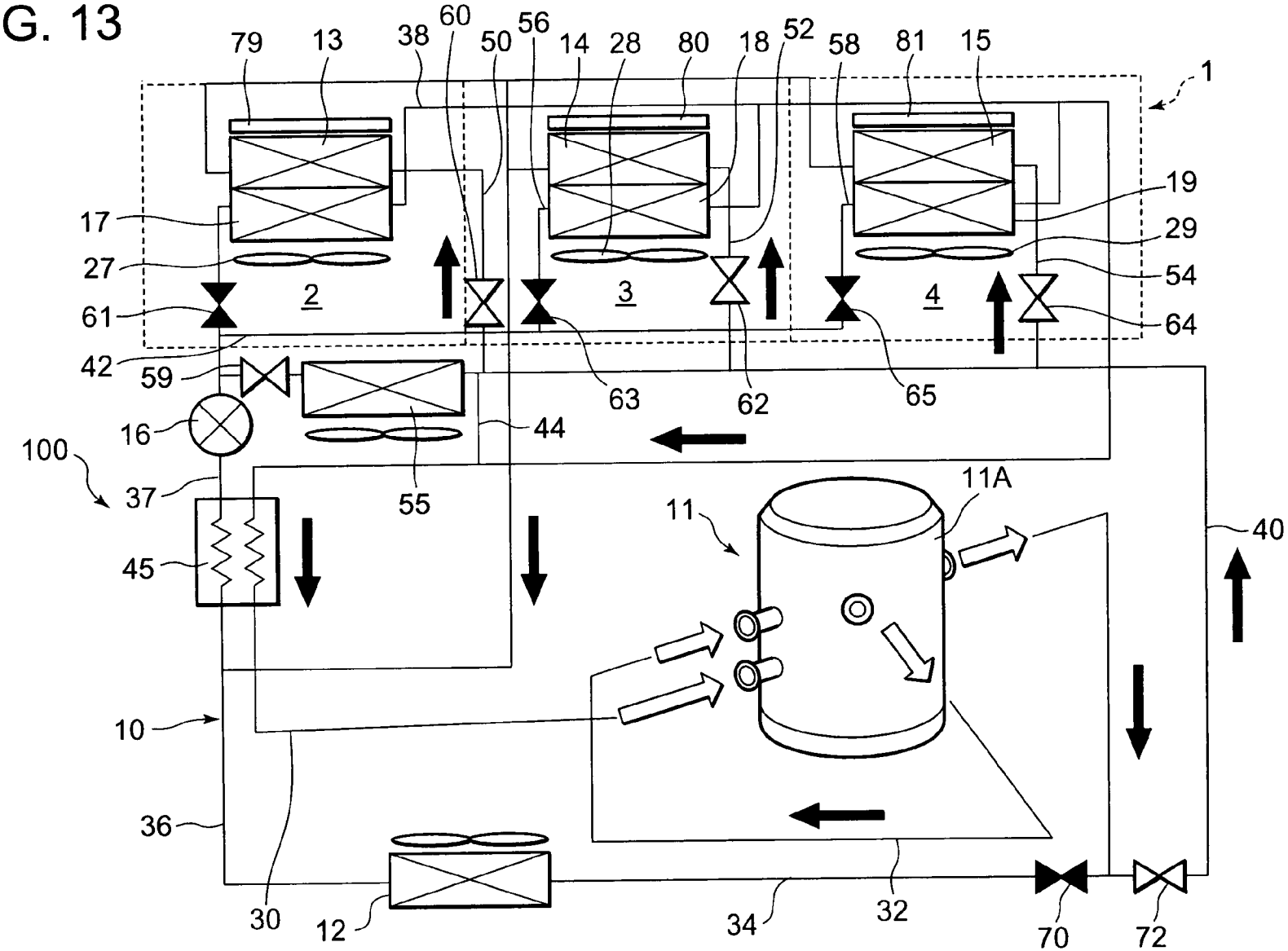
FIG. 13 is a refrigerant circuit diagram of FIG. 8 showing a flow of a refrigerant on a mode of using the receiving rooms 2, 3 and 4 as heating chambers.

Lastly, referring to FIG. 13, a mode of using the receiving rooms 2, 3 and 4 as heating chambers for heating articles will be described. FIG. 13 is a refrigerant circuit diagram showing a flow of a refrigerant on this mode. The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12.

The control device opens the solenoid valves 60, 62 and 64 to open the refrigerant pipes 50, 52 and 54. Accordingly, a refrigerant from the first bypass circuit 40 is branched to flow through the refrigerant pipes 50, 52 and 54. The control device closes the solenoid valve 61 to stop refrigerant circulation to the evaporator 17, and closes the solenoid valves 63 and 65 to close the pipes 56, 58. The control device opens the solenoid valve 59 to open the third bypass circuit 44. Accordingly, refrigerants from the expansion valve 16 all flow into the third bypass circuit 44 without flowing to the second bypass circuit 42 or the evaporator 17.

The control device starts running of the fans 27, 28 and 29 installed in the receiving rooms 2, 3 and 4, and drives the driving element of the compressor 11. Accordingly, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container 11A, the refrigerant gas is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

As the solenoid valves 60, 62 and 64 are opened as described above, the refrigerant is branched from the first bypass circuit 40 to flow through the refrigerant pipes 50, 52 and 54. The refrigerant that has entered the refrigerant pipe 50 flows into the radiator 13 installed in the receiving room 2, and heat is released therefrom. Here, the high-temperature and high-pressure refrigerant compressed by the compressor 11 is not condensed, but the heat is released in the supercritical state. It should be noted that the air heated as a result of heat releasing from the refrigerant by the radiator 13 is circulated in the receiving room 2 by running the fan 27 to heat the inside thereof. According to the invention, carbon dioxide is used for the refrigerant. Thus, since the refrigerant is not condensed at the radiator 13, a heat exchanging efficiency of the radiator 13 is extremely high, and air can be set to a sufficiently high level in the receiving room 2.

The refrigerant that has entered the refrigerant pipe 52 flows into the radiator 14 installed in the receiving room 3, and heat is released therefrom. Here, the high-temperature and high-pressure refrigerant compressed by the compressor 11 is not condensed, but the heat is released in the supercritical state. It should be noted that the air heated as a result of heat releasing from the refrigerant by the radiator 14 is circulated in the receiving room 3 by running the fan 28 to heat the inside thereof. According to the invention, carbon dioxide is used for the refrigerant. Thus, since the refrigerant is not condensed at the radiator 14, a heat exchanging efficiency of the radiator 14 is extremely high, and air can be set to a sufficiently high level in the receiving room 3.

On the other hand, the refrigerant that has entered the refrigerant pipe 54 flows into the radiator 15 installed in the receiving room 4. Here, the high-temperature and high-pressure refrigerant compressed by the compressor 11 is not condensed, but the heat is released in the supercritical state. It should be noted that the air heated as a result of heat releasing from the refrigerant by the radiator 15 is circulated in the receiving room 4 by running the fan 29 to heat the inside thereof. According to the invention, carbon dioxide is used for the refrigerant. Thus, since the refrigerant is not condensed at the radiator 15, a heat exchanging efficiency of the radiator 15 is extremely high, and air can be set to a sufficiently high level in the receiving room 4.

Subsequently, the refrigerants out of the radiators 13, 14 and 15 are combined together, enter the refrigerant pipe 36 from the first bypass circuit 40, and pass through the internal heat exchanger 45. There, the heats of the refrigerants are drawn by a low-pressure side refrigerant out of the auxiliary evaporator 55, and the refrigerants are further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16.

Then, the refrigerant set in the 2-phase mixed state by the expansion valve 16 enters the third bypass circuit 44 to flow into the auxiliary evaporator 55 installed therein since the solenoid valve 59 is opened as described above. The refrigerant is evaporated there, and absorbs heat from ambient air to exhibit a cooling effect. Subsequently, the refrigerant enters the refrigerant pipe 38, and passes through the internal heat exchanger 45.

There, the refrigerant repeats a cycle of drawing heat from the aforementioned high-pressure side refrigerant, receiving a heating effect to become a complete gas, and being sucked through the refrigerant introduction pipe 30 into the first compression element of the compressor 11.

Thus, by disposing the auxiliary evaporator 55 separately from the evaporators 17, 18, and 19 for cooling the receiving rooms 2, 3 and 4 and evaporating the refrigerant at the auxiliary evaporator 55, all the receiving rooms 2, 3 and 4 can be used as heating chambers for heating the articles. Accordingly, even when all the receiving rooms 2, 3 and 4 are used as heating chambers, the refrigerant can be evaporated by the auxiliary evaporator 55, and continuous heating running which uses the refrigerant circuit 10 can be realized. Thus, it is possible to improve reliability of the heating/cooling system 100.

As described above in detail, the carbon dioxide of good heating characteristics is used for the refrigerant. Accordingly, the insides of the receiving rooms 2, 3 and 4 can be heated by the radiators 13, 14 and 15, and cooled by the evaporators 17, 18 and 19. Thus, the receiving rooms 2, 3 and 4 can be heated without installing any heating elements such as electric heaters or any special heating devices. As a result, it is possible to greatly reduce power consumption of the heating/cooling system 100.

Hot air and cold air can be switched to be used in the receiving rooms 2, 3 and 4 by controlling refrigerant circulation through the solenoid valves 59, 60, 61, 62, 63, 64, 65, 70, and 72 of the aforementioned modes. Thus, by switching opening/closing of each solenoid valve according to a use situation, it is possible to freely control hot air/cold air in the receiving rooms 2, 3 and 4.

It should be noted that in the case of the mode of using the receiving room 2, and/or the receiving room 3, and/or the receiving room 4 as the heating chamber for heating articles, by running the electric heater 79, 80 or 81 installed therein, heating may be executed by the electric heater 79, 80 or 81 to supplement the heating by the evaporator 13, 14 or 15. In this case, it is possible to prevent a problem that the receiving room 2, 3 or 4 cannot be sufficiently heated due to a shortage of a heating efficiency at a low outside temperature in winter or the like. The electric heater 79, 80 or 81 supplements the heating by the radiator 13, 14 or 15. Accordingly, a capacity of the electric heater 79, 80 or 81 can be reduced. As a result, it is possible to reduce power consumption compared with the case of heating only by the electric heater.

Embodiment 2-2

Figure 14:
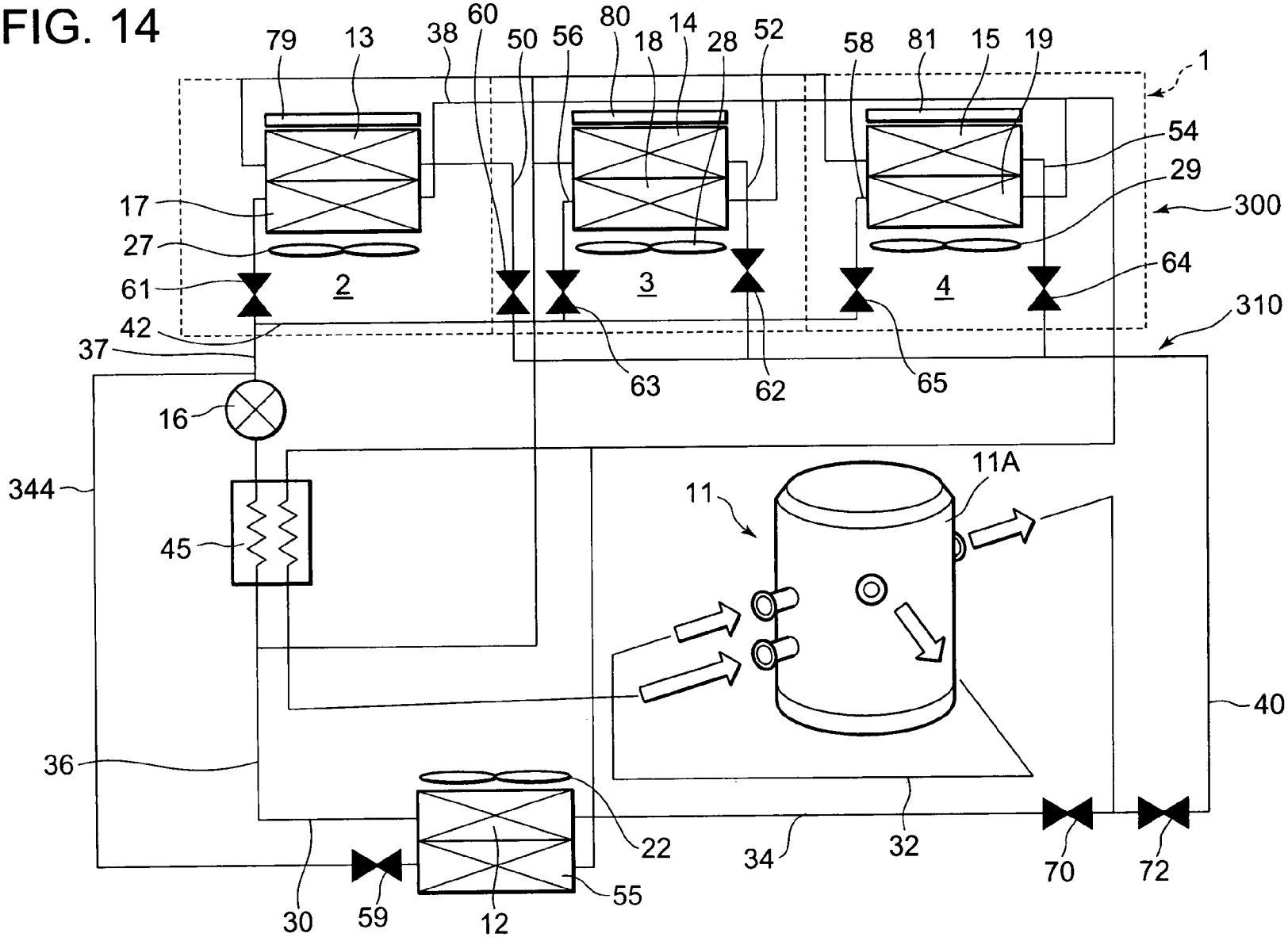
FIG. 14 is a refrigerant circuit diagram of a heating/cooling system according to another embodiment of the invention in this case (Embodiment 2-2)

According to the Embodiment 2-1, the gas cooler 12 and the auxiliary evaporator 55 are disposed separately from each other in the refrigerant circuit 10. However, the invention is not limited to this, and the gas cooler and the auxiliary evaporator may be integrally provided. FIG. 14 is a schematic configuration diagram showing a heating/cooling system 300 in this case. It should be noted that portions denoted by reference numerals similar to those of FIGS. 8 to 13 exhibit identical or similar effects.

In FIG. 14, a reference numeral 310 denotes a refrigerant circuit which comprises a gas cooler 12, radiators 13, 14 and 15, an expansion valve 16 as a pressure reducing device, evaporators 17, 18 and 19, and the like.

In the drawing, a reference numeral 344 denotes a third bypass circuit branched and connected to the midway of a refrigerant pipe 37. This third bypass circuit 344 is disposed to pass through an auxiliary evaporator 55, and a pipe out of the auxiliary evaporator 55 is combined with a refrigerant pipe 38 out of the evaporator 17. The auxiliary evaporator 55 is provided integrally with the gas cooler 12, and arranged on the leeward side of the gas cooler 12. In other words, the gas cooler 12 is disposed on the windward side of air blown by the fan 22, and the auxiliary evaporator 55 is disposed on the leeward side. On the inlet side of the auxiliary evaporator 55, a solenoid valve 59 is installed as flow path control means for controlling refrigerant circulation for the auxiliary evaporator 55.

Operations on modes of heating/cooling the receiving rooms 2, 3 and 4 are similar to those of the Embodiment 1. Thus, referring to FIGS. 15 to 19, opening/closing of the solenoid valves 59, 60, 61, 62, 63, 64, 65, 70 and 72 will be briefly described. In FIGS. 15 to 19, white solenoid valves indicate states of valves opened by the control device, and black solenoid valves indicate state of valves closed by the control device. It should be noted that as a refrigerant sealed in the refrigerant circuit 310, carbon dioxide is used as in the case of the foregoing embodiments.

Figure 15:
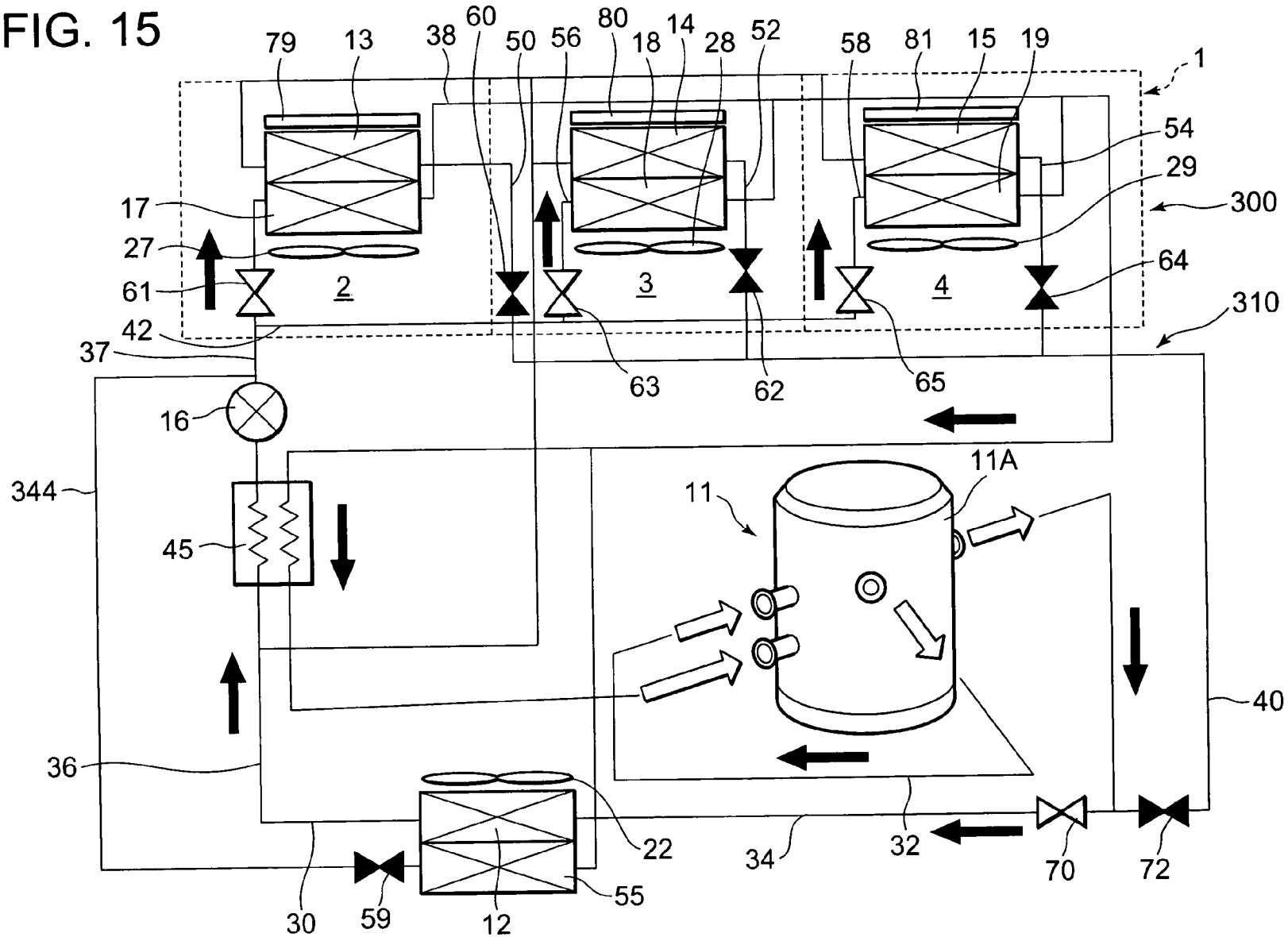
FIG. 15 is a refrigerant circuit diagram showing a flow of a refrigerant on a mode of using receiving rooms 2, 3 and 4 as cooling chambers in the heating/cooling system of the Embodiment 2-2.

To begin with, on a mode of using the receiving rooms 2, 3 and 4 as cooling chambers for cooling articles, as shown in FIG. 15, the solenoid valve 70 is opened, while the solenoid valve 72 is closed to close the first bypass circuit 40. Accordingly, refrigerants discharged from the compressor 11 all flow to the gas cooler 12. The solenoid valves 60, 62 and 64 are closed to close the refrigerant pipes 50, 52 and 54, while the solenoid valves 61, 63 and 65 are opened to open the pipes 56, 58. Accordingly, refrigerants compressed by the expansion valve 16 are evaporated by the evaporators 17, 18 and 19, and the receiving rooms 2, 3 and 4 can be cooled.

Figure 16:
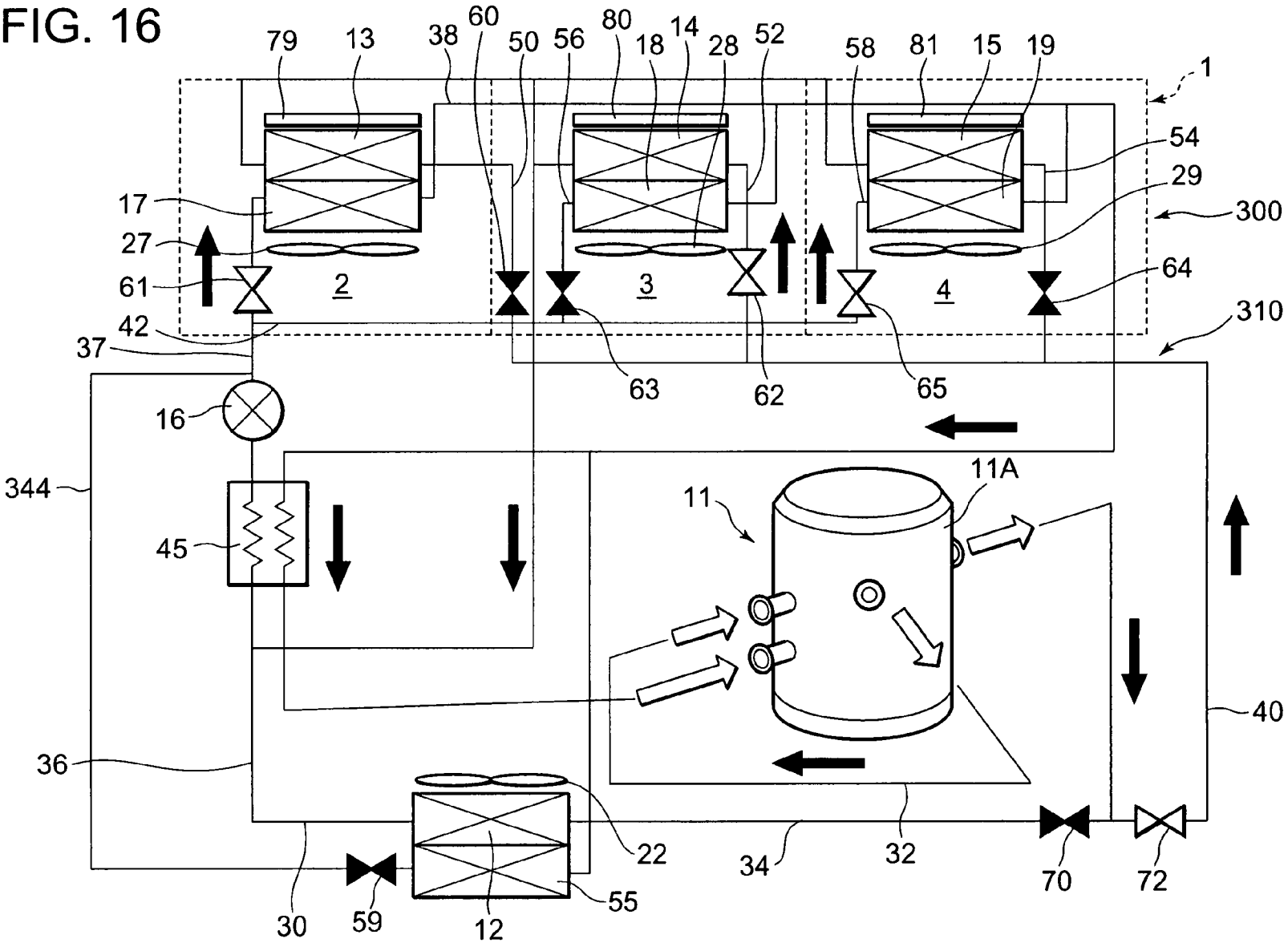
FIG. 16 is a refrigerant circuit diagram showing a flow of a refrigerant on a mode of using the receiving rooms 2, and 4 as cooling chambers and the receiving room 3 as a heating chamber in the heating/cooling system of the Embodiment 2-2.

Next, on a mode of using the receiving rooms 2 and 4 as cooling chambers for cooling articles, and the receiving room 3 as a heating chamber for heating articles, as shown in FIG. 16, the solenoid valve 70 is closed, while the solenoid valve 72 is opened to open the first bypass circuit 40. Accordingly, refrigerants discharged from the compressor 11 all flow to the first bypass circuit 40. Further, the solenoid valves 60 and 64 are closed to close the refrigerant pipes 50 and 54, while the solenoid valve 62 is opened to open the refrigerant pipe 52. Accordingly, refrigerants from the first bypass circuit 40 all enter the refrigerant pipe 52, and heat is released by the radiator 14 installed in the receiving room 3, whereby the inside of the receiving room 3 is heated. The solenoid valve 63 is closed to close the pipe 56, while the solenoid valves 61 and 65 are opened to open the pipe 58. Accordingly, a refrigerant reduced in pressure by the expansion valve 16 is evaporated at the evaporators 17, 19, thereby cooling the receiving rooms 2, 4.

Figure 17:
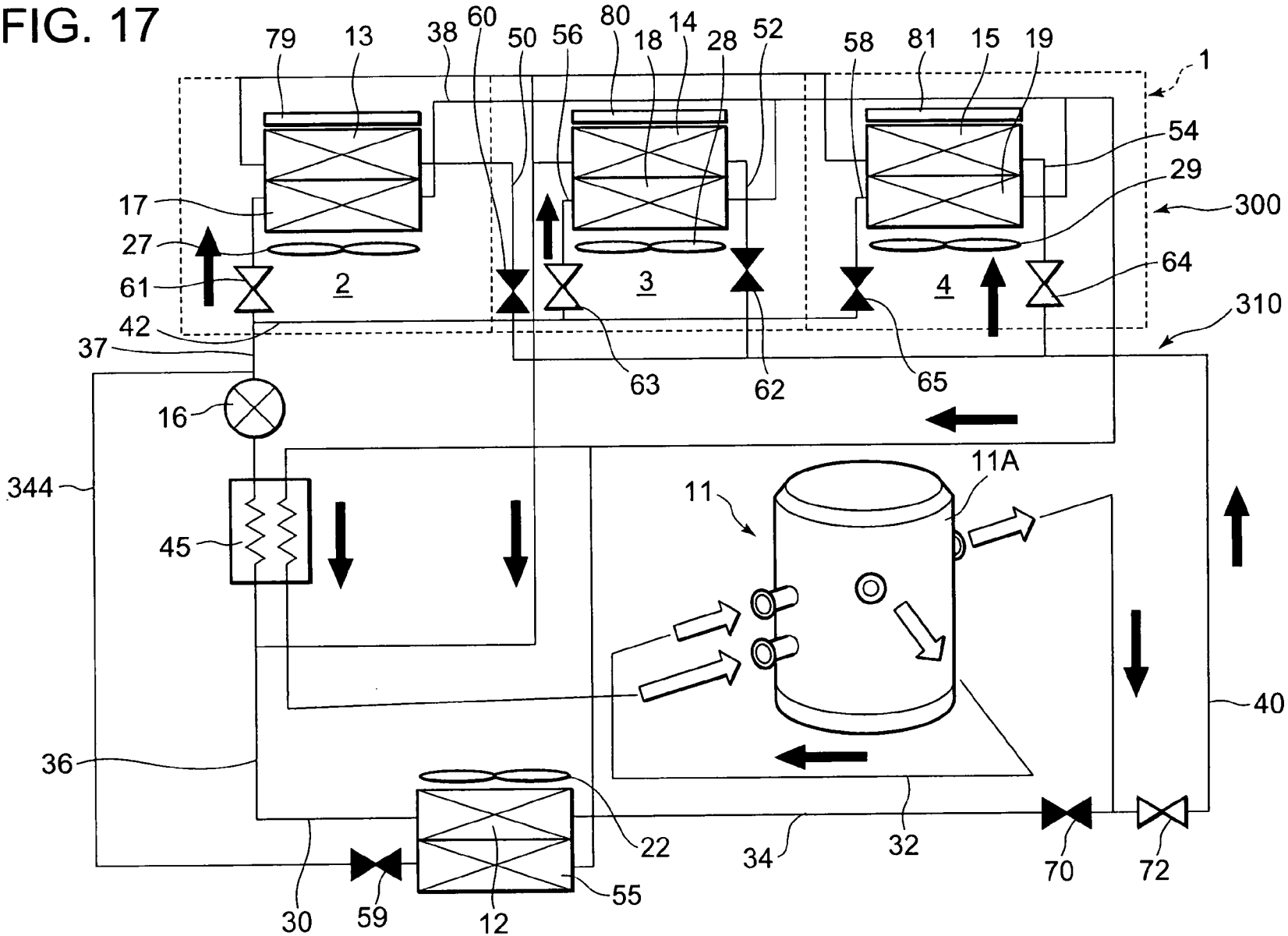
FIG. 17 is a refrigerant circuit diagram showing a flow of a refrigerant on a mode of using the receiving rooms 2 and 3 as cooling chambers and the receiving room 4 as a heating chamber in the heating/cooling system of the Embodiment 2-2.

Next, on a mode of using the receiving rooms 2 and 3 as cooling chambers for cooling articles and the receiving room 4 as a heating chamber for heating articles, as shown in FIG. 17, the solenoid valve 70 is closed, while the solenoid valve 72 is opened to open the first bypass circuit 40. Accordingly, refrigerants discharged from the compressor 11 all flow to the first bypass circuit 40. Further, the solenoid valves 60 and 62 are closed to close the refrigerant pipes 50 and 52, while the solenoid valve 64 is opened to open the refrigerant pipe 54. Accordingly, refrigerants from the first bypass circuit 40 all enter the refrigerant pipe 54, and heat is released by the radiator 15 installed in the receiving room 4, whereby the inside of the receiving room 4 can be heated. The solenoid valve 65 is closed to close the pipe 58, while the solenoid valves 61 and 63 are opened to open the pipe 56. Accordingly, a refrigerant reduced in pressure by the expansion valve 16 is evaporated by the evaporators 17, 18, thereby cooling the receiving rooms 2, 3 and 4.

Figure 18:
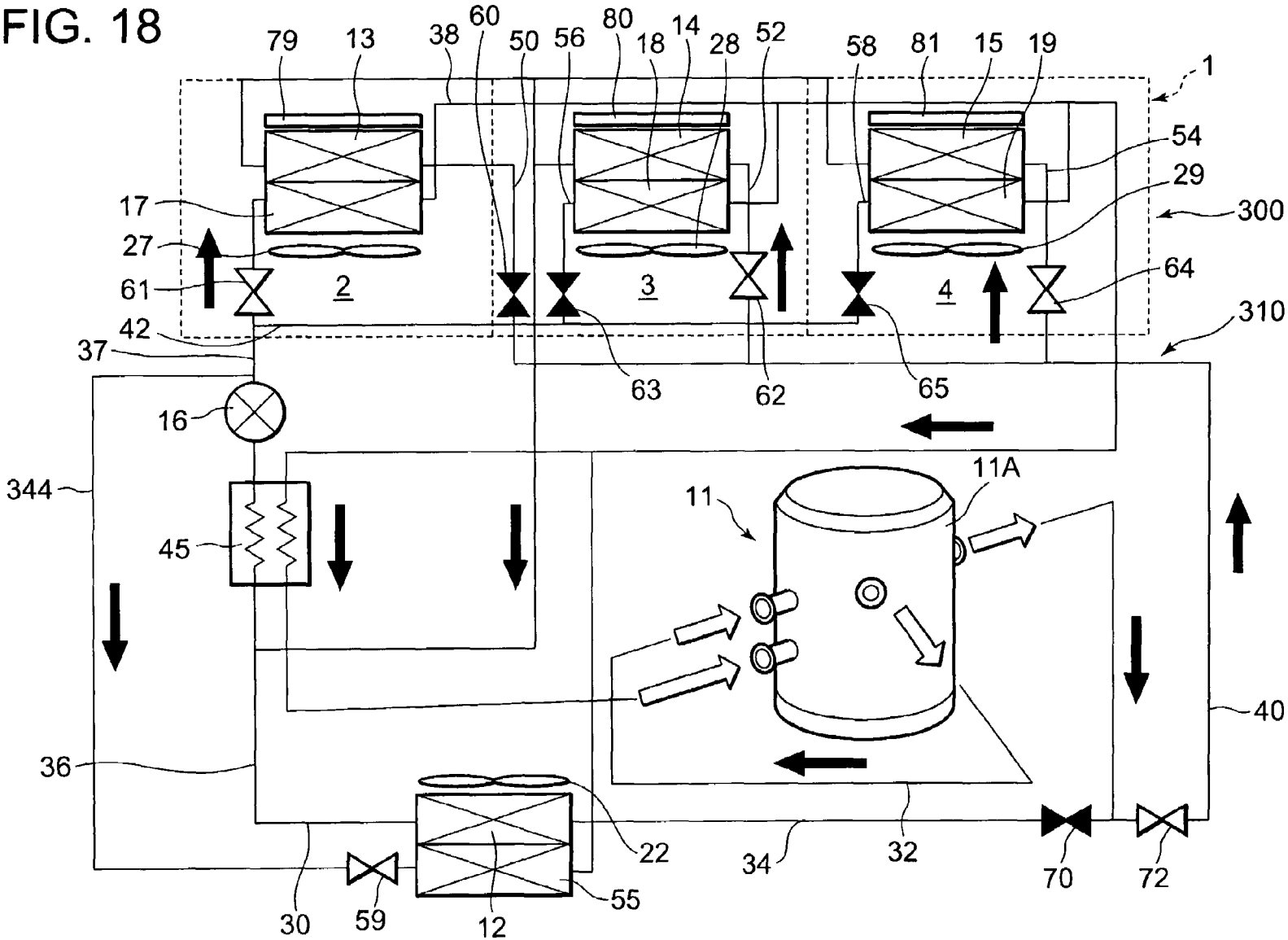
FIG. 18 is a refrigerant circuit diagram showing a flow of a refrigerant on a mode of using the receiving room 2 as a cooling chamber and the receiving rooms 3 and 4 as heating chambers in the heating/cooling system of the Embodiment 2-2.

Next, on a mode of using the receiving room 2 as a cooling chamber for cooling articles and the receiving rooms 3 and 4 as heating chambers for heating articles, as shown in FIG. 18, the solenoid valve 70 is closed, while the solenoid valve 72 is opened to open the first bypass circuit 40. Accordingly, refrigerants discharged from the compressor 11 all flow to the first bypass circuit 40. Further, the solenoid valve 60 is closed to close the refrigerant pipe 50, while the solenoid valves 62 and 64 are opened to open the refrigerant pipe 52 and 54. Accordingly, a refrigerant from the first bypass circuit 40 is branched to enter the refrigerant pipes 52 and 54, and heat is released by the radiators 14, 15, whereby the insides of the receiving rooms 3 and 4 can be heated. The solenoid valve 61 is opened, while the solenoid valves 63 and 65 are closed to close the pipes 56 and 58. Accordingly, a refrigerant reduced in pressure by the expansion valve 16 is evaporated by the evaporator 17, thereby cooling the receiving room 2.

Moreover, in this case, the solenoid valve 59 is opened to cause flowing of the refrigerant reduced in pressure by the expansion valve 16 to the third bypass circuit 344, and the refrigerant is evaporated by the auxiliary evaporator 55. Accordingly, in addition to the evaporation of the refrigerant by the evaporator 17, the refrigerant can be sufficiently evaporated by the auxiliary evaporator 55. As a result, it is possible to sufficiently heat the receiving rooms 3 and 4 while maintaining high heat releasing efficiencies of the radiators 14, 15.

Figure 19:
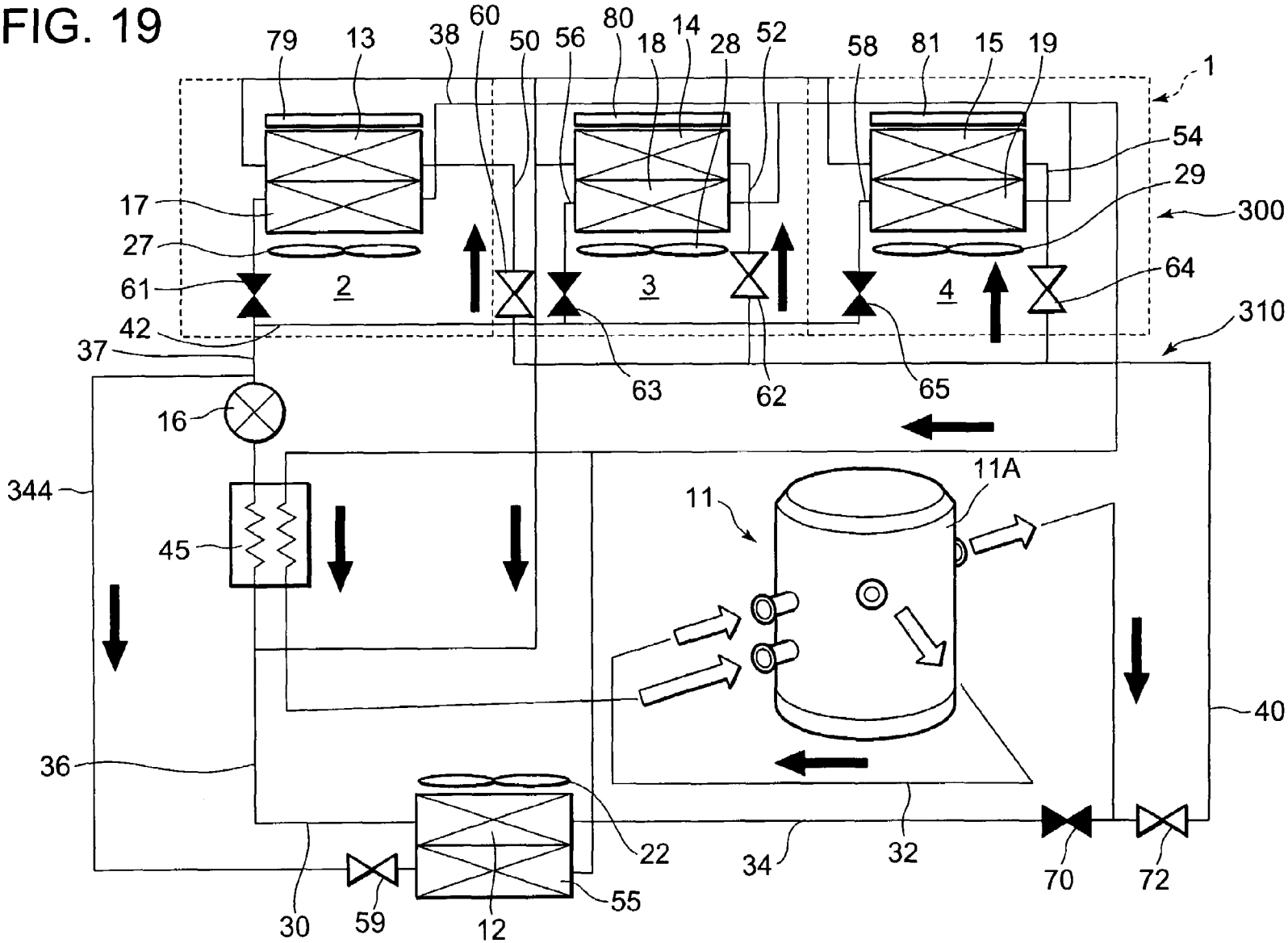
FIG. 19 is a refrigerant circuit diagram showing a flow of a refrigerant on a mode of using the receiving rooms 2, 3 and 4 as heating chambers in the heating/cooling system of the Embodiment 2-2.

Lastly, on a mode of using the receiving rooms 2, 3 and 4 as heating chambers for heating articles, as shown in FIG. 19, the solenoid valve 70 is closed, while the solenoid valve 72 is opened to open the first bypass circuit 40. Accordingly, refrigerants discharged from the compressor 11 all flow to the first bypass circuit 40. Further, the solenoid valves 60, 62 and 64 are opened to open the refrigerant pipes 50, 52 and 54. Accordingly, a refrigerant from the first bypass circuit 40 is branched to enter the refrigerant pipes 50, 52 and 54, and heat is released by the radiators 13, 14 and 15, whereby the insides of the receiving rooms 2, 3 and 4 can be heated. The solenoid valve 61 is closed to stop refrigerant circulation to the evaporator 17, and the solenoid valves 63 and 65 are closed to close the pipes 56, 58.

Moreover, in this case, the solenoid valve 59 is opened to open the third bypass circuit 344, thereby allowing flowing of all refrigerants reduced in pressure by the expansion valve 16 to the third bypass circuit 344. Accordingly, the refrigerant is evaporated by the evaporator 15 installed in the third bypass circuit 344. Even when the all the receiving rooms 2, 3 and 4 are used as heating chambers, it is possible to realize continuous heating running by the radiators 13, 14 and 15.

According to the embodiment, the integral constitution of the gas cooler 12 and the auxiliary evaporator 55 enables reductions in installation spaces thereof. Thus, it is possible to achieve space conservation of the heating/cooling system 300.

The gas cooler 12 is arranged on the windward side of the air blown by the fan 22, and the auxiliary evaporator 55 is arranged on the leeward side, whereby the air heated as a result of heat releasing from the refrigerant by the gas cooler 12 can be blown to the auxiliary evaporator 55. Thus, the refrigerant can be actively evaporated by the auxiliary evaporator 55.

That is, since the refrigerant can be effectively evaporated by the auxiliary evaporator 55, an efficiency of evaporating the refrigerant is increased. As a result, a refrigerant heating efficiency is increased to realize continuous heating running. Accordingly, it is possible to improve performance of the heating/cooling system 300.

According to the embodiment, the three rooms (receiving rooms 2, 3 and 4) capable of using hot air and cold air in a switching manner are provided. However, the invention is not limited to this. A plurality (four or more) of receiving rooms, and a plurality of radiators or evaporators for heating/cooling the receiving rooms may be installed, and refrigerant circulation to the radiators or the evaporators may be controlled by flow path control means. Accordingly, hot air and cold air can be used in a switching manner.

Furthermore, according to the embodiments, the radiators 13, 14 and 15 and the evaporators 17, 18 and 19 are installed in the receiving rooms 2, 3 and 4, refrigerant circulation is controlled by opening/closing the solenoid valves 59, 60, 61, 62, 63, 64, 65, 70 and 72, and heating/cooling of the receiving rooms 2, 3 and 4 are controlled. However, the invention is not limited to such. By switching fan blowing or the like, hot air or cold air may be blown to the receiving room to heat/cool the same.

Embodiment 2-3

Figure 20:
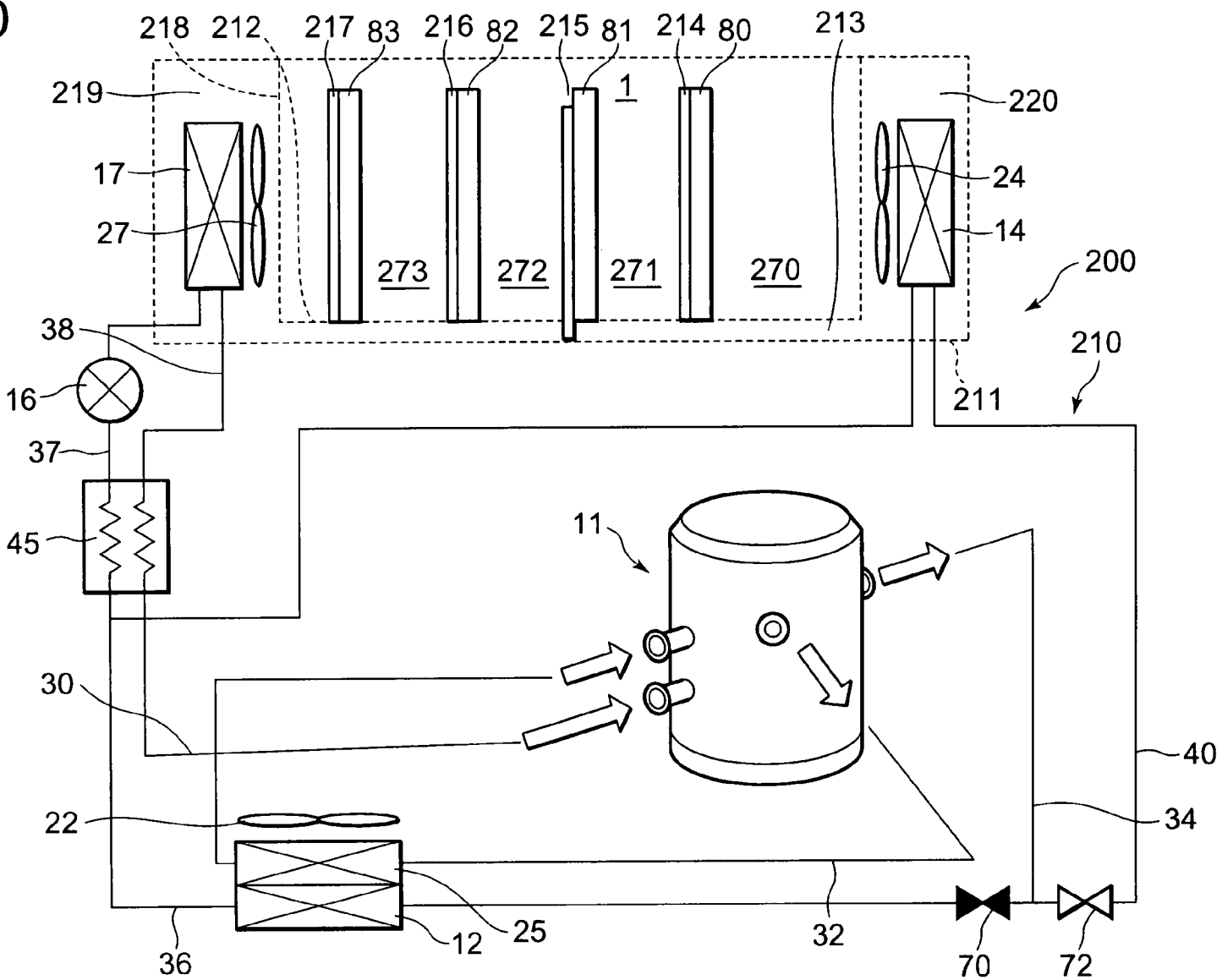
FIG. 20 is a refrigerant circuit diagram of an open showcase according to yet another embodiment of the invention in this case (Embodiment 2-3)
Figure 21:
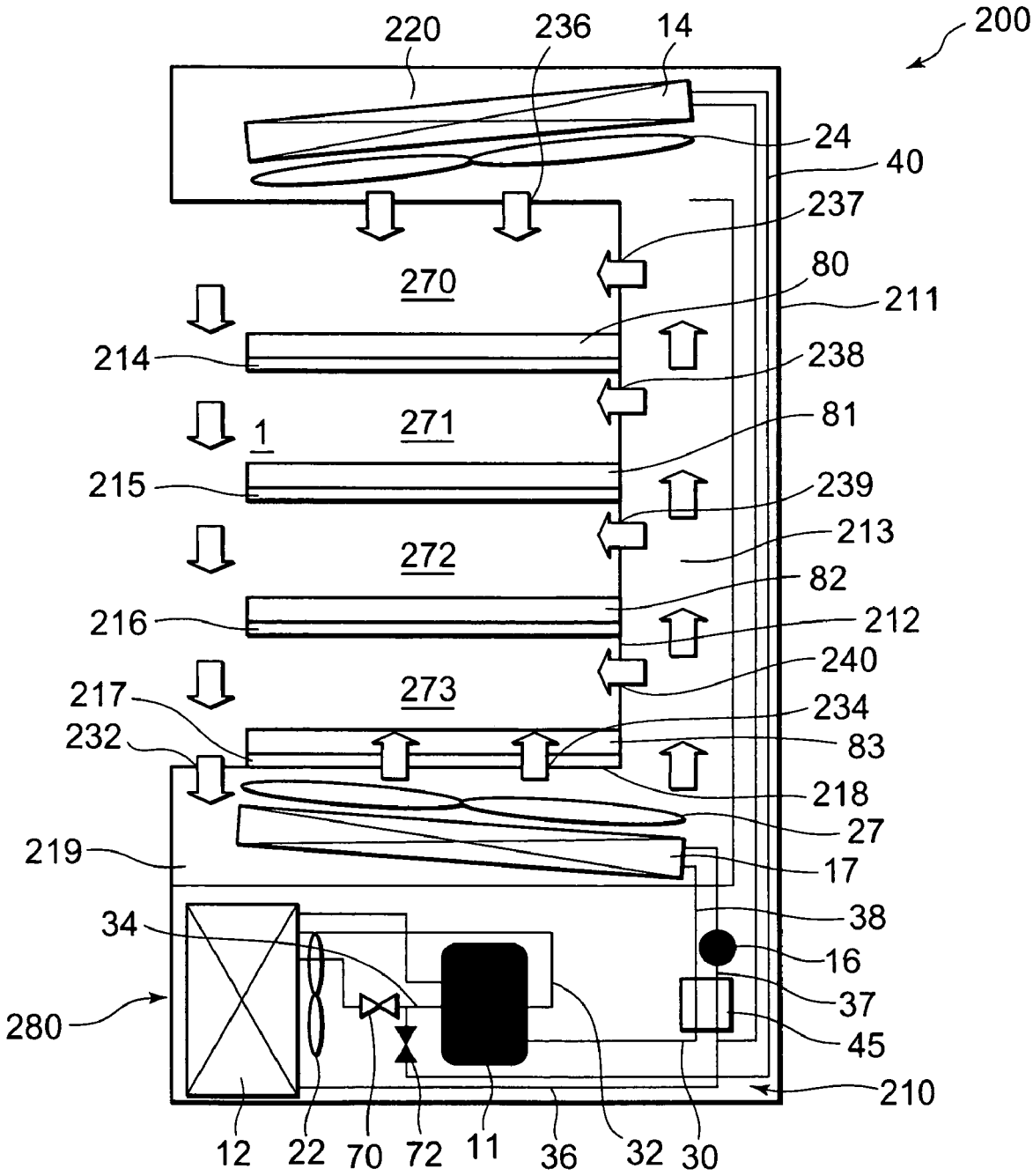
FIG. 21 is a vertical section side diagram showing an operation on a mode of using receiving rooms 270, 271, 272 and 273 as cooling chambers in the open showcase of the Embodiment 2-3.

Next, referring to FIGS. 20 to 24, description will be made of an embodiment in which the heating/cooling system of the invention is applied to an open showcase 200. FIG. 20 is a refrigerant circuit diagram of the open showcase 200. FIGS. 21 to 24 are vertical section side diagrams of the open showcase 200. It should be noted that portions of FIGS. 20 and 24 denoted by reference numerals similar to those of FIGS. 8 to 19 exhibit identical or similar effects.

The open showcase 200 of the embodiment is a vertical type showcase installed in a store such as a supermarket, which comprises an insulated wall 211 formed into a roughly U shape in section, and side plates (not shown) mounted to both sides of the insulated wall. A partition plate 212 is mounted to the inside of the insulated wall 211, a duct 213 is formed between the insulated wall 211 and the partition plate 212, and the inside of the partition plate 212 is a storage room 1.

Plural stages (4 stages in the embodiment) of shelves are installed in the storage room 1. Spaces above the shelves 214, 215, 216 and 217 are set as receiving rooms 270, 271, 272 and 273 for receiving articles. Electric heaters 80, 81, 82 and 83 are mounted on the shelves 214, 215, 216, and 217 as auxiliary heaters to heat the receiving rooms 270, 271, 272 and 273. These electric heaters 80, 81, 82, and 83 are provided to compensate for an efficiency shortage due to heating by a radiator 14 (described later).

Suction ports 230, 232 are formed in upper and lower edges of a front opening of the storage room 1. The suction port 230 is communicated with an upper duct 220 (described later), and the suction port 232 is communicated with a bottom duct 219 (described later).

A deck pan 218 is mounted to a bottom part of the storage room 1. A lower part of the deck pan 218 is the bottom duct 219 communicated with the duct 213. In the bottom duct 219, an evaporator 17 and a fan 27 are installed to cool the receiving rooms 270, 271, 272 and 273. In the deck pan 218, holes 234, 234 are formed through the receiving room 273 and the bottom duct 219 up and down. Air heat-exchanged with the evaporator 17 is blown through the holes 234, 234 into the receiving room 273 by the fan 27.

On the other hand, the upper duct 220 communicated, with the dust 213 is similarly formed in the upper part of the storage room 1. In this upper duct 220, a radiator 14 and a fan 24 are installed to heat the receiving rooms 270, 271, 272 and 273. Holes 236, 236 are formed through the receiving room 270 and the upper duct 220 up and down. Air heat-exchanged with the radiator 14 is blown through the holes 236, 236 into the receiving room 270 by the fan 24.

In the partition plate 212, communication holes 237, 238, 239, and 240 are formed to communicate the inside of the duct 213 with the receiving rooms 270, 271, 272 and 273. The air heat-exchanged with the evaporator 17 or the radiator 14 is blown through the communication holes 237, 238, 239, and 240 into the receiving rooms 270, 271, 272 and 273 by the fan 27 or 24.

Here, the shelves 214, 215 and 216 can penetrate the duct 213 to partition it into upper and lower parts. That is, holes (not shown) are formed on backsides of the shelves 214, 215 and 216 (duct 213 side in FIGS. 21 to 24) to insert the shelves 214, 215 and 216 into the duct 213. By inserting the shelf 214, 215 or 216 through the hole into the duct 213, a flow of air in the duct 213 can be cut off, and the duct 213 can be partitioned into upper and lower parts.

On the other hand, a machine room 280 is formed below the bottom duct 219. This machine room 280 accommodates a compressor 11, a gas cooler 12, an internal heat exchanger 45, an expansion valve 16 as a pressure reducing device, and the like which constitute a refrigerant circuit 210 (described later). It should be noted that the compressor 11 used in the embodiment is a 2-stage compression type compressor, which comprises a driving element and first and second compression elements driven by the driving element. The gas cooler 12 is designed to release heat from a high-temperature and high-pressure refrigerant discharged from the compressor 11, and a fan 22 is installed near the gas cooler 12.

Now, referring to FIG. 20, the refrigerant circuit 210 will be described. The refrigerant circuit 210 comprises the compressor 11, the gas cooler 12, the radiator 14, the expansion valve 16, the evaporator 17, and the like. That is, a refrigerant discharge pipe 34 of the compressor 11 is connected to an inlet of the gas cooler 12. A refrigerant pipe 36 connected to an outlet side of the gas cooler 12 passes through the internal heat exchanger 45. It should be noted that the internal heat exchanger 45 is designed to exchange heat between high-pressure side and low-pressure side refrigerants. A refrigerant pipe 37 connected to the outlet of the internal heat exchanger 45 is connected through the expansion valve 16 to an inlet of the evaporator 17 installed in the bottom duct 219. A refrigerant pipe 38 out of the evaporator 17 passes through the internal heat exchanger 45 to be connected to a refrigerant introduction pipe 30. It should be noted that the refrigerant introduction pipe 30 is connected to a first compression element of the compressor 11. A low-pressure refrigerant is sucked through the pipe 30 into the compressor 11.

In FIG. 20, a reference numeral 32 denotes a refrigerant introduction pipe for introducing a refrigerant compressed by the first compression element of the compressor 11 into a second compression element. The refrigerant introduction pipe 32 is constituted such that the refrigerant is passed through an intermediate cooler 25 installed outside the sealed container and then sucked into the second compression element. The intermediate cooler 25 is constituted integrally with the gas cooler 12 to cool the refrigerant compressed by the first compression element.

Here, a first bypass circuit 40 is branched and connected to the midway of the refrigerant discharge pipe 34. An outlet of this first bypass circuit 40 is connected to the midway of the refrigerant pipe 36. The first bypass circuit 40 is provided to pass through the radiator 14 installed in the upper duct 220. In the inlet side of the radiator 14 of the first bypass circuit 40 and the refrigerant discharge pipe 34, solenoid valves 70, 72 are installed as flow path control means for controlling flowing of a high-pressure refrigerant compressed by the second compression element of the compressor 11 through the refrigerant discharge pipe 34 to the gas cooler 12 or the first bypass circuit 40. Opening/closing of these valves is controlled by a control device (not shown).

It should be noted that carbon dioxide is sealed as a refrigerant in the refrigerant circuit 210, and a high-pressure side of the refrigerant circuit 210 becomes supercritical pressure.

(1) Mode of using receiving room 270, 271, 272 and 273 as cooling chambers Next, and operation of the open showcase 200 configured in the aforementioned manner will be described. To begin with, referring to FIG. 21, the mode of using the receiving rooms 270, 271, 272 and 273 as cooling chambers for cooling articles will be described.

It is assumed that the shelf, 214, 215 or 216 is not inserted into the duct 213. The control device (not shown) opens the solenoid valve 70, and closes the solenoid valve 72 to close the first bypass circuit 40. Accordingly, refrigerants discharged from the compressor 11 all flow through the refrigerant discharge pipe 34 into the gas cooler 12 without flowing to the first bypass circuit 40.

The control device starts running of the fans 22, 27 and 24 received in the bottom and upper ducts 219 and 220, and drives the driving element of the compressor 11. Thus, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container, the refrigerant gas is passed through the intermediate cooler 25. Then, the refrigerant receives air from the fan 22 during the passage through the intermediate cooler 25 to release heat. Subsequently, the refrigerant is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure.

The refrigerant gas discharged from the compressor 11 flows through the refrigerant discharge pipe 34 into the gas cooler 12 since the solenoid valve 70 is opened while the solenoid valve 72 is closed as described above. Here, the high-temperature and high-pressure refrigerant compressed by the compressor 11 is not condensed, but the fans are run in the supercritical state of the refrigerant gas. The high-temperature and high-pressure refrigerant gas receives air from the fan 22 to release heat at the gas cooler 12. According to the invention, the carbon dioxide is used for the refrigerant. Thus, the refrigerant goes out of the gas cooler 12 in the supercritical state, enters the refrigerant pipe 36, and passes through the internal heat exchanger 45.

There, the heat of the refrigerant is drawn by a low-pressure side refrigerant out of the evaporator 17, and the refrigerant is further cooled. The presence of the internal heat exchanger 45 causes the low-pressure side refrigerant to draw the heat from the refrigerant which goes out of the gas cooler 12 and passes through the internal heat exchanger 45. A supercooling degree of the refrigerant is increased by a corresponding amount. Thus, a cooling efficiency of the evaporator 17 is increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state flows into the evaporator 17 installed in the bottom duct 219. The refrigerant is evaporated there, and absorbs heat from ambient air to exhibit a cooling effect. It should be noted that the air cooled by the evaporation of the refrigerant at the evaporator 17 enters the cooling chamber 273 through the holes 234, 234 by running the fan 27 to cool the inside thereof. Further, the air cooled by the evaporator 17 enters the duct 213 and the upper duct 220 by running the fan 27. The air is then blown through the communication holes 237, 238, 239 and 240 into the receiving rooms 270, 272, 272 and 273 to cool the insides thereof.

It should be noted that the air (cold air) blown into the receiving rooms 270, 272, 272 and 273 repeats a cycle of being sucked through the suction port 232 into the bottom duct 219 after cooling the receiving rooms 270, 271, 272 and 273, and being cooled again by the evaporator 17.

On the other hand, the refrigerant evaporated at the evaporator 17 flows out thereof, enters the refrigerant pipe 38, and passes through the internal heat exchanger 45. There, the refrigerant repeats a cycle of drawing heat from the high-pressure side refrigerant, receiving a heating effect to become a complete gas, and being sucked through the refrigerant introduction pipe 30 into the first compression element of the compressor 11.

Figure 22:
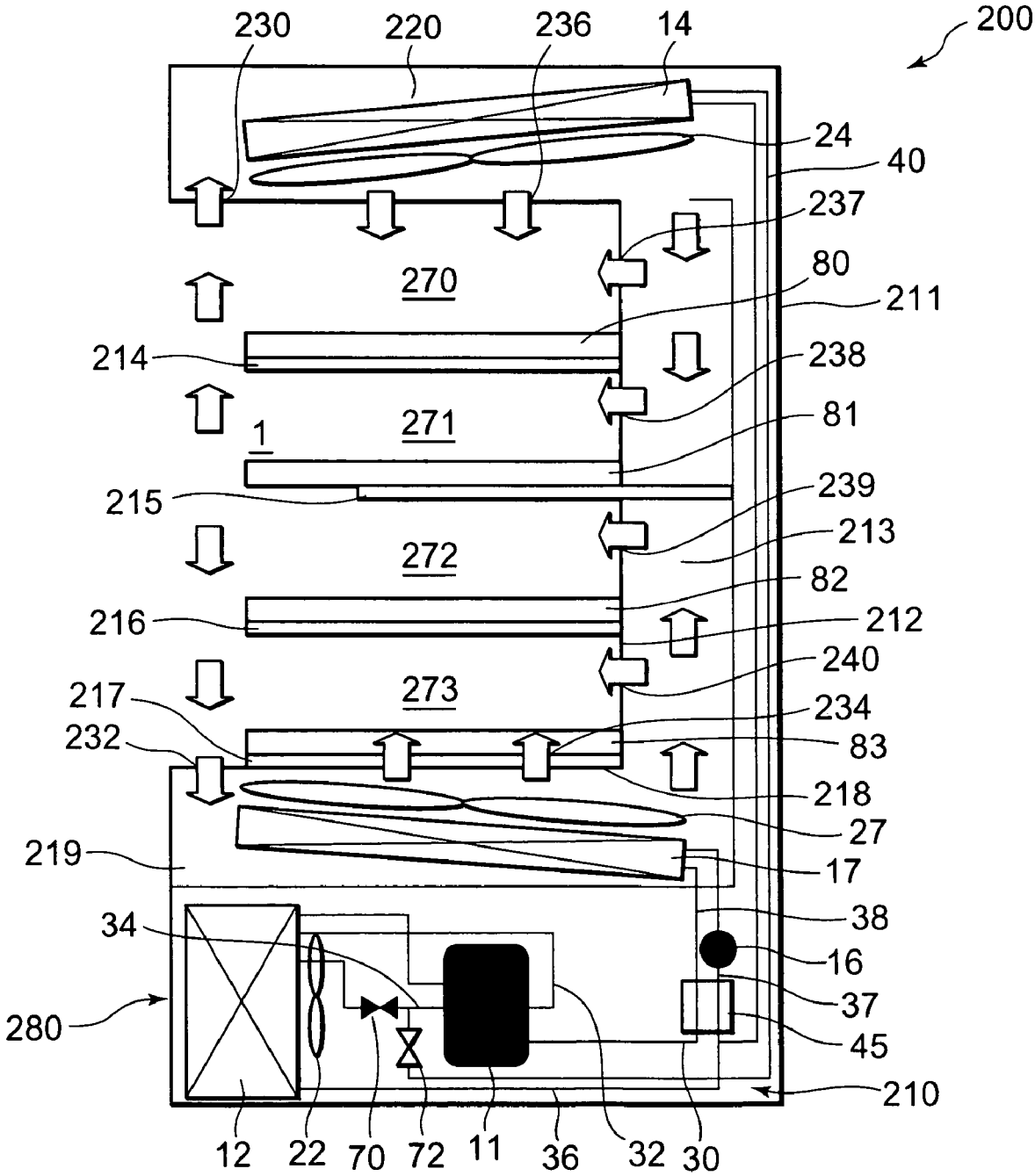
FIG. 22 is a vertical section side diagram showing an operation on a mode of using the receiving rooms 270, 271 as heating chambers and the receiving rooms 272, 273 as cooling chambers in the open showcase of the Embodiment 2-3.

(2) Mode of using receiving rooms 270, 271 as heating chambers and receiving rooms 272, 273 as cooling chambers Next, referring to FIG. 22, description will be made of an operation on a mode of using the receiving rooms 270 and 271 as heating chambers for heating articles, and the receiving rooms 272 and 273 as cooling chambers for cooling articles.

When a worker inserts the shelf 215 into the duct 213 (at this time, the shelves 214 and 216 are not inserted into the duct 213), the shelf 215 partitions the duct 213 into upper and lower parts. The control device (not shown) closes the solenoid valve 70, and opens the solenoid valve 72 to open the first bypass circuit 40. Accordingly, refrigerants discharged from the compressor 11 all flow through the refrigerant discharge pipe 34 to the first bypass circuit 40 without flowing to the gas cooler 12.

The control device starts running of the electric heaters 80, 81 installed on the shelves 214, 215 of the receiving rooms 270, 271. Accordingly, the receiving rooms 270, 271 are heated. Additionally, the control device starts running of the fans 27 and 24 received in the bottom and upper ducts 219 and 220. At this time, the fan 22 is not run. The control device drives the driving element of the compressor 11. Thus, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container, the refrigerant gas is passed through the intermediate cooler 25. The refrigerant releases heat during the passages through the intermediate cooler 25. However, the fan 22 is not run according to this mode, and thus heat releasing from the refrigerant at the intermediate cooler 25 is only a little, or almost no heat releasing occurs. Accordingly, the refrigerant sucked into the second compression element can be maintained at a high temperature. Thus, a temperature of a refrigerant discharged from the compressor 11 becomes high to heat ambient air at the radiator 14. As a result, a heating efficiency of the radiator 14 can be maintained.

Subsequently, the refrigerant is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure.

The refrigerant gas discharged from the compressor 11 flows from the midway of the refrigerant discharge pipe 34 through the first bypass circuit 40 into the radiator 14 installed in the upper duct 220 since the solenoid valve 70 is closed while the solenoid valve 72 is opened as described above. Here, the high-temperature and high-pressure refrigerant compressed by the compressor 11 is not condensed, but the fans are run in the supercritical state of the refrigerant gas. Heat is released from the high-temperature and high-pressure refrigerant gas by the evaporator 14. It should be noted that ambient air heated as a result of heat releasing from the refrigerant by the evaporator 14 enters the heating chamber 270 through the holes 236, 236 by running the fan 24 to heat the inside thereof. The air heated by the evaporator 14 passes through the duct 213 by the fan 24, and enters the receiving rooms 270, 271 through the communication holes 237 and 238 to heat the insides thereof. According to the invention, the carbon dioxide is used for the refrigerant. Thus, since the refrigerant is not condensed at the radiator 14, a heat exchanging efficiency of the evaporator 14 is extremely high, and air in the heating chambers 270, 271 can be set to sufficiently high temperatures.

Air (hot air) blown by the fan 24 is not blown to a part below the shelf 215 since the duct 213 is partitioned by the shelf 215 as described above. Accordingly, the receiving rooms 270, 271 above the shelf 215 can be heated.

The air (hot air) blown into the receiving rooms 270, 271 repeats a cycle of being sucked through the suction port 230 into the upper duct 220 after heating the receiving rooms 270, 271, and being heated again by the evaporator 14.

On the other hand, the refrigerant from which the heat has been released by the evaporator 14 enters the refrigerant pipe 36 from the first bypass circuit 40, and passes through the internal heat exchanger 45. There, the heat of the refrigerant is drawn by a low-pressure side refrigerant out of the evaporator 17, and the refrigerant is further cooled. The presence of the internal heat exchanger 45 causes the low-pressure side refrigerant to draw the heat from the refrigerant which goes out of the evaporator 14 and passes through the internal heat exchanger 45. A supercooling degree of the refrigerant is increased by a corresponding amount. Thus, a cooling efficiency of the evaporator 17 is increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state flows into the evaporator 17 installed in the bottom duct 219. The refrigerant is evaporated there, and absorbs heat from ambient air to exhibit a cooling effect. It should be noted that the air cooled by the evaporation of the refrigerant at the evaporator 17 enters the receiving room 273 through the holes 234, 234 by running the fan 27 to cool the inside thereof. Further, the air cooled by the evaporator 17 enters the duct 213 by running the fan 27. The air is then blown through the communication holes 239 and 240 into the receiving rooms 272 and 273 to cool the insides thereof.

Here, air (cold air) blown by the fan 27 is not blown to a part above the shelf 215 since the duct 213 is partitioned by the shelf 215 as described above. Accordingly, the receiving rooms 272 and 273 only below the shelf 215 can be cooled.

It should be noted that the air (cold air) blown into the receiving rooms 272, 273 repeats a cycle of being sucked through the suction port 232 into the bottom duct 219 after cooling the receiving rooms 272, 273, and being cooled again by the evaporator 17.

On the other hand, the refrigerant evaporated at the evaporator 17 flows out thereof, enters the refrigerant pipe 38, and passes through the internal heat exchanger 45. There, the refrigerant repeats a cycle of drawing heat from the high-pressure side refrigerant, receiving a heating effect to become a complete gas, and being sucked through the refrigerant introduction pipe 30 into the first compression element of the compressor 11.

Figure 23:
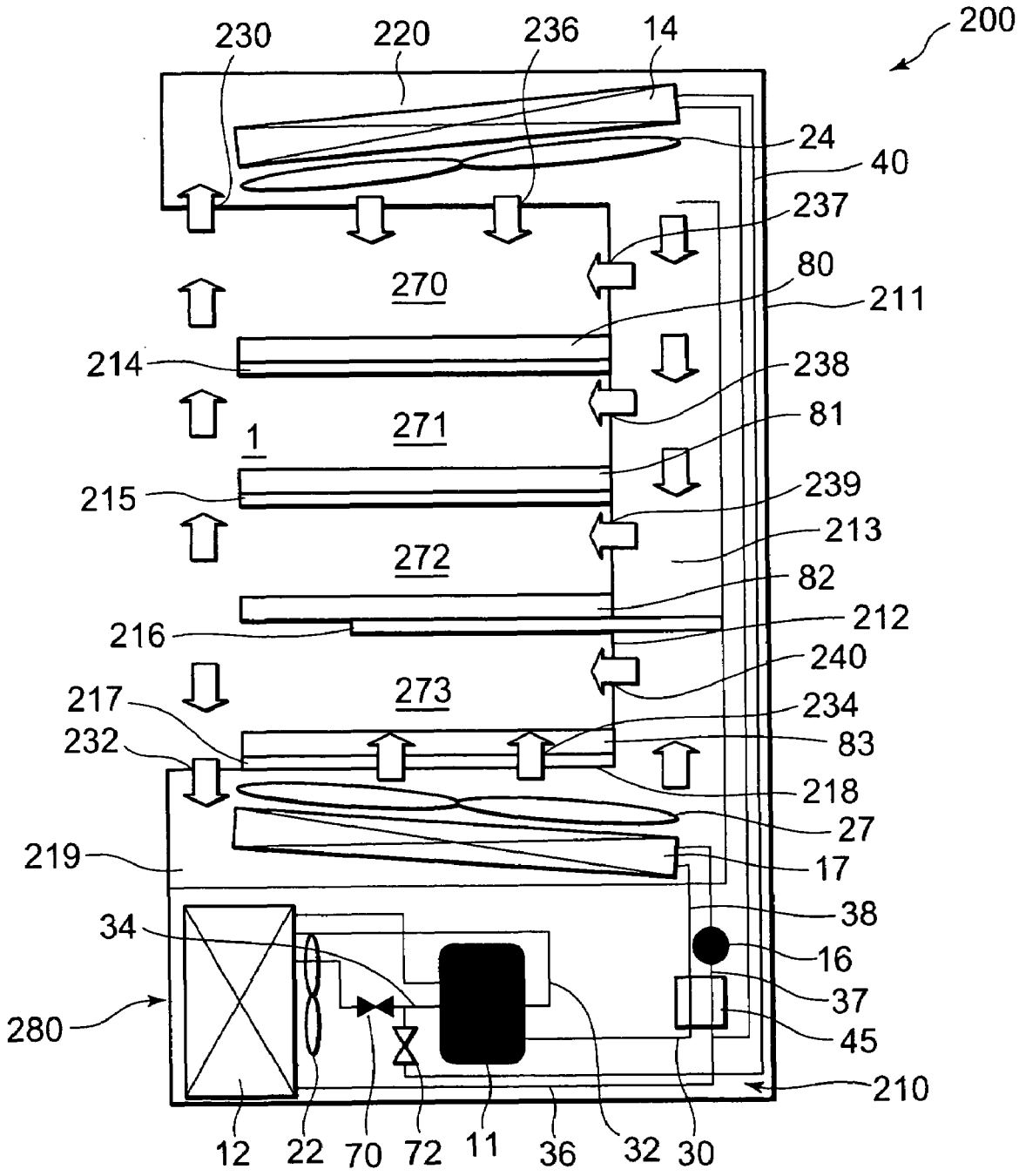
FIG. 23 is a vertical section side diagram showing an operation on a mode of using the receiving rooms 270, 271 and 272 as heating chambers and the receiving room 273 as a cooling chamber in the open showcase of the Embodiment 2-3.

(3) Mode of using receiving rooms 270, 271 and 272 as heating chambers and receiving room 273 as cooling chamber Next, referring to FIG. 23, description will be made of an operation on a mode of using the receiving rooms 270, 271 and 272 as heating chambers for heating articles, and the receiving room 273 as a cooling chamber for cooling articles.

When a worker inserts the shelf 216 into the duct 213 (at this time, the shelves 214 and 215 are not inserted into the duct 213), the shelf 216 partitions the duct 213 into upper and lower parts. The control device (not shown) closes the solenoid valve 70, and opens the solenoid valve 72 to open the first bypass circuit 40. Accordingly, refrigerants discharged from the compressor 11 all flow through the refrigerant discharge pipe 34 to the first bypass circuit 40 without flowing to the gas cooler 12.

The control device starts running of the electric heaters 80, 81 and 82 installed on the shelves 214, 215 and 216 of the receiving rooms 270, 271 and 272. Accordingly, the receiving rooms 270, 271 and 272 are heated. Additionally, the control device starts running of the fans 27 and 24 received in the bottom and upper ducts 219 and 220. At this time, the fan 22 is not run. The control device drives the driving element of the compressor 11. Thus, a low-pressure refrigerant gas is sucked through the refrigerant introduction pipe 30 into the first compression element (not shown) of the compressor 11, and compressed to become an intermediate pressure gas. After it is discharged through the refrigerant introduction pipe 32 to the outside of the sealed container, the refrigerant gas is passed through the intermediate cooler 25. The refrigerant releases heat during the passage through the intermediate cooler 25. However, the fan 22 is not run according to this mode, and thus heat releasing from the refrigerant at the intermediate cooler 25 is only a little, or almost no heat releasing occurs.

Accordingly, the refrigerant sucked into the second compression element can be maintained at a high temperature. Thus, a temperature of a refrigerant discharged from the compressor 11 becomes high to heat ambient air at the radiator 14. As a result, a heating efficiency of the radiator 14 can be maintained.

Subsequently, the refrigerant is sucked into the second compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure.

The refrigerant gas discharged from the compressor 11 flows from the midway of the refrigerant discharge pipe 34 through the first bypass circuit 40 into the radiator 14 installed in the upper duct 220 since the solenoid valve 70 is closed while the solenoid valve 72 is opened as described above. Here, the high-temperature and high-pressure refrigerant compressed by the compressor 11 is not condensed, but the fans are run in the supercritical state of the refrigerant gas. Heat is released from the high-temperature and high-pressure refrigerant gas by the evaporator 14. It should be noted that ambient air heated as a result of heat releasing from the refrigerant by the evaporator 14 enters the heating chamber 270 through the holes 236, 236 by running the fan 24 to heat the inside thereof. The air heated by the evaporator 14 passes through the duct 213 by the fan 24, and enters the receiving rooms 270, 271 and 272 through the communication holes 237, 238 and 239 to heat the insides thereof. According to the invention, the carbon dioxide is used for the refrigerant. Thus, since the refrigerant is not condensed at the radiator 14, a heat exchanging efficiency of the evaporator 14 is extremely high, and air in the heating chambers 270, 271 and 272 can be set to sufficiently high temperatures.

Air (hot air) blown by the fan 24 is not blown to a part below the shelf 216 since the duct 213 is partitioned by the shelf 216 as described above. Accordingly, the receiving rooms 270, 271 and 272 above the shelf 216 can be heated.

The air (hot air) blown into the receiving rooms 270, 271 and 272 repeats a cycle of being sucked through the suction port 230 into the upper duct 220 after heating the receiving rooms 270, 271 and 272, and being heated again by the evaporator 14.

On the other hand, the refrigerant from which the heat has been released by the evaporator 14 enters the refrigerant pipe 36 from the first bypass circuit 40, and passes through the internal heat exchanger 45. There, the heat of the refrigerant is drawn by a low-pressure side refrigerant out of the evaporator 17, and the refrigerant is further cooled. The presence of the internal heat exchanger 45 causes the low-pressure side refrigerant to draw the heat from the refrigerant which goes out of the evaporator 14 and passes through the internal heat exchanger 45. A supercooling degree of the refrigerant is increased by a corresponding amount. Thus, a cooling efficiency of the evaporator 17 is increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state flows into the evaporator 17 installed in the bottom duct 219. The refrigerant is evaporated there, and absorbs heat from ambient air to exhibit a cooling effect. It should be noted that the air cooled by the evaporation of the refrigerant at the evaporator 17 enters the receiving room 273 through the holes 234, 234 by running the fan 27 to cool the inside thereof.

Here, air (cold air) blown by the fan 27 is not blown to a part above the shelf 216 since the duct 213 is partitioned by the shelf 216 as described above. Accordingly, the receiving room 273 only below the shelf 216 can be cooled.

It should be noted that the air (cold air) blown into the receiving room 273 repeats a cycle of being sucked through the suction port 232 into the bottom duct 219 after cooling the receiving room 273, and being cooled again by the evaporator 17.

On the other hand, the refrigerant evaporated at the evaporator 17 flows out thereof, enters the refrigerant pipe 38, and passes through the internal heat exchanger 45. There, the refrigerant repeats a cycle of drawing heat from the high-pressure side refrigerant, receiving a heating effect to become a complete gas, and being sucked through the refrigerant introduction pipe 30 into the first compression element of the compressor 11.

Figure 24:
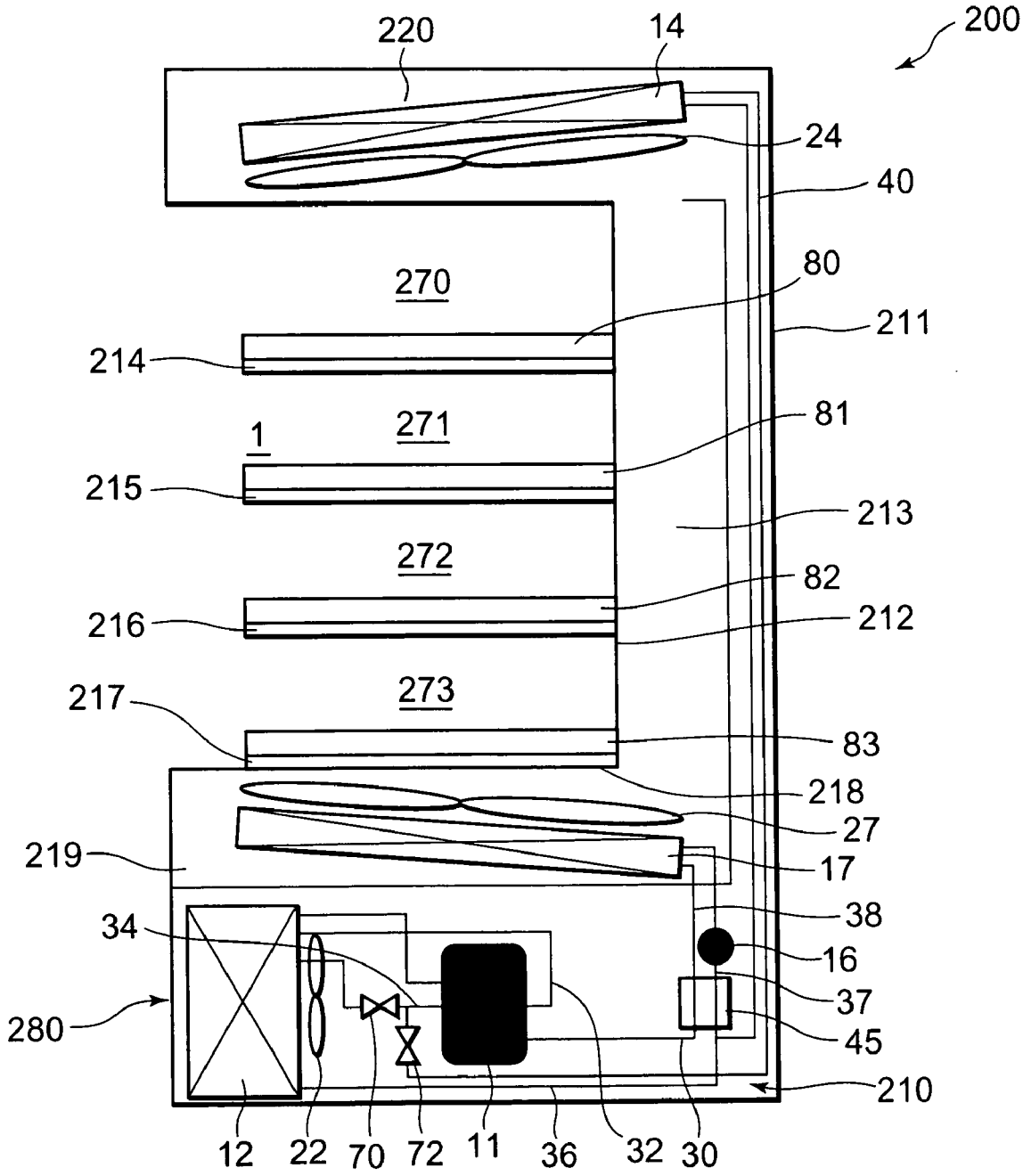
FIG. 24 is a vertical section side diagram showing a mode of using the receiving rooms 270, 271, 272 and 273 as heating chambers in the open showcase of the Embodiment 2-3.

(4) Mode of using receiving rooms 270, 271, 272 and 273 as heating chambers Lastly, referring to FIG. 24, description will be made of using the receiving rooms 270, 272, 272 and 273 as heating chambers for heating articles. While running of the compressor 1 is stopped, the control device (not shown) starts running of the electric heaters 80, 81, 82 and 83 installed on the shelves 214, 215, 216 and 217 to heat the receiving rooms 270, 271, 272 and 273. Accordingly, the receiving rooms 270, 272, 272 and 273 can be heated.

As described above, according to the embodiment, the radiator 14, the evaporator 17, and the fans 24, 27 for blowing air heat-exchanged with the radiator 14 and the evaporator 17 are installed outside the receiving rooms 270, 272, 272 and 273. Thus, heating/cooling of the receiving rooms 270, 272, 272 and 273 can be switched.

In addition to heating by the radiator 14, by using the electric heaters, it is possible to sufficiently heat the receiving rooms 270, 271, 272 and 273. Thus, the electric heaters are used to supplement the heating by the radiator 14. As a result, it is possible to reduce power consumption.

Figure 25:
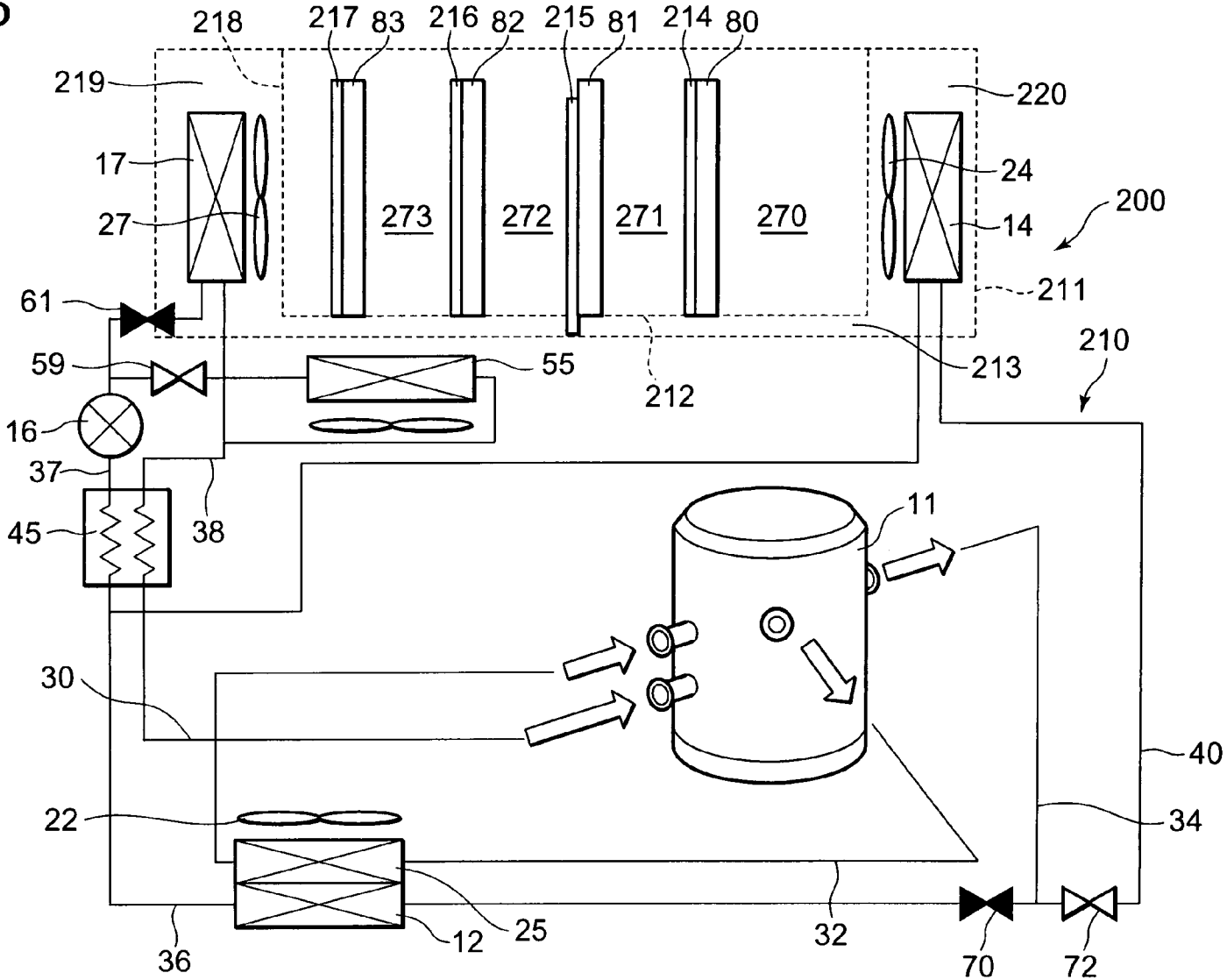
FIG. 25 is another refrigerant circuit diagram which uses the receiving rooms 270, 271, 272 and 273 as cooling chambers in the open showcase of the Embodiment 2-3.

According to the embodiment, on the mode of using all the receiving rooms 270, 272, 272 and 273 as heating chambers, while the running of the compressor 11 is stopped, all the receiving rooms 270, 272, 272 and 273 are heated only by the electric heaters 80, 81, 82 and 83. However, as shown in FIG. 25, an auxiliary evaporator 55 for evaporating a refrigerant may be installed separately from the evaporator 17 in the refrigerant circuit 210, and solenoid valves 61, 59 as flow path control means for controlling refrigerant circulation may be installed in the pipe of the inlet side of the evaporator 17 and the auxiliary evaporator 55. The solenoid valve 61 may be closed to inhibit flowing of a refrigerant to the evaporator 17. The solenoid valve 59 may be opened to supply a refrigerant to the auxiliary evaporator 55, and the refrigerant may be evaporated by the auxiliary evaporator 55. Thus, all the receiving rooms 270, 271, 272 and 273 can be heated by the radiator 14.

Next, referring to FIGS. 26 to 31, an embodiment of yet another invention will be described in detail.

Embodiment 3

Figure 26:
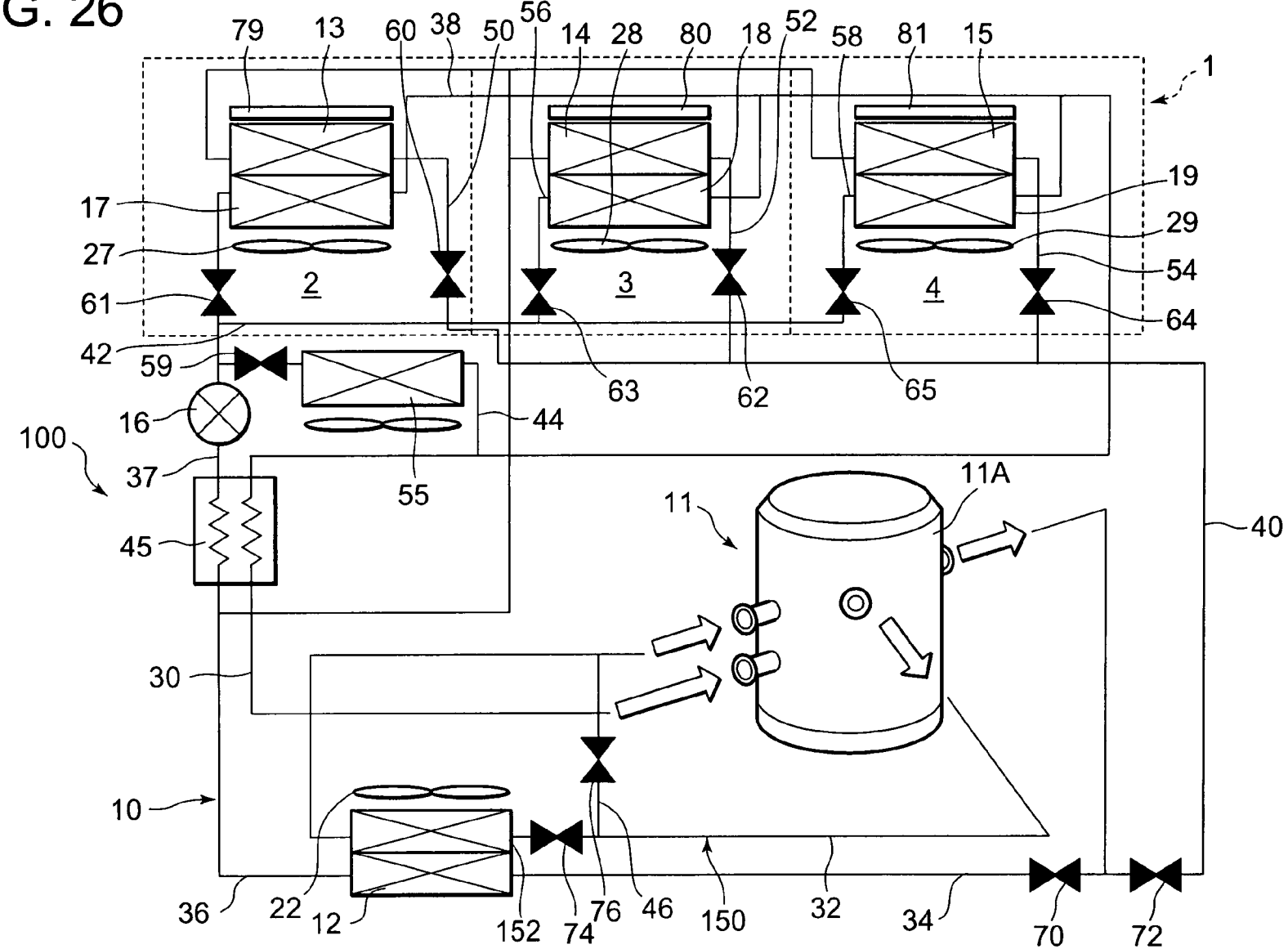
FIG. 26 is a refrigerant circuit diagram of a heating/cooling system according to an embodiment of another invention (Embodiment 3)

FIG. 26 is a schematic configuration diagram showing a heating/cooling system 100 according to an embodiment of the invention. It should be noted that the heating/cooling system of the invention can be used for a showcase, an automatic vending machine, an air conditioner, a cooling/heating cabinet or the like as in the previous case.

In FIG. 26, a reference numeral 1 denotes a storage room of the heating/cooling system 100. In this storage room 1, receiving rooms 2, 3 and 4 are disposed, and surrounded with insulating members.

In the receiving room 2, a radiator 13 for heating the receiving room 2, an electric heater 79 as an auxiliary heater, an evaporator 17 for cooling the receiving room 2, and a fan 27 for blowing (circulating) air heat-exchanged with the radiator 13 or the evaporator 17, or air heated by the electric heater into the receiving room 2 are installed.

In the receiving room 3, a radiator 14 and an electric heater 80 as an auxiliary heater for heating the receiving room 3, an evaporator 18 for cooling the receiving room 3, and a fan 28 for blowing (circulating) air heat-exchanged with the radiator 14 or the evaporator 18 or air heated by the electric heater into the receiving room 3 are installed.

Similarly, in the receiving room 4, a radiator 15 and an electric heater 81 as an auxiliary heater for heating the receiving room 4, an evaporator 19 for cooling the receiving room 4, and a fan 29 for blowing (circulating) air heat-exchanged with the radiator 15 or the evaporator 19 or air heated by the electric heater 81 into the receiving room 4 are installed.

Additionally, in FIG. 26, a reference numeral 10 denotes a refrigerant circuit constituted by sequentially connecting a compressor 11, a gas cooler 12, an expansion valve 16 as a pressure reducing device, and the evaporator 17, and the like annularly through pipes. The gas cooler 12 is provided separately from the radiators 13, 14 and 15 installed in the receiving rooms 2, 3 and 4 to cause heat releasing from a refrigerant.

That is, a refrigerant discharge pipe 34 of the compressor 11 is connected to an inlet of the gas cooler 12. Here, the compressor 11 of the embodiment is an internal intermediate pressure 2-stage compression type rotary compressor which comprises a driving element disposed in a sealed container 11A, and first and second rotary compression elements driven by the driving element.

In the drawing, a reference numeral 30 denotes a refrigerant introduction pipe for introducing a refrigerant into a cylinder of the first rotary compression element of the compressor 11. One end of this refrigerant introduction pipe 30 is communicated with the cylinder of the first rotary compression element. The other end of the refrigerant introduction pipe 30 is connected to an outlet of an internal heat exchanger 45 described below.

A refrigerant introduction pipe 32 is a refrigerant pipe for introducing a refrigerant compressed by the first rotary compression element into the second rotary compression element. Here, the refrigerant introduction pipe 32 is disposed to pass through an intermediate cooling circuit 150 installed outside the sealed container 11A. The intermediate cooling circuit 150 cools the refrigerant compressed by the first rotary compression element of the compressor 11, and sucks the refrigerant into the second rotary compression element. In the intermediate cooling circuit 150, a heat exchanger 152 for releasing heat at the intermediate cooling circuit 150, and a bypass pipe 46 for bypassing the heat exchanger 152 are installed. According to the embodiment, the heat exchanger 152 is constituted integrally with the gas cooler 12, and a fan 22 is disposed near the heat exchanger 152 and the gas cooler 12 to blow air thereto, thereby releasing heat from the refrigerant.

In the inlet side of the heat exchanger 152 of the intermediate cooling circuit 150 and the bypass pipe 46 which bypasses the heat exchanger 152, solenoid valves 74 and 76 are installed as flow path control means for controlling refrigerant circulation for the heat exchanger 152 and the bypass pipe 46. According to the embodiment, the solenoid valves 74 and 76 are provided to control refrigerant circulation for the heat exchanger 152 and the bypass pipe 46. However, the invention is not limited to such. A three-way valve may be provided to switch refrigerant circulation between the heat exchanger 152 and the bypass pipe 46.

The refrigerant discharge pipe 34 is a refrigerant pipe for discharging a refrigerant compressed by the second rotary compression element to the gas cooler 12.

A refrigerant pipe 36 connected to an outlet side of the gas cooler 12 is connected to the internal heat exchanger 45. It should be noted that the internal heat exchanger 45 is designed to exchange heat between high-pressure side and low-pressure side refrigerants. A refrigerant pipe 37 connected to the outlet of the internal heat exchanger 45 is connected through the expansion valve 16 to an inlet of the evaporator 17 of the receiving room 2.

Here, a first bypass circuit 40 is branched and connected to the midway of the refrigerant discharge pipe 34. This first bypass circuit 40 is further branched into pipes 50, 52 and 54, and then combined together to be connected to the refrigerant pipe 36. In the first bypass circuit 40 and the refrigerant discharge pipe 34, solenoid valves 70, 72 are installed as flow path control means for controlling flowing of a refrigerant compressed by the second rotary compression element of the compressor 11 to the gas cooler 12 or the first bypass circuit 40. Refrigerant circulation for the gas cooler 12 and the first bypass circuit 40 is not limited to control of the solenoid valves 70 and 72. For example, refrigerant circulation may be controlled by using and switching a three-way valve.

The pipe 50 is disposed to pass through the radiator 13 installed in the receiving room 2. In the pipe 50 of the inlet side of the radiator 13, a solenoid valve 60 is installed as flow path control means for controlling refrigerant circulation for the radiator 13.

The pipe 52 is disposed to pass through the radiator 14 installed in the receiving room 3. In the pipe 52 of the inlet side of the radiator 14, a solenoid valve 62 is installed as flow path control means for controlling refrigerant circulation for the radiator 14.

The pipe 54 is disposed to pass through the radiator 15 installed in the receiving room 4. In the pipe 54 of the inlet side of the radiator 15, a solenoid valve 64 is installed as flow path control means for controlling refrigerant circulation for the radiator 15.

A second bypass circuit 42 is branched and connected to the midway of the refrigerant pipe 37 out of the expansion valve 16. This second bypass circuit 42 is further branched into pipes 56 and 58, and then combined with a refrigerant pipe 38 out of the evaporator 17.

The pipe 56 is disposed to pass through the evaporator 18 installed in the receiving room 3. In the pipe 56 of the inlet side of the evaporator 18, a solenoid valve 63 is installed as flow path control means for controlling refrigerant circulation for the evaporator 18.

The pipe 58 is disposed to pass through the evaporator 19 installed in the receiving room 4. In the pipe 58 of the inlet side of the evaporator 19, a solenoid valve 65 is installed as flow path control means for controlling refrigerant circulation for the evaporator 58.

On a downstream side of the refrigerant pipe 37 to which the second bypass circuit 42 of the inlet side of the evaporator 17 is connected, a solenoid valve 61 is installed as flow path control means for controlling refrigerant circulation for the evaporator 17.

Furthermore, a third bypass circuit 44 is branched and connected to the refrigerant pipe 37 on an upstream side of the branched second bypass circuit 42 on the outlet side of the expansion valve 16. This third bypass circuit 44 is disposed to pass through an auxiliary evaporator 55, and a pipe out of the auxiliary evaporator 55 is combined with the refrigerant pipe 38 out of the evaporator 17. On the inlet side of the auxiliary evaporator 55 of the third bypass circuit 44, a solenoid valve 59 is installed as flow path control means for controlling refrigerant circulation for the auxiliary evaporator 55. It should be noted that the auxiliary evaporator 55 is provided separately from the evaporators 17, 18 and 19 installed in the receiving rooms 2, 3 and 4, and designed to evaporate a refrigerant.

Here, as a refrigerant sealed in the refrigerant circuit 10, carbon dioxide ($CO_2$) which is a natural refrigerant kind to a global environment is used in consideration of combustibility, toxicity, and the like.

Opening/closing of each of the solenoid valves 59, 60, 61, 62, 63, 64, 65, 70, 72, 73 and 74 is controlled by a control device (not shown). The control device controls refrigerant circulation by the solenoid valves 59, 60, 61, 62, 63, 64, 65, 70, and 72 to enable switching between hot air and cold air in the receiving rooms 2, 3 and 4. The control device controls the solenoid valves 74, 76 to control cooling of a refrigerant compressed by the first rotary compression element of the compressor 11 and passed through the intermediate cooling circuit 150 or sucking of the refrigerant into the second rotary compression element without being cooled.

It should be noted that the control device is control means in charge of controlling the heating/cooling system 100, and controls running of the compressor 11 and the fans 22, 27, 28, and 29 or the like in addition to control of the solenoid valves 59, 60, 61, 62, 63, 64, 65, 70, 72, 74 and 76.

(1) Mode of using receiving rooms 2, 3 and 4 as cooling chambers

Figure 27:
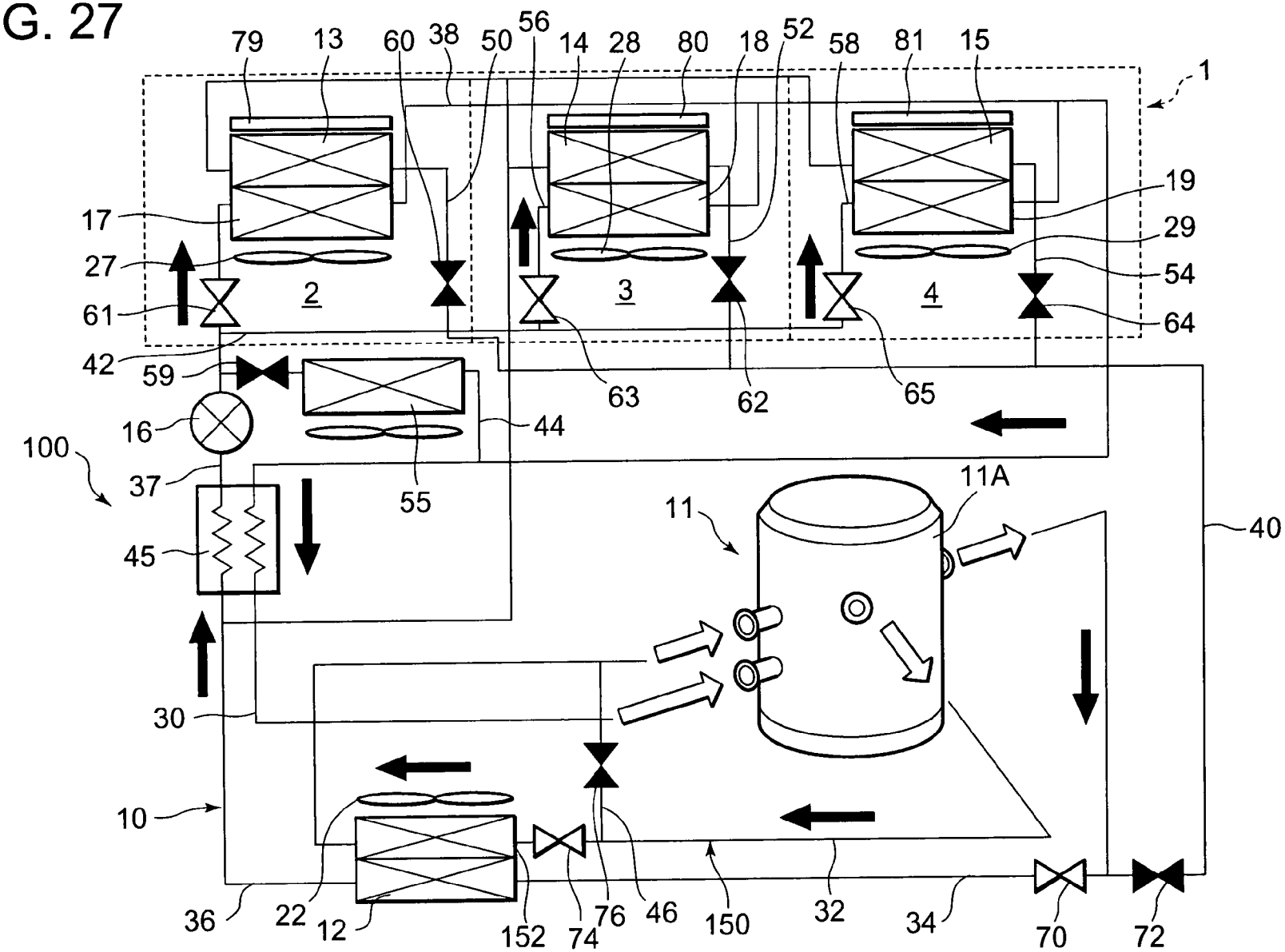
FIG. 27 is a refrigerant circuit diagram of FIG. 26 showing a flow of a refrigerant on a mode of using receiving rooms 2, 3 and 4 as cooling chambers.

Next, an operation of the heating/cooling system 100 of the invention configured in the aforementioned manner will be described. To begin with, referring to FIG. 27, a mode of using the receiving rooms 2, 3 and 4 as cooling chambers for cooling articles will be described. FIG. 27 is a refrigerant circuit diagram showing a flow of a refrigerant on this mode. The solenoid valve 70 is opened by the control device (not shown), while the solenoid valve 72 is closed to close the first bypass circuit 40. Accordingly, refrigerants discharged from the compressor 11 all flow through the refrigerant discharge pipe 34 to the gas cooler 12. The control device opens the solenoid valve 74, and closes the solenoid valve 76 to close the bypass pipe 46. Accordingly, refrigerants compressed by the first rotary compression element and discharged to the outside of the compressor 11 all flow to the heat exchanger 152.

The control device closes the solenoid valves 60, 62 and 64 to close the refrigerant pipes 50, 52 and 54, while it opens the solenoid valves 63 and 65 to open the pipes 56, 58. Accordingly, refrigerants from the second bypass circuit 42 flow through the pipes 56 and 58. The control device opens the solenoid valve 61 to allow flowing of a refrigerant from the expansion valve 16 to the evaporator 17, and closes the solenoid valve 59 to close the third bypass circuit 44. It should be noted that white solenoid valves indicate states of valves opened by the control device and black solenoid valves indicate states of valves closed by the control device in FIGS. 27 to 31.

The control device starts running of the fans 22, 27, 28 and 29, and drives the driving element of the compressor 11. Accordingly, a low-pressure refrigerant gas is sucked through the refrigerant introduction pipe 30 into the first rotary compression element (not shown) of the compressor 11, compressed to become an intermediate pressure gas, and discharged into the sealed container 11A. The refrigerant discharged into the sealed container 11A is discharged through the refrigerant introduction pipe 32 to the outside thereof, and enters the intermediate cooling circuit 150. Then, as the solenoid valve 74 is opened while the solenoid valve 76 is closed as described above, the refrigerant flowing through the refrigerant introduction pipe 32 passes through the heat exchanger 152. There, the refrigerant receives air from the fan 22 to release heat.

As described above, the refrigerant compressed by the first rotary compression element is cooled by the heat exchanger 152, and then sucked into the second rotary compression element. Thus, a temperature of the refrigerant gas discharged from the second rotary compression element of the compressor 11 can be reduced. Accordingly, since evaporation temperatures of the refrigerants by the evaporators 17, 18 and 19 are reduced, the receiving rooms 2, 3 and 4 can be cooled to lower temperatures. As a result, it is possible to increase efficiencies of the evaporators 17, 18 and 19 to cool the receiving rooms 2, 3 and 4.

Subsequently, the refrigerant is sucked into the second rotary compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows through the refrigerant discharge pipe 34 into the gas cooler 12 since the solenoid valve 70 is opened while the solenoid valve 72 is closed as described above.

Here, the high-temperature and high-pressure refrigerant compressed by the compressor 11 is not condensed, but the fans are run in the supercritical state of the refrigerant gas. The high-temperature and high-pressure refrigerant gas passes through the internal heat exchanger 45 after heat is released therefrom by the gas cooler 12. There, the heat of the refrigerant is drawn by low-pressure side refrigerants out of the evaporators 17, 18 and 19, and the refrigerant is further cooled. The presence of the internal heat exchanger 45 causes the low-pressure side refrigerant to draw the heat from the refrigerant which goes out of the gas cooler 12 and passes through the internal heat exchanger 45. A supercooling degree of the refrigerant is increased by a corresponding amount. Thus, cooling efficiencies of the evaporators 17, 18, and 19 are increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state by the expansion valve 16 flows into the evaporator 17 installed in the cooling chamber 2 since the solenoid valve 61 is opened as described above. The refrigerant is evaporated there, and absorbs heat from ambient air to exhibit a cooling effect. It should be noted that the air cooled by the evaporation of the refrigerant at the evaporator 17 is circulated in the receiving room 2 by running the fan 27 to cool the inside thereof.

The refrigerant is evaporated at a lower temperature by the evaporator 17 because of the effect of cooling the refrigerant compressed by the first rotary compression element at the heat exchanger 152 and the effect of passing the high-pressure side refrigerant discharged from the gas cooler 12 through the internal heat exchanger 50 and cooling it. Accordingly, the inside of the receiving room 2 can be cooled to a lower temperature, making it possible to increase a cooling efficiency. Subsequently, the refrigerant evaporated at the evaporator 17 goes out of the same, and enters the refrigerant pipe 38.

Meanwhile, a part of the refrigerant reduced in pressure by the expansion valve 16 enters the second bypass circuit 42 branched and connected to the midway of the refrigerant pipe 37 since the solenoid valves 63 and 65 are opened as described above, and the refrigerant is further branched to enter the pipes 56 and 58. The refrigerant that has entered the pipe 56 flows into the evaporator 18 installed in the receiving room 3, evaporates there, and absorbs heat from ambient air to exhibit a cooling effect. The air cooled by the evaporation of the refrigerant at the evaporator 18 is circulated in the receiving room 3 by running the fan 28 to cool the same.

The refrigerant is evaporated at a lower temperature at the evaporator 18 because of the effect of cooling the refrigerant compressed by the first rotary compression element at the heat exchanger 152 and the effect of passing the high-pressure side refrigerant discharged from the gas cooler 12 through the internal heat exchanger 50 and cooling it. Accordingly, the inside of the receiving room 3 can be cooled at a lower temperature, making it possible to increase a cooling efficiency. Subsequently, the refrigerant flows out of the evaporator 18, and combines with the refrigerant from the evaporator 17 which flows through the refrigerant pipe 38.

On the other hand, the refrigerant that has entered the pipe 58 flows into the evaporator 19 installed in the receiving room 4, evaporates there, and absorbs heat from ambient air to exhibit a cooling effect. The air cooled by the evaporation of the refrigerant at the evaporator 19 is circulated in the receiving room 4 by running the fan 29 to cool the same. The refrigerant is evaporated at a lower temperature by the evaporator 19 because of the effect of cooling the refrigerant compressed by the first rotary compression element at the heat exchanger 152 and the effect of passing the high-pressure side refrigerant discharged from the gas cooler 12 through the internal heat exchanger 50 and cooling it. Accordingly, the inside of the receiving room 4 can be cooled at a lower temperature, making it possible to increase a cooling efficiency.

Subsequently, the refrigerant out of the evaporator 19 combines with the refrigerants from the evaporators 17 and 18 which flow through the refrigerant pipe 38, and reaches the internal heat exchanger 45.

The refrigerant draws heat from the aforementioned high-pressure side refrigerant to receive a heating effect. Here, the refrigerant evaporated by each of the evaporators 17, 18, and 19 to become low in temperature and fed out therefrom may be set not in a completely gas state but in a liquid mixed state. However, the refrigerant is passed through the internal heat exchanger 45 to be heat-exchanged with the high-pressure side high-temperature refrigerant, thereby being superheated. At this time, a superheating degree of the refrigerant is secured, causing the refrigerant to become a complete gas.

Accordingly, the refrigerant out of each of the evaporators 17, 18, and 19 can be surely gasified, making it possible to assure prevention of a liquid-back, i.e., suction of a liquid refrigerant into the compressor 11, and to prevent a problem of damaging of the compressor 11 by liquid compression without disposing any accumulators or the like on the low-pressure side. Thus, it is possible to improve reliability of the heating/cooling system 100.

It should be noted that the refrigerant heated by the internal heat-exchanger 45 repeats a cycle of being sucked though the refrigerant introduction pipe 30 into the first compression element of the compressor 11.

As described above, the gas cooler 12 is provided separately from the radiators 13, 14 and 15 for heating the receiving rooms 2, 3 and 4, and the heat is released from the refrigerant by the gas cooler 12. Thus, it is possible to use all the receiving rooms 2, 3 and 4 as cooling chambers for cooling articles.

Figure 28:
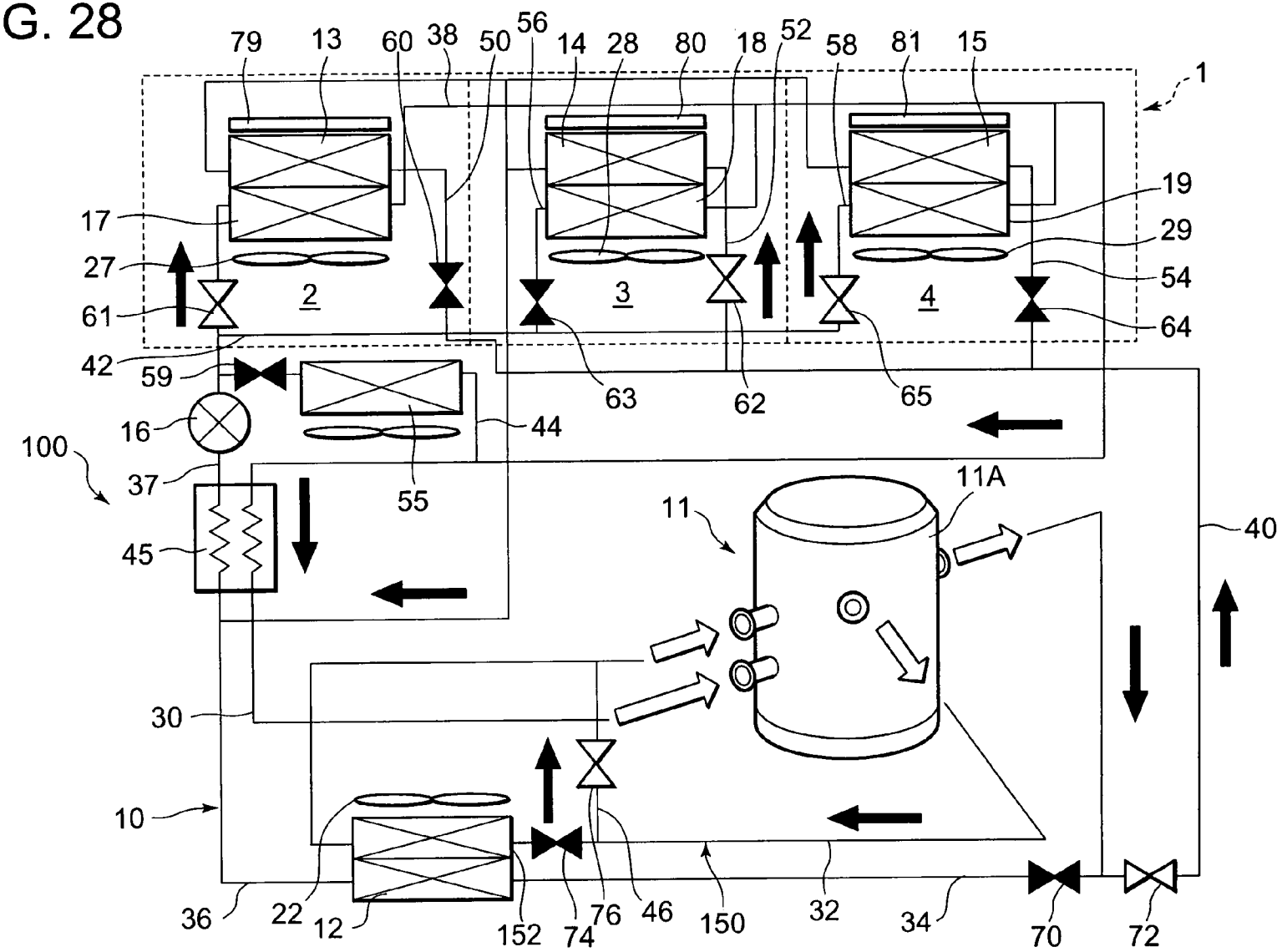
FIG. 28 is a refrigerant circuit diagram of FIG. 26 showing a flow of a refrigerant on a mode of using the receiving rooms 2 and 4 as cooling chambers and the receiving room 3 as a heating chamber.

(2) Mode of using receiving rooms 2 and 4 as cooling chambers and receiving room 3 as heating chamber Next, referring to FIG. 28, description will be made of an operation of the heating/cooling system 100 on a mode of using the receiving rooms 2 and 4 as cooling chambers for cooling articles and the receiving room 3 as a heating chamber for heating articles. FIG. 28 is a refrigerant circuit diagram showing a flow of a refrigerant on this mode.

The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12. The control device closes the solenoid valve 74, and opens the solenoid valve 76 to open the bypass pipe 46. Accordingly, refrigerants compressed by the first rotary compression element and discharged to the outside of the compressor 11 all flow to the bypass pipe 46 without passing through the heat exchanger 152.

The control device closes the solenoid valves 60 and 62 to close the refrigerant pipes 50 and 54, while it opens the solenoid valve 62 to open the refrigerant pipe 52. Accordingly, a refrigerant from the first bypass circuit 40 flows through the refrigerant pipe 52. The control device closes the solenoid valve 63 to close the pipe 56, while it opens the solenoid valve 65 to open the pipe 58. Accordingly, a refrigerant from the second bypass circuit 42 flows through the pipe 58. Furthermore, the control device closes the solenoid valve 59 to close the third bypass circuit 44, and opens the solenoid valve 61 to allow flowing of a refrigerant from the expansion valve 16 to the evaporator 17 installed in the receiving room 2.

The control device starts running of the fans 27, 28 and 29, and drives the driving element of the compressor 11. Accordingly, a low-pressure refrigerant gas is sucked through the refrigerant introduction pipe 30 into the first rotary compression element (not shown) of the compressor 11, compressed to become an intermediate pressure gas, and discharged into the sealed container 11A. The refrigerant discharged into the sealed container 11A is discharged through the refrigerant introduction pipe 32 to the outside of the sealed container 11A, and enters the intermediate cooling circuit 150. According to this mode, the solenoid valve 74 is closed while the solenoid valve 76 is opened as described above. Thus, the refrigerant is sucked from the refrigerant introduction pipe 32 through the bypass pipe 46 into the second rotary compression element of the compressor 11 without being passed through the heat exchanger 152.

That is, the refrigerant compressed by the first rotary compression element and sucked into the second rotary compression element is not cooled by the heat exchanger 152. Thus, cooling of the refrigerant by the intermediate cooling circuit 150 can be made substantially invalid. As a result, the refrigerant compressed by the second rotary compression element and discharged from the compressor 11 can be set to a high temperature.

The refrigerant sucked into the second rotary compression element is compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, as the solenoid valve 62 is opened as described above, the refrigerant enters the refrigerant pipe 52 from the first bypass circuit 40, and flows into the radiator 14 installed in the receiving room 3. Here, the high-temperature and high-pressure refrigerant compressed by the compressor 11 is not condensed, but the fans are run in the supercritical state of the refrigerant gas. Heat is released from the high-temperature and high-pressure refrigerant gas by the radiator 14. It should be noted that air heated as a result of heat releasing from the refrigerant by the radiator 14 is circulated in the receiving room 3 to heat the inside thereof by running the fan 28. According to the invention, carbon dioxide is used for the refrigerant. Thus, since the refrigerant is not condensed at the radiator 14, a heat exchanging efficiency of the radiator 14 is extremely high, making it possible to set air to a sufficiently high temperature in the receiving room 3.

Moreover, as described above, the refrigerant compressed by the first rotary compression element of the compressor 11 is passed through the bypass pipe 46, and the refrigerant is not cooled by the heat exchanger 152 of the intermediate cooling circuit 150. Thus, the refrigerant discharged from the compressor 11 can be maintained at a high temperature. In other words, since the high-temperature refrigerant flows in by the radiator 14, the receiving room 3 can be heated to a high temperature. Thus, it is possible to increase a heating efficiency of the radiator 14.

Subsequently, the refrigerant enters the refrigerant pipe 36 from the first bypass circuit 40, and passes through the internal heat exchanger 45. There, the heat of the refrigerant is drawn by low-pressure side refrigerants out of the evaporators 17 and 19, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant flows into the evaporator 17 installed in the receiving room 2.

The refrigerant is evaporated there, and absorbs heat from ambient air to exhibit a cooling effect. It should be noted that the air cooled by the evaporation of the refrigerant at the evaporator 17 is circulated in the receiving room 2 by running the fan 27 to cool the inside thereof. Subsequently, the refrigerant flows out of the evaporator 17 and enters the refrigerant pipe 38.

Meanwhile, a part of the refrigerant reduced in pressure by the expansion valve 16 passes through the second bypass circuit 42 from the midway of the refrigerant pipe 37 since the solenoid valve 65 is opened as described above, and enters the pipe 58. The refrigerant that has entered the pipe 58 flows into the evaporator 19 installed in the receiving room 4, evaporates there, and absorbs heat from ambient air to exhibit a cooling effect. The air cooled by the evaporation of the refrigerant at the evaporator 19 is circulated in the receiving room 4 by running the fan 29 to cool the same. Subsequently, the refrigerant flows out of the evaporator 19, and combines with the refrigerant from the evaporator 17 which flows through the refrigerant pipe 38.

The refrigerants combined through the refrigerant pipe 38 repeat a cycle of passing through the internal heat exchanger 45, drawing heat from the high-pressure side refrigerant, receiving a heating effect to become complete gases, and being sucked through the refrigerant introduction pipe 30 into the first compression element of the compressor 11.

Figure 29:
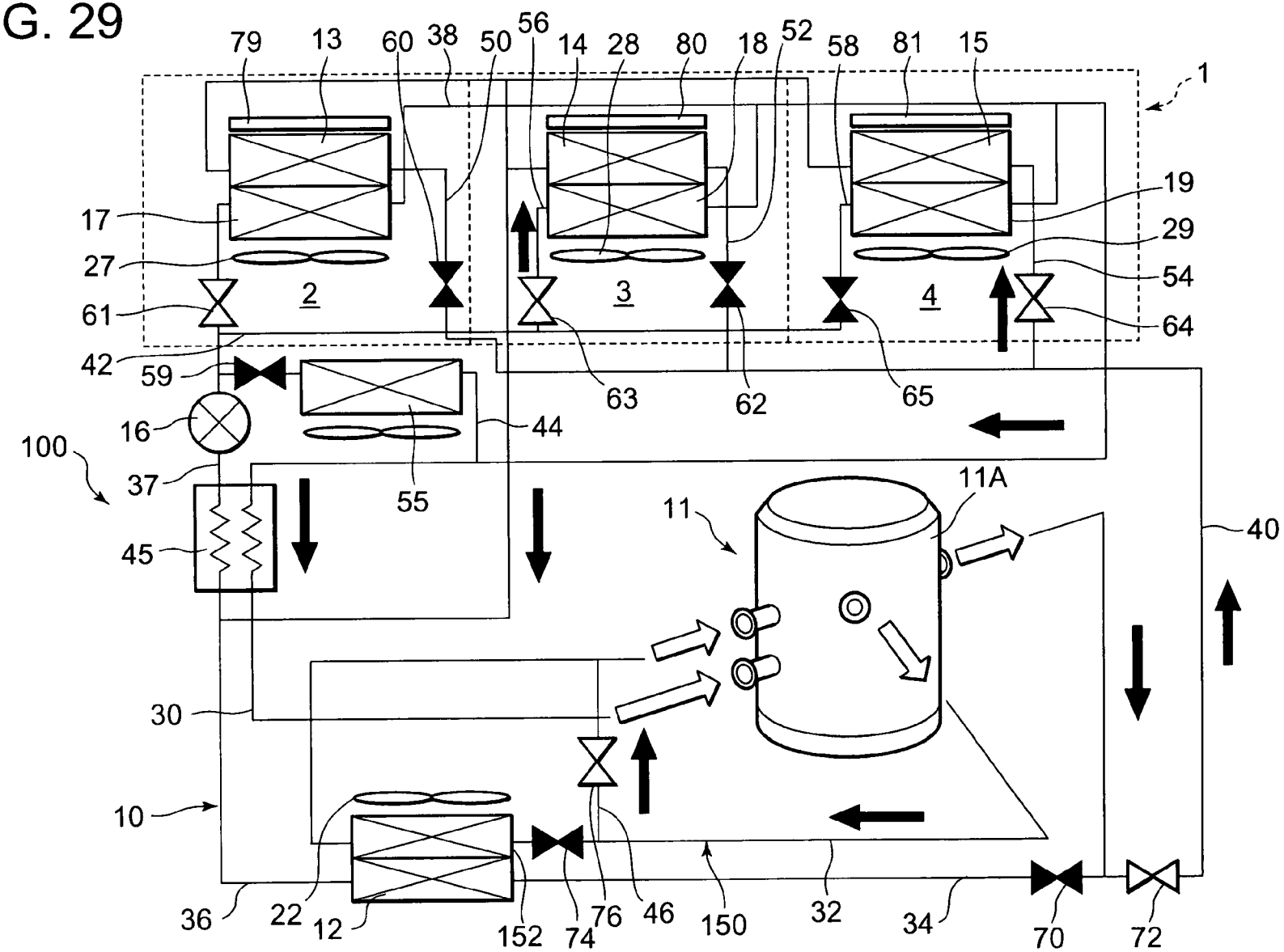
FIG. 29 is a refrigerant circuit diagram of FIG. 26 showing a flow of a refrigerant on a mode of using the receiving rooms 2 and 3 as cooling chambers and the receiving room 4 as a heating chamber.

(3) Mode of using receiving rooms 2 and 3 as cooling chambers and receiving room 4 as heating chamber Next, referring to FIG. 29, description will be made of an operation of the heating/cooling system 100 on a mode of using the receiving rooms 2 and 3 as cooling chambers for cooling articles and the receiving room 4 as a heating chamber for heating articles. FIG. 29 is a refrigerant circuit diagram showing a flow of a refrigerant on this mode.

The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12. The control device closes the solenoid valve 74, and opens the solenoid valve 76 to open the bypass pipe 46. Accordingly, refrigerants compressed by the first rotary compression element and discharged to the outside of the compressor 11 all flow to the bypass pipe 46 without passing through the heat exchanger 152.

The control device closes the solenoid valves 60 and 62 to close the refrigerant pipes 50 and 52, while it opens the solenoid valve 64 to open the refrigerant pipe 54. Accordingly, a refrigerant from the first bypass circuit 40 flows through the refrigerant pipe 54. The control device opens the solenoid valve 63 to open the pipe 56, while it closes the solenoid valve 65 to close the pipe 58. Accordingly, a refrigerant from the second bypass circuit 42 flows through the pipe 56. Furthermore, the control device opens the solenoid valve 61 to allow flowing of a refrigerant from the expansion valve 16 to the evaporator 17, and closes the solenoid valve 59 to close the third bypass circuit 44.

The control device starts running of the fans 27, 28 and 29, and drives the driving element of the compressor 11. Accordingly, a low-pressure refrigerant gas is sucked through the refrigerant introduction pipe 30 into the first rotary compression element (not shown) of the compressor 11, compressed to become an intermediate pressure gas, and discharged into the sealed container 11A. The refrigerant discharged into the sealed container 11A is discharged through the refrigerant introduction pipe 32 to the outside of the sealed container 11A, and enters the intermediate cooling circuit 150. The solenoid valve 74 is closed while the solenoid valve 76 is opened as described above. Thus, the refrigerant is sucked from the refrigerant introduction pipe 32 through the bypass pipe 46 into the second rotary compression element of the compressor 11 without being passed through the heat exchanger 152.

That is, the refrigerant compressed by the first rotary compression element and sucked into the second rotary compression element is not cooled by the heat exchanger 152. Thus, cooling of the refrigerant by the intermediate cooling circuit 150 can be made substantially invalid. As a result, the refrigerant compressed by the second rotary compression element and discharged from the compressor 11 can be set to a high temperature.

The refrigerant sucked into the second rotary compression element is compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, as the solenoid valve 64 is opened as described above, the refrigerant enters the refrigerant pipe 54 from the first bypass circuit 40, and flows into the radiator 15 installed in the receiving room 4. Here, the high-temperature and high-pressure refrigerant compressed by the compressor 11 is not condensed, but the fans are run in the supercritical state of the refrigerant gas. Heat is released from the high-temperature and high-pressure refrigerant gas by the radiator 15. It should be noted that air heated as a result of heat releasing from the refrigerant by the radiator 15 is circulated in the receiving room 4 to heat the inside thereof by running the fan 29. According to the invention, carbon dioxide is used for the refrigerant. Thus, since the refrigerant is not condensed at the radiator 15, a heat exchanging efficiency of the radiator 15 is extremely high, making it possible to set air to a sufficiently high temperature in the receiving room 4.

Moreover, as described above, the refrigerant compressed by the first rotary compression element of the compressor 11 is passed through the bypass pipe 46, and the refrigerant is not cooled by the heat exchanger 152 of the intermediate cooling circuit 150. Thus, the refrigerant discharged from the compressor 11 can be maintained at a high temperature. In other words, since the high-temperature refrigerant flows in by the radiator 15, the receiving room 4 can be heated to a high temperature. Thus, it is possible to increase a heating efficiency of the radiator 15.

Subsequently, the refrigerant enters the refrigerant pipe 36, and passes through the internal heat exchanger 45. There, the heat of the refrigerant is drawn by low-pressure side refrigerants out of the evaporators 17 and 18, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant flows into the evaporator 17 installed in the receiving room 2.

The refrigerant is evaporated there, and absorbs heat from ambient air to exhibit a cooling effect. It should be noted that the air cooled by the evaporation of the refrigerant at the evaporator 17 is circulated in the receiving room 2 by running the fan 27 to cool the inside thereof. Subsequently, the refrigerant flows out of the evaporator 17 and enters the refrigerant pipe 38.

Meanwhile, a part of the refrigerant reduced in pressure by the expansion valve 16 passes through the second bypass circuit 42 from the midway of the refrigerant pipe 37 since the solenoid valve 63 is opened as described above, and enters the pipe 56. The refrigerant that has entered the pipe 56 flows into the evaporator 18 installed in the receiving room 3, evaporates there, and absorbs heat from ambient air to exhibit a cooling effect. The air cooled by the evaporation of the refrigerant at the evaporator 18 is circulated in the receiving room 3 by running the fan 28 to cool the same. Subsequently, the refrigerant flows out of the evaporator 18, and combines with the refrigerant from the evaporator 17 which flows through the refrigerant pipe 38.

The refrigerants combined through the refrigerant pipe 38 repeat a cycle of passing through the internal heat exchanger 45, drawing heat from the high-pressure side refrigerant, receiving a heating effect to become complete gases, and being sucked through the refrigerant introduction pipe 30 into the first compression element of the compressor 11.

Figure 30:
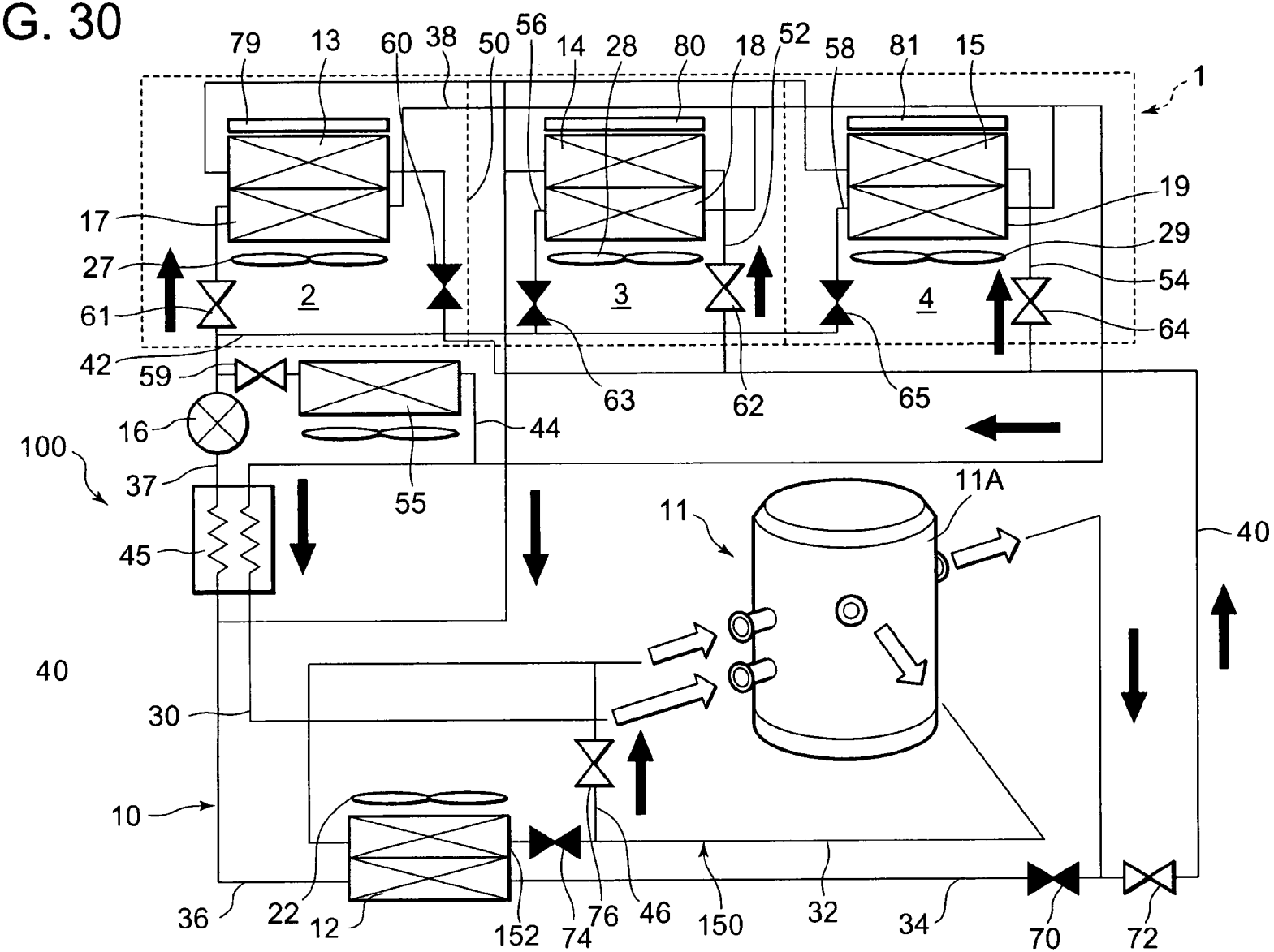
FIG. 30 is a refrigerant circuit diagram of FIG. 26 showing a flow of a refrigerant on a mode of using the receiving room 2 as a cooling chamber and the receiving rooms 3 and 4 as heating chambers.

(4) Mode of using receiving room 2 as cooling chamber and receiving rooms 3 and 4 as heating chambers Next, referring to FIG. 30, description will be made of an operation of the heating/cooling system 100 on a mode of using the receiving room 2 as a cooling chamber for cooling articles and the receiving rooms 3 and 4 as heating chambers for heating articles. FIG. 30 is a refrigerant circuit diagram showing a flow of a refrigerant on this mode.

The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12. The control device closes the solenoid valve 74, and opens the solenoid valve 76 to open the bypass pipe 46. Accordingly, refrigerants compressed by the first rotary compression element and discharged to the outside of the compressor 11 all flow to the bypass pipe 46 without passing through the heat exchanger 152.

The control device closes the solenoid valve 60 to close the refrigerant pipe 50, while it opens the solenoid valves 62 and 64 to open the refrigerant pipes 52 and 54. Accordingly, a refrigerant from the first bypass circuit 40 is branched to flow through the refrigerant pipes 52 and 54. The control device opens the solenoid valves 59 and 61 to open the third bypass circuit 44, while it closes the solenoid valves 63 and 65 to close the pipes 56 and 58. Accordingly, a refrigerant from the expansion valve 16 flows into the third bypass circuit 44 and the evaporator 17 installed in the receiving room 2 without flowing to the second bypass circuit 42.

The control device starts running of the fans 27, 28 and 29, and drives the driving element of the compressor 11. Accordingly, a low-pressure refrigerant gas is sucked through the refrigerant introduction pipe 30 into the first rotary compression element (not shown) of the compressor 11, compressed to become an intermediate pressure gas, and discharged into the sealed container 11A. The refrigerant discharged into the sealed container 11A is discharged through the refrigerant introduction pipe 32 to the outside of the sealed container 11A, and enters the intermediate cooling circuit 150. The solenoid valve 74 is closed while the solenoid valve 76 is opened as described above. Thus, the refrigerant is sucked from the refrigerant introduction pipe 32 through the bypass pipe 46 into the second rotary compression element of the compressor 11 without being passed through the heat exchanger 152.

That is, the refrigerant compressed by the first rotary compression element and sucked into the second rotary compression element is not cooled by the heat exchanger 152. Thus, cooling of the refrigerant by the intermediate cooling circuit 150 can be made substantially invalid. As a result, the refrigerant compressed by the second rotary compression element and discharged from the compressor 11 can be set to a high temperature.

The refrigerant sucked into the second rotary compression element is compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, as the solenoid valves 62 and 64 are opened as described above, the refrigerant is branched from the first bypass circuit 40 to enter the refrigerant pipes 52 and 54. The refrigerant that has entered the refrigerant pipe 52 flows into the radiator 14 installed in the receiving room 3, and releases heat there. Here, the high-temperature and high-pressure refrigerant compressed by the compressor 11 is not condensed, but the fans are run in the supercritical state of the refrigerant gas. It should be noted that air heated as a result of heat releasing from the refrigerant by the radiator 14 is circulated in the receiving room 3 to heat the inside thereof by running the fan 28. According to the invention, carbon dioxide is used for the refrigerant. Thus, since the refrigerant is not condensed at the radiator 14, a heat exchanging efficiency of the radiator 14 is extremely high, making it possible to set air to a sufficiently high temperature in the receiving room 3.

Moreover, as described above, the refrigerant compressed by the first rotary compression element of the compressor 11 is passed through the bypass pipe 46, and the refrigerant is not cooled by the heat exchanger 152 of the intermediate cooling circuit 150. Thus, the refrigerant discharged from the compressor 11 can be maintained at a high temperature. In other words, since the high-temperature refrigerant flows in by the radiator 14, the receiving room 3 can be heated to a high temperature. Thus, it is possible to increase a heating efficiency of the radiator 14.

On the other hand, the refrigerant that has entered the refrigerant pipe 55 flows into the radiator 15 installed in the receiving room 4. Here, the high-temperature and high-pressure refrigerant compressed by the compressor 11 is not condensed, but the fans are run in the supercritical state of the refrigerant gas. It should be noted that air heated as a result of heat releasing from the refrigerant by the radiator 15 is circulated in the receiving room 4 to heat the inside thereof by running the fan 29. According to the invention, carbon dioxide is used for the refrigerant. Thus, since the refrigerant is not condensed at the radiator 15, a heat exchanging efficiency of the radiator 15 is extremely high, making it possible to set air to a sufficiently high temperature in the receiving room 4.

Moreover, as described above, the refrigerant compressed by the first rotary compression element of the compressor 11 is passed through the bypass pipe 46, and the refrigerant is not cooled by the heat exchanger 152 of the intermediate cooling circuit 150. Thus, the refrigerant discharged from the compressor 11 can be maintained at a high temperature. In other words, since the high-temperature refrigerant flows in by the radiator 15, the receiving room 4 can be heated to a high temperature. Thus, it is possible to increase a heating efficiency of the radiator 15.

Subsequently, the refrigerant out of the radiator 14 or 15 combined with the other, enters the refrigerant pipe 36 from the first bypass circuit 40, and passes through the internal heat exchanger 45. There, the heat of the refrigerant is drawn by low-pressure side refrigerants out of the evaporator 17 and the auxiliary evaporator 55, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant flows into the evaporator 17 installed in the receiving room 2.

The refrigerant is evaporated there, and absorbs heat from ambient air to exhibit a cooling effect. It should be noted that the air cooled by the evaporation of the refrigerant at the evaporator 17 is circulated in the receiving room 2 by running the fan 27 to cool the inside thereof. Subsequently, the refrigerant flows out of the evaporator 17 and enters the refrigerant pipe 38.

Meanwhile, a part of the refrigerant reduced in pressure by the expansion valve 16 enters the third bypass circuit 44 branched and connected to the midway of the refrigerant pipe 37 since the solenoid valve 59 is opened as described above, and enters the auxiliary evaporator 55 installed therein. The refrigerant evaporates there, and absorbs heat from ambient air to exhibit a cooling effect. Subsequently, the refrigerant flows out of the auxiliary evaporator 55, combines with the refrigerant from the evaporator 17 which flows through the refrigerant pipe 38, and passes through the internal heat exchanger 45.

The refrigerant repeats a cycle of drawing heat from the high-pressure side refrigerant, receiving a heating effect to become a complete gas, and being sucked through the refrigerant introduction pipe 30 into the first compression element of the compressor 11.

As described above, even when the receiving rooms 3 and 4 are used as heating chambers for heating articles, the refrigerant is evaporated by the auxiliary evaporator 55 in addition to the heating by the evaporator 17. As a result, it is possible to sufficiently heat the receiving rooms 3 and 4.

(5) Mode of using receiving rooms 2, 3 and 4 as heating chambers

Figure 31:
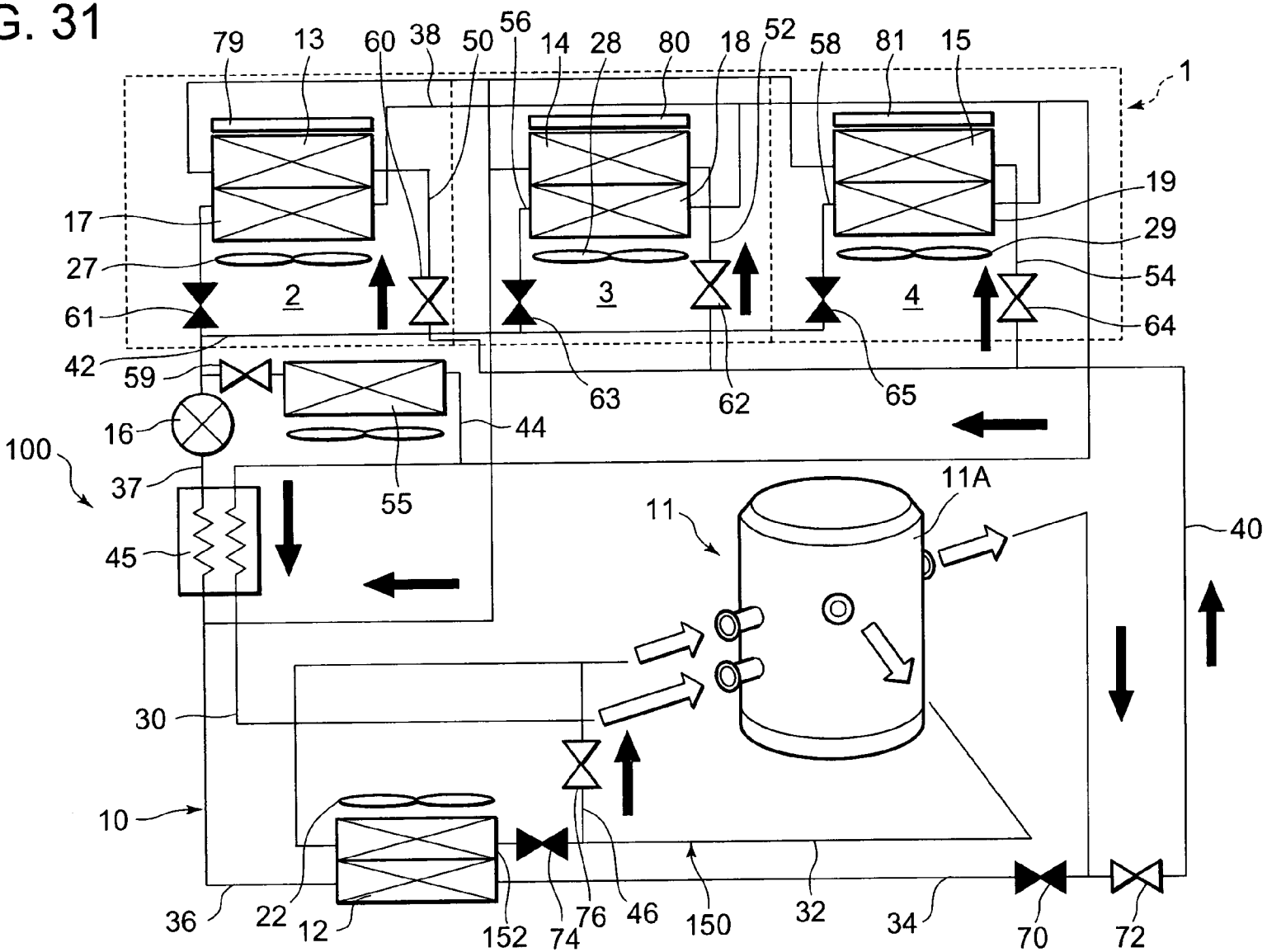
FIG. 31 is a refrigerant circuit diagram of FIG. 26 showing a flow of a refrigerant on a mode of using the receiving rooms 2, 3 and 4 as heating chambers.

Lastly, referring to FIG. 31, description will be made of an operation of the heating/cooling system 100 on a mode of using the receiving rooms 2, 3 and 4 as heating chambers for heating articles. FIG. 31 is a refrigerant circuit diagram showing a flow of a refrigerant on this mode. The solenoid valve 70 is closed by the control device (not shown), while the solenoid valve 72 is opened to open the first bypass circuit 40. Accordingly, refrigerants discharged from the compressor 11 all flow from the midway of the refrigerant discharge pipe 34 into the first bypass circuit 40 without flowing to the gas cooler 12.

The control device closes the solenoid valve 74, and opens the solenoid valve 76 to open the bypass pipe 46. Accordingly, refrigerants compressed by the first rotary compression element and discharged to the outside of the compressor 11 all flow to the bypass pipe 46 without passing through the heat exchanger 152.

The control device opens the solenoid valves 60, 62 and 64 to open the refrigerant pipes 50, 52 and 54. Accordingly, a refrigerant from the first bypass circuit 40 is branched to flow through the refrigerant pipes 50, 52 and 54. The control device closes the solenoid valve 61 to stop refrigerant circulation to the evaporator 17, and closes the solenoid valves 63 and 65 to close the pipes 56 and 58. The control device opens the solenoid valve 59 to open the third bypass circuit 44. Accordingly, a refrigerant from the expansion valve 16 flows into the third bypass circuit 44 without flowing to the second bypass circuit 42 or the evaporator 17.

The control device starts running of the fans 27, 28 and 29, and drives the driving element of the compressor 11. Accordingly, a low-pressure refrigerant gas is sucked through the refrigerant introduction pipe 30 into the first rotary compression element (not shown) of the compressor 11, compressed to become an intermediate pressure gas, and discharged into the sealed container 11A. The refrigerant discharged into the sealed container 11A is discharged through the refrigerant introduction pipe 32 to the outside of the sealed container 11A, and enters the intermediate cooling circuit 150. The solenoid valve 74 is closed while the solenoid valve 76 is opened as described above. Thus, the refrigerant is sucked from the refrigerant introduction pipe 32 through the bypass pipe 46 into the second rotary compression element of the compressor 11 without being passed through the heat exchanger 152.

That is, the refrigerant compressed by the first rotary compression element and sucked into the second rotary compression element is not cooled by the heat exchanger 152. Thus, cooling of the refrigerant by the intermediate cooling circuit 150 can be made substantially invalid. As a result, the refrigerant compressed by the second rotary compression element and discharged from the compressor 11 can be set to a high temperature.

The refrigerant sucked into the second rotary compression element is compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows from the midway of the refrigerant discharge pipe 34 into the first bypass circuit 40 since the solenoid valve 70 is closed while the solenoid valve 72 is opened as described above.

Then, as the solenoid valves 60, 62 and 64 are opened as described above, the refrigerant is branched from the first bypass circuit 40 to enter the refrigerant pipes 50, 52 and 54. The refrigerant that has entered the refrigerant pipe 50 flows into the radiator 13 installed in the receiving room 2, and releases heat there. Here, the high-temperature and high-pressure refrigerant compressed by the compressor 11 is not condensed, but the heat is released in a supercritical state. It should be noted that air heated as a result of heat releasing from the refrigerant by the radiator 13 is circulated in the receiving room 2 to heat the inside thereof by running the fan 27. According to the invention, carbon dioxide is used for the refrigerant. Thus, since the refrigerant is not condensed at the radiator 13, a heat exchanging efficiency of the radiator 13 is extremely high, making it possible to set air to a sufficiently high temperature in the receiving room 2.

Moreover, as described above, the refrigerant compressed by the first rotary compression element of the compressor 11 is passed through the bypass pipe 46, and the refrigerant is not cooled by the heat exchanger 152 of the intermediate cooling circuit 150. Thus, the refrigerant discharged from the compressor 11 can be maintained at a high temperature. In other words, since the high-temperature refrigerant flows in by the radiator 13, the receiving room 2 can be heated to a high temperature. Thus, it is possible to increase a heating efficiency of the radiator 13.

Meanwhile, the refrigerant that has entered the refrigerant pipe 52 flows into the radiator 14 installed in the receiving room 3, and releases heat there. Here, the high-temperature and high-pressure refrigerant compressed by the compressor 11 is not condensed, but the fans are run in the supercritical state of the refrigerant gas. It should be noted that air heated as a result of heat releasing from the refrigerant by the radiator 14 is circulated in the receiving room 3 to heat the inside thereof by running the fan 28. According to the invention, carbon dioxide is used for the refrigerant. Thus, since the refrigerant is not condensed at the radiator 14, a heat exchanging efficiency of the radiator 14 is extremely high, making it possible to set air to a sufficiently high temperature in the receiving room 3.

Moreover, as described above, the refrigerant compressed by the first rotary compression element of the compressor 11 is passed through the bypass pipe 46, and the refrigerant is not cooled by the heat exchanger 152 of the intermediate cooling circuit 150. Thus, the refrigerant discharged from the compressor 11 can be maintained at a high temperature. In other words, since the high-temperature refrigerant flows in by the radiator 14, the receiving room 3 can be heated to a high temperature. Thus, it is possible to increase a heating efficiency of the radiator 14.

On the other hand, the refrigerant that has entered the refrigerant pipe 54 flows into the radiator 15 installed in the receiving room 4. Here, the high-temperature and high-pressure refrigerant compressed by the compressor 11 is not condensed, but the fans are run in the supercritical state of the refrigerant gas. It should be noted that air heated as a result of heat releasing from the refrigerant by the radiator 15 is circulated in the receiving room 4 to heat the inside thereof by running the fan 29. According to the invention, carbon dioxide is used for the refrigerant. Thus, since the refrigerant is not condensed at the radiator 15, a heat exchanging efficiency of the radiator 15 is extremely high, making it possible to set air to a sufficiently high temperature in the receiving room 4.

Moreover, as described above, the refrigerant compressed by the first rotary compression element of the compressor 11 is passed through the bypass pipe 46, and the refrigerant is not cooled by the heat exchanger 152 of the intermediate cooling circuit 150. Thus, the refrigerant discharged from the compressor 11 can be maintained at a high temperature. In other words, since the high-temperature refrigerant flows in by the radiator 15, the receiving room 4 can be heated to a high temperature. Thus, it is possible to increase a heating efficiency of the radiator 15.

Subsequently, the refrigerant out of the radiator 13, 14 or 15 combines with the other, enters the refrigerant pipe 36 from the first bypass circuit 40, and passes through the internal heat exchanger 45. There, the heat of the refrigerant is drawn by low-pressure side refrigerant out of the auxiliary evaporator 55, and the refrigerant is further cooled. The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16.

The refrigerant set in the 2-phase mixed state by the expansion valve 16 enters the third bypass circuit 44 and flows into the auxiliary evaporator 55 installed therein because the solenoid valve 59 is opened as described above.

The refrigerant is evaporated there, and absorbs heat from ambient air to exhibit a cooling effect. Then, the refrigerant enters the refrigerant pipe 38, and passes through the internal heat exchanger 45.

The refrigerant repeats a cycle of drawing heat from the high-pressure side refrigerant, receiving a heating effect to become a complete gas, and being sucked through the refrigerant introduction pipe 30 into the first compression element of the compressor 11.

As described above, the auxiliary evaporator 55 is provided separately from the evaporators 17, 18 and 19 for cooling the receiving rooms 2, 3 and 4. By evaporating the evaporator at the auxiliary evaporator 55, all the receiving rooms 2, 3 and 4 can be used as heating chambers for heating articles. Thus, even when the receiving rooms 2, 3 and 4 are used as heating chambers, continuous heating running can be realized by the refrigerant circuit 10.

Moreover, the refrigerant compressed by the first rotary compression element of the compressor 11 is supplied to the bypass pipe 46, wherein cooling of the refrigerant by the intermediate cooling circuit 150 is made substantially invalid. Thus, the refrigerant discharged out of the compressor 11 can be maintained at a high temperature. Because of this effect, it is possible to increase heating efficiencies of the radiators 13, 14 and 15.

All in all, it is possible to further improve convenience of the heating/cooling system 100.

As described above, the carbon dioxide of good heating characteristics is used for the refrigerant. Accordingly, the insides of the receiving rooms 2, 3 and 4 can be heated by the radiators 13, 14 and 15, and cooled by the evaporators 17, 18 and 19. Thus, the receiving rooms 2, 3 and 4 can be heated without installing any heating elements such as electric heaters or any special heating devices. As a result, it is possible to greatly reduce power consumption of the heating/cooling system 100.

Hot air and cold air can be switched to be used in the receiving rooms 2, 3 and 4 by controlling refrigerant circulation through the solenoid valves 59, 60, 61, 62, 63, 64, 65, 70, and 72 of the aforementioned modes. Thus, by switching opening/closing of each solenoid valve according to a use situation, it is possible to freely control hot air/cold air in the receiving rooms 2, 3 and 4.

In the case of the mode of using all the receiving rooms 2, 3 and 4 as the cooling chambers, the refrigerant compressed by the first rotary compression element is supplied to the heat exchanger 152 of the intermediate cooling circuit 150 to be cooled, and then sucked into the second rotary compression element. Accordingly, a temperature of the refrigerant gas discharged from the second compression element of the compressor can be reduced. As a result, it is possible to increase cooling efficiencies of the receiving rooms 2, 3 and 4.

Additionally, in the case of the mode of heating the inside of any one of the receiving rooms 2, 3 and 4, the refrigerant is supplied to the bypass pipe 46, and the cooling of the refrigerant by the intermediate cooling circuit 150 is made substantially invalid. Thus, the refrigerant gas discharged from the second rotary compression element of the compressor 11 can be maintained at a high temperature, and a heating efficiency of the radiator can be increased.

Furthermore, the intermediate cooling circuit 150 comprises the heat exchanger 152 for releasing heat from the refrigerant, the bypass pipe 46 for bypassing the heat exchanger 152, and the solenoid valves 74 and 76 for controlling refrigerant circulation for the heat exchanger 152 and the bypass pipe 46. Thus, it is possible to control cooling of the refrigerant compressed by the first rotary compression element with a relatively simple structure.

According to the embodiment, the gas cooler 12 and the heat exchanger 152 are constituted integrally. However, the invention is not limited to this. The gas cooler 12 and the heat exchanger 152 may be installed separately.

Additionally, in this case, the fan may be run to blow air to the heat exchanger when cooling is performed by the heat exchanger without disposing a bypass pipe 46, and the fan may be stopped when cooling by heat exchanger is made invalid.

In the case of the mode of using the receiving room 2, and/or the receiving room 3, and/or the receiving room 4 as heating rooms for heating articles, by running the electric heater 79, 80 or 81 installed therein, heating may be executed by the electric heater 79, 80 or 81 to supplement the heating by the evaporator 13, 14 or 15. In this case, it is possible to prevent a problem that the receiving room 2, 3 or 4 cannot be sufficiently heated due to a shortage of a heating efficiency in winter or the like. The electric heater 79, 80 or 81 supplements the heating by the radiator 13, 14 or 15. Accordingly, a capacity of the electric heater 79, 80 or 81 can be reduced. As a result, it is possible to reduce power consumption compared with the case of heating only by the electric heater.

According to the embodiment, the gas cooler 12 and the auxiliary evaporator 55 are separately installed in the refrigerant circuit 10. However, the invention is not limited to this. The gas cooler and the auxiliary evaporator may be constituted integrally. With this constitution, installation spaces of the gas cooler 12 and the auxiliary evaporator 55 can be reduced. As a result, it is possible to achieve space conservation for the heating/cooling system 300.

According to the embodiment, the three receiving rooms (receiving rooms 2, 3 and 4) capable of using hot air and cold air in a switching manner are provided. However, the invention is not limited to this. Four or more receiving rooms may be disposed, and hot air and cold air can be used in a switching manner by flow path control means.

According to the embodiment, the radiators 13, 14 and 15 and the evaporators 17, 18 and 19 are installed in the receiving rooms 2, 3 and 4, and refrigerant circulation is controlled by opening/closing the solenoid valves 59, 60, 61, 62, 63, 64, 65, 70 and 72, thereby controlling heating/cooling of the receiving rooms 2, 3 and 4. However, the invention is not limited to this. For example, a duct may be disposed outside the receiving room, a radiator and an evaporator may be installed in the duct. By switching fan blowing, hot or cold air may be blown to each receiving room to switch heating/cooling.

Furthermore, according to the embodiment, the rotary compressor of the internal intermediate 2-stage compression type is used. However, as long as a constitution is such that the refrigerant compressed by the first compression element is sucked into the second compression element, any compression forms, any number of stages or the like may be employed.

Figure 33:
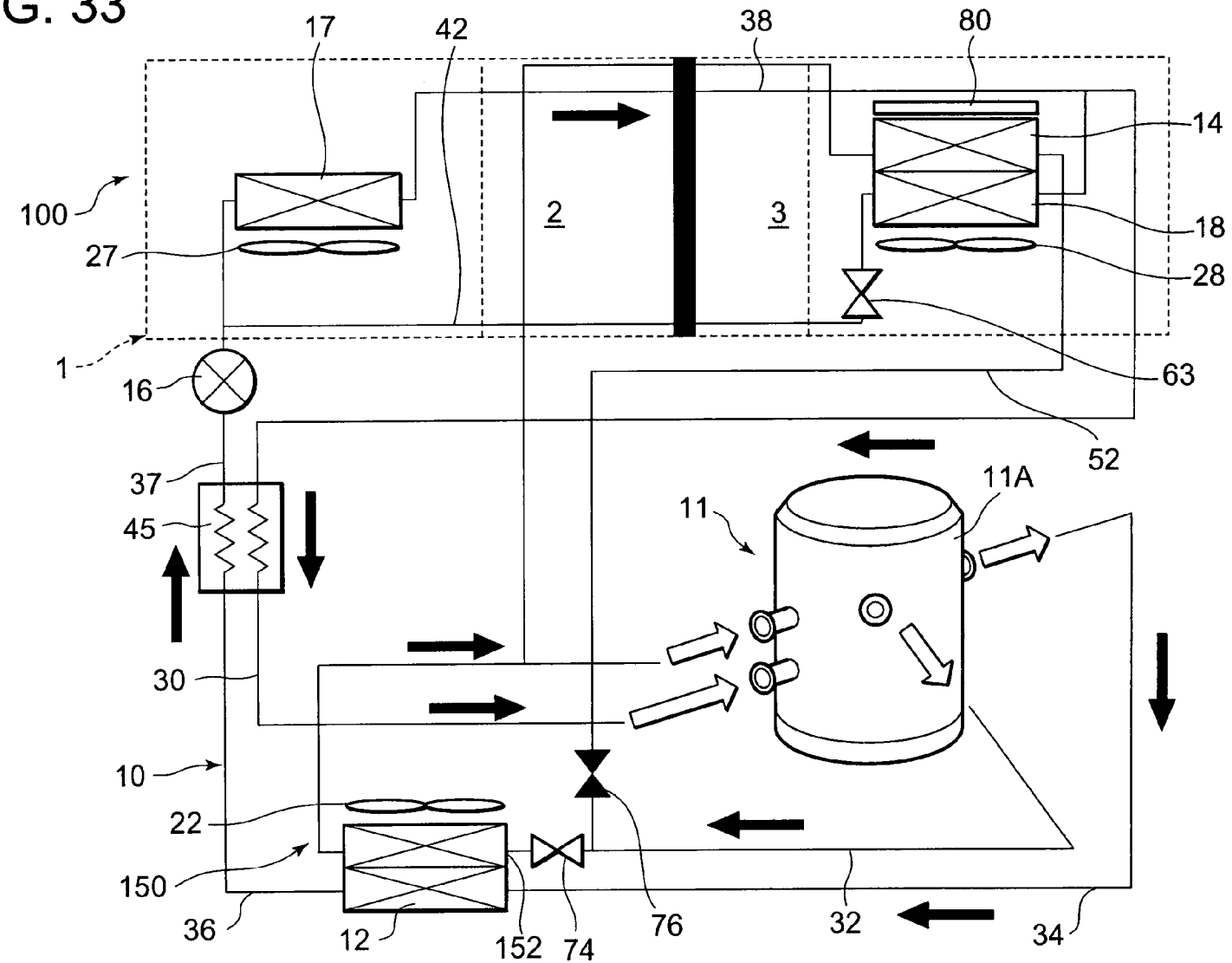
FIG. 33 is a refrigerant circuit diagram of FIG. 32 showing a flow of a refrigerant on a mode of using a receiving room 3 as a cooling chamber.
Figure 34:
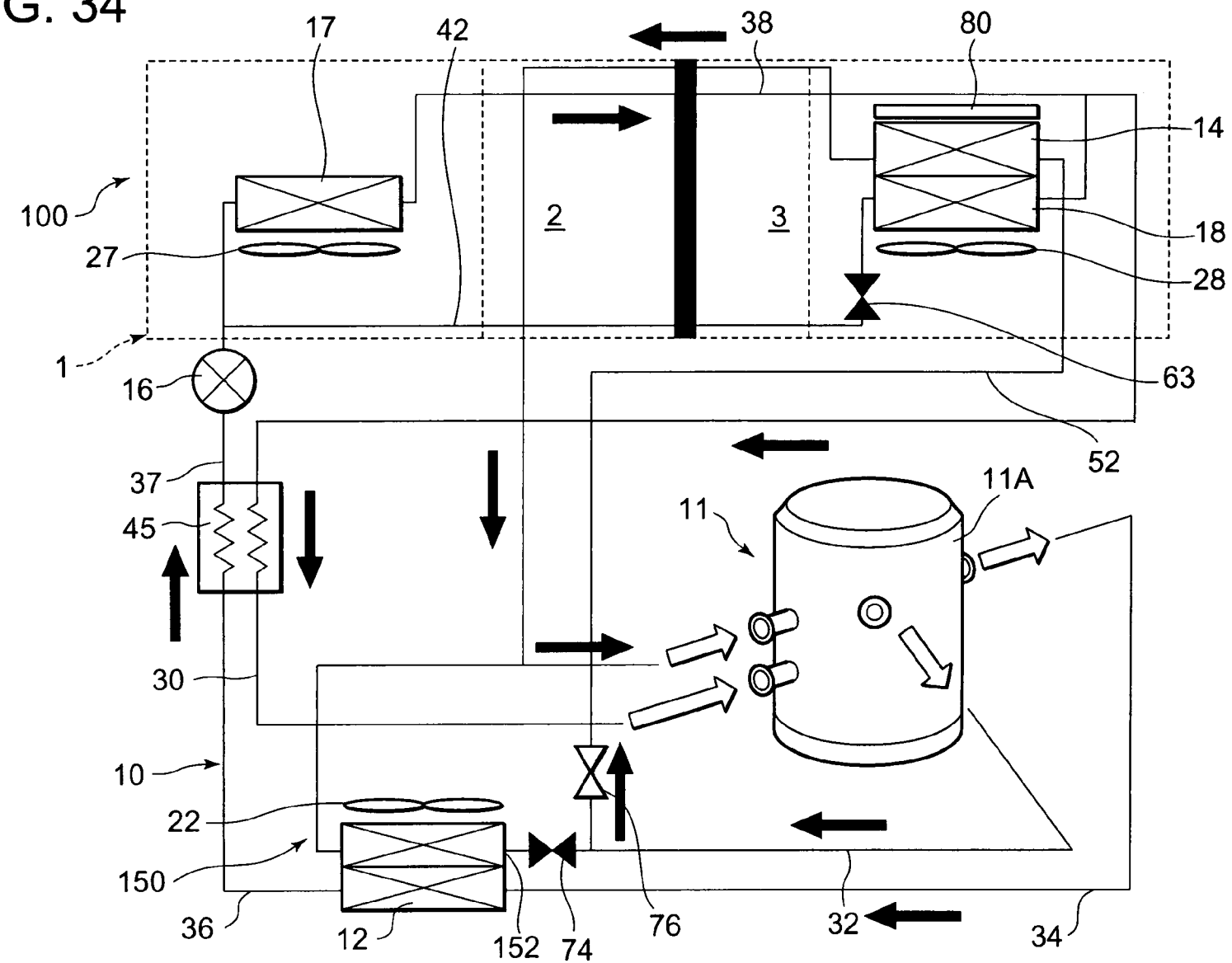
FIG. 34 is a refrigerant circuit diagram of FIG. 32 showing a flow of a refrigerant on a mode of using the receiving room 3 as a heating chamber.
Figure 35:
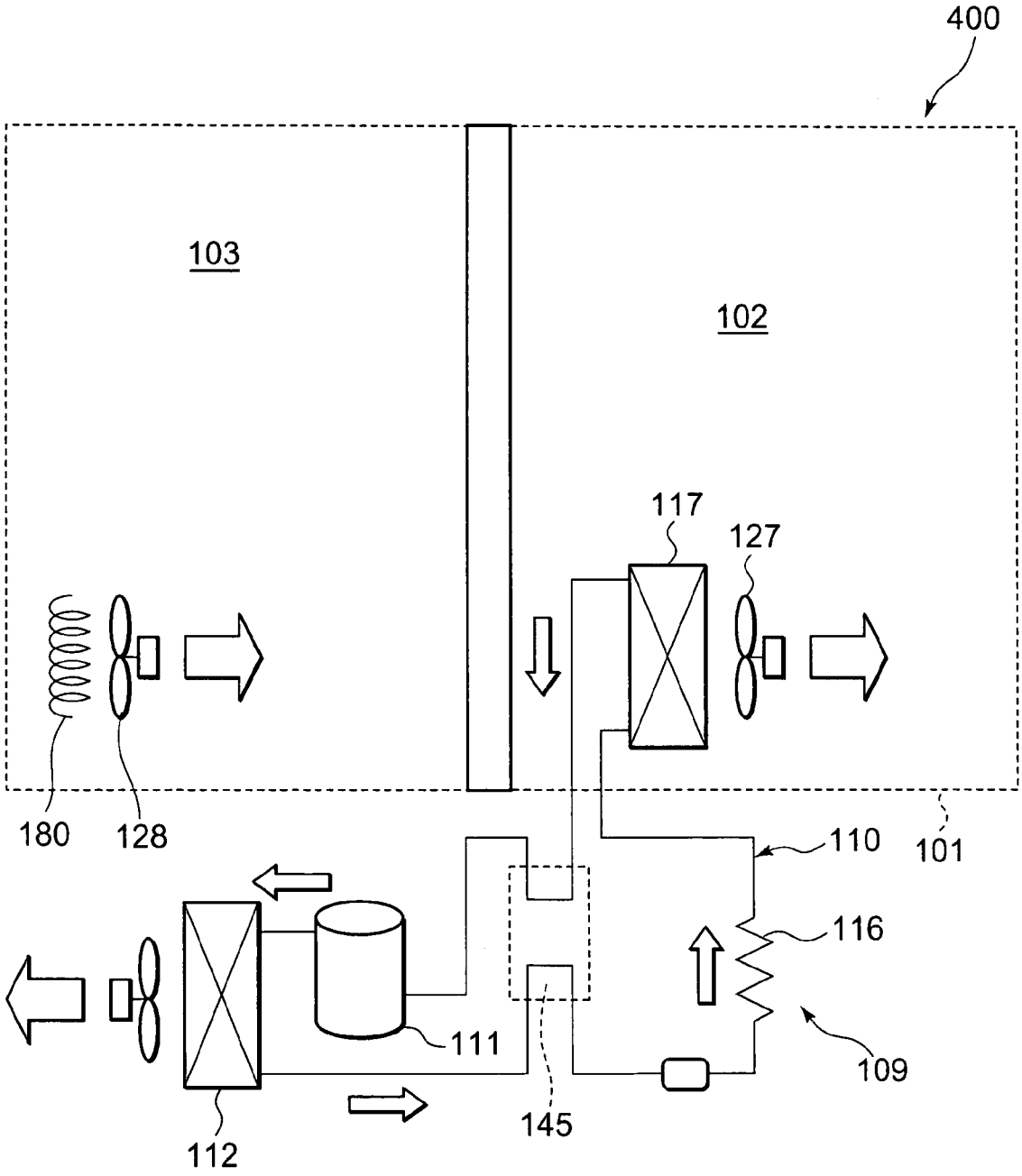
FIG. 35 PRIOR ART
FIG. 35 is an internal configuration diagram of a conventional heating/cooling system.

Next, referring to FIGS. 32 to 34, an embodiment of yet another invention will be described in detail.

Embodiment 4

Figure 32:
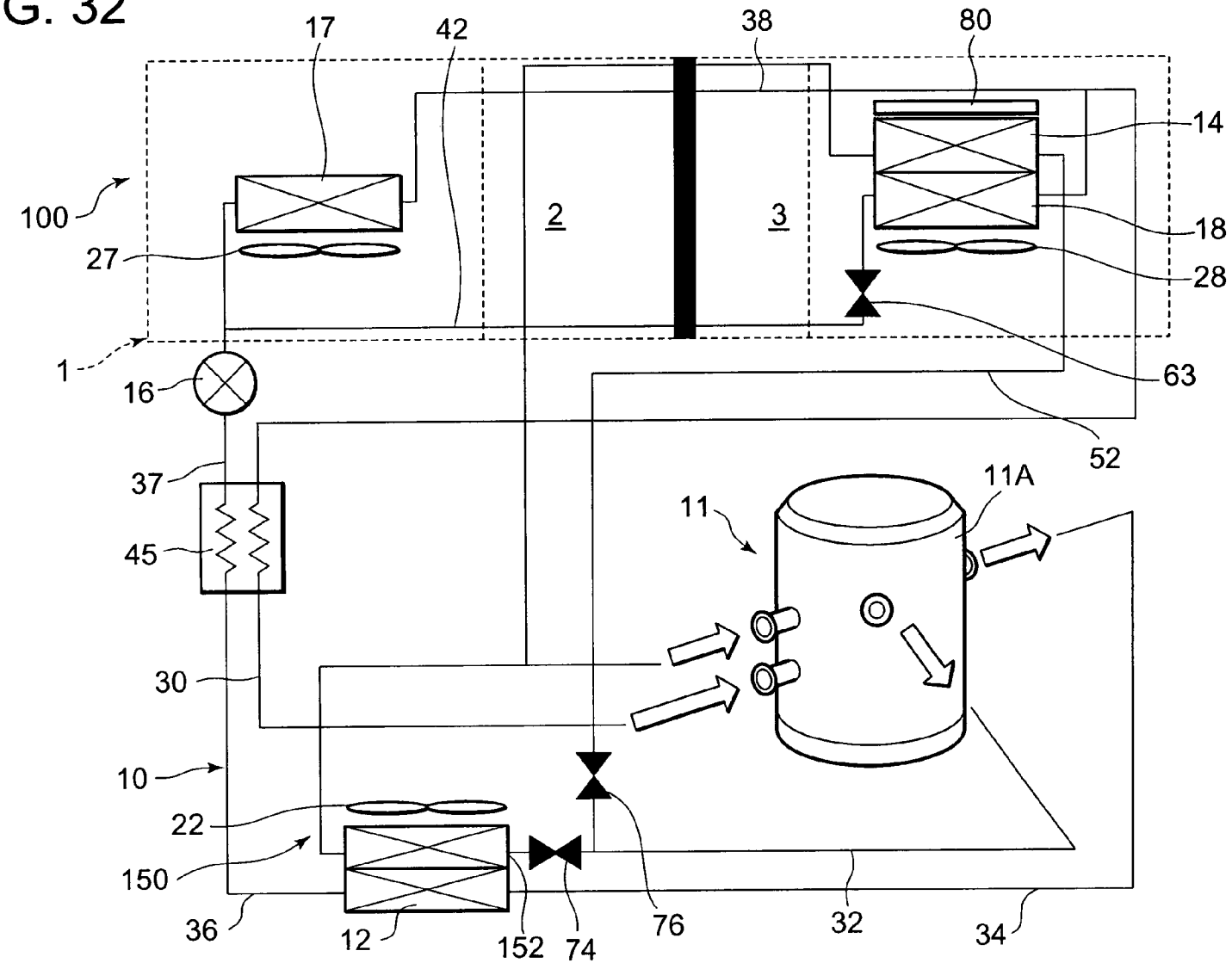
FIG. 32 is a refrigerant circuit diagram of a heating/cooling system according to an embodiment of another invention (Embodiment 4)

FIG. 32 is a schematic configuration diagram showing a heating/cooling system 100 according to an embodiment of the invention. It should be noted that the heating/cooling system of the invention can be used for a showcase, an automatic vending machine, an air conditioner, a cooling/heating cabinet or the like as in the previous case.

In FIG. 32, a reference numeral 1 denotes a storage room of the heating/cooling system 100. This storage room 1 is surrounded with an insulating member. The storage room 1 is partitioned into a cooling chamber 2 and a receiving room 3 by an insulated wall.

In the cooling chamber 2, an evaporator 17 for evaporating a refrigerant, and a fan 27 for blowing (circulating) air heat-exchanged with the evaporator 17 into the cooling chamber 2 are installed.

In the receiving room 3, a heat exchanger 14 (described later) for heating the inside of the receiving room 3 and an electric heater 80 as an auxiliary heater for heating the receiving room 3, an evaporator 18 for cooling the inside of the receiving room 3, and a fan 28 for blowing (circulating) air heat-exchanged with the heat exchanger 14 or the evaporator 18 or air heated by the electric heater 80 into the receiving room 3 are installed.

Additionally, in FIG. 32, a reference numeral 10 denotes a refrigerant circuit constituted by sequentially connecting a compressor 11, a gas cooler 12, an expansion valve 16 as a pressure reducing device, and the evaporator 17, and the like annularly through pipes.

That is, a refrigerant discharge pipe 34 of the compressor 11 is connected to an inlet of the gas cooler 12. Here, the compressor 11 of the embodiment is an internal intermediate pressure 2-stage compression type rotary compressor which comprises a driving element (not shown) disposed in a sealed container 11A, and first and second rotary compression elements (not shown) driven by the driving element.

In the drawing, a reference numeral 30 denotes a refrigerant introduction pipe for introducing a refrigerant into the first rotary compression element of the compressor 11. One end of this refrigerant introduction pipe 30 is communicated with a cylinder of the first rotary compression element. The other end of the refrigerant introduction pipe 30 is connected to an outlet of an internal heat exchanger 45 described below.

In the drawing, a reference numeral 32 denotes a refrigerant introduction pipe for introducing a refrigerant compressed by the first rotary compression element into the second rotary compression element. Here, the refrigerant introduction pipe 32 is disposed to pass through an intermediate cooling circuit 150 installed outside the sealed container 11A.

The intermediate cooling circuit 150 comprises the refrigerant introduction pipe 32, and a refrigerant pipe 52 branched from the midway thereof. A radiator 152 is disposed on a downstream side of the refrigerant pipe 52 of the refrigerant introduction pipe 32. This radiator 152 is constituted integrally with the gas cooler 12, and a fan 22 is disposed nearby to release heat from a refrigerant by blowing air to the radiator 152 and the gas cooler 12. Thus, by integrally constituting the radiator 152 and the gas cooler 12, expansion of the heating/cooling system 100 caused by disposing the radiator 152 can be limited to a minimum. Moreover, the radiator 152 and the gas cooler 12 shares one fan 22. Thus, an installation space can be reduced, and production cost by disposing the radiator 152 can be reduced as much as possible.

The refrigerant pipe 52 branched from the refrigerant introduction pipe 32 passes through the heat exchanger 14 installed in the receiving room 3, and then connected to the refrigerant introduction pipe 32 on an outlet side of the radiator 152. It should be noted that the heat exchanger cools the refrigerant compressed by the first rotary compression element of the compressor 11, and sucks the refrigerant into the second rotary compression element.

In the refrigerant introduction pipe 32 of the inlet side of the radiator 152 (on a downstream side of a branch of the refrigerant pipe 52) and the refrigerant pipe 52 of the inlet side of the heat exchanger 14, solenoid valves 74 and 76 are installed as flow path control means for controlling flowing of a refrigerant discharged from the first rotary compression element to the heat exchanger 14 or the radiator 152.

The refrigerant discharge pipe 34 is a refrigerant pipe for discharging a refrigerant compressed by the second rotary compression element to the gas cooler 12.

A refrigerant pipe 36 connected to an outlet side of the gas cooler 12 is connected to the internal heat exchanger 45. It should be noted that the internal heat exchanger 45 is designed to exchange heat between high-pressure side and low-pressure side refrigerants. A refrigerant pipe 37 connected to the outlet of the internal heat exchanger 45 is connected through the expansion valve 16 to an inlet of the evaporator 17 of the cooling chamber 2.

Here, a bypass circuit 42 is branched and connected to the midway of the refrigerant pipe 37 out of the expansion valve 16. This bypass circuit 42 is disposed to pass through the evaporator 18 installed in the receiving room 3, and to combine with the refrigerant pipe 38 out of the evaporator 17. In the pipe of the inlet side of the evaporator 18, a solenoid valve 63 is disposed as flow path control means for controlling refrigerant circulation for the evaporator 18.

Here, as a refrigerant sealed in the refrigerant circuit 10, carbon dioxide ($CO_2$) which is a natural refrigerant kind to a global environment is used in consideration of combustibility, toxicity, and the like.

Opening/closing of each of the solenoid valves 63, 74 and 76 is controlled by a control device (not shown). It should be noted that the control device is control means in charge of controlling the heating/cooling system 100, and controls running of the compressor 11 and the fans 22, 27 and 28 or the like in addition to control of the solenoid valves 63, 74 and 76.

(1) Mode of using receiving room 3 as cooling chamber

Next, an operation of the heating/cooling system 100 of the invention configured in the aforementioned manner will be described. To begin with, referring to FIG. 33, a mode of using the receiving room 3 as a cooling chamber for cooling articles will be described. FIG. 33 is a refrigerant circuit diagram showing a flow of a refrigerant on this mode. The solenoid valve 74 is opened by the control device (not shown), while the solenoid valve 76 is closed to close the refrigerant pipe 52. Accordingly, refrigerants discharged from the compressor 11 all flow to the radiator 152 without flowing to the heat exchanger 14.

The control device opens the solenoid valve 63 to open the bypass circuit 42. Accordingly, a refrigerant from the expansion valve 16 flows to the evaporator 18. It should be noted that white solenoid valves indicate states of valves opened by the control device, black solenoid valves indicate states of valves closed by the control device, and arrows indicate flows of refrigerants in FIGS. 33 and 34.

The control device starts running of the fans 22, 27 and 28, and drives the driving element of the compressor 11. Accordingly, a low-pressure refrigerant gas is sucked through the refrigerant introduction pipe 30 into the first rotary compression element (not shown) of the compressor 11, compressed to become an intermediate pressure gas, and discharged into a sealed container 11A. The refrigerant discharged into the sealed container 11A is discharged through the refrigerant introduction pipe 32 to the outside thereof, and enters the intermediate cooling circuit 150. Then, as the solenoid valve 74 is opened while the solenoid valve 76 is closed as described above, the refrigerant flowing through the refrigerant introduction pipe 32 passes through the radiator 152. There, the refrigerant receives air from the fan 22 to release heat.

As described above, the refrigerant compressed by the first rotary compression element is cooled by the radiator 152, and then sucked into the second rotary compression element. Thus, a temperature of the refrigerant gas discharged from the second rotary compression element of the compressor 11 can be reduced. Accordingly, since evaporation temperatures of the refrigerants by the evaporators 17 and 18 are reduced, the cooling chamber 2 and the receiving room 3 can be cooled to lower temperatures. As a result, it is possible to increase efficiencies of the evaporators 17 and 18 to cool the cooling chamber 2 and the receiving room 3.

Subsequently, the refrigerant is sucked into the second rotary compression element, and compressed to become a high-temperature and high-pressure refrigerant gas. The refrigerant gas is then discharged through the refrigerant discharge pipe 34 to the outside of the compressor 11. By this time, the refrigerant has been compressed to proper supercritical pressure. The refrigerant gas discharged from the compressor 11 flows through the refrigerant discharge pipe 34 into the gas cooler 12.

Here, the high-temperature and high-pressure refrigerant compressed by the compressor 11 is not condensed, but the fans are run in the supercritical state of the refrigerant gas. The high-temperature and high-pressure refrigerant gas passes through the internal heat exchanger 45 after heat is released therefrom by the gas cooler 12. There, the heat of the refrigerant is drawn by low-pressure side refrigerants out of the evaporators 17, 18, and the refrigerant is further cooled. The presence of the internal heat exchanger 45 causes the low-pressure side refrigerant to draw the heat from the refrigerant which goes out of the gas cooler 12 and passes through the internal heat exchanger 45. A supercooling degree of the refrigerant is increased by a corresponding amount. Thus, cooling efficiencies of the evaporators 17, 18 are increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state by the expansion valve 16 flows into the evaporator 17 installed in the cooling chamber 2. The refrigerant is evaporated there, and absorbs heat from ambient air to exhibit a cooling effect. It should be noted that the air cooled by the evaporation of the refrigerant at the evaporator 17 is circulated in the cooling chamber 2 by running the fan 27 to cool the inside thereof.

The refrigerant is evaporated at a lower temperature by the evaporator 17 because of the effect of cooling the refrigerant compressed by the first rotary compression element at the radiator 152 and the effect of passing the high-pressure side refrigerant discharged from the gas cooler 12 through the internal heat exchanger 50 and cooling it. Accordingly, the inside of the cooling chamber 2 can be cooled to a lower temperature, making it possible to increase a cooling efficiency. Subsequently, the refrigerant evaporated at the evaporator 17 goes out of the same, and enters the refrigerant pipe 38.

Meanwhile, a part of the refrigerant reduced in pressure by the expansion valve 16 enters the bypass circuit 42 branched and connected to the midway of the refrigerant pipe 37 since the solenoid valve 63 is opened as described above, and flows into the evaporator 18 installed in the receiving room 3. The refrigerant evaporates there, and absorbs heat from ambient air to exhibit a cooling effect. The air cooled by the evaporation of the refrigerant at the evaporator 18 is circulated in the receiving room 3 by running the fan 28 to cool the same.

The refrigerant is evaporated at a lower temperature at the evaporator 18 because of the effect of cooling the refrigerant compressed by the first rotary compression element at the heat exchanger 152 and the effect of passing the high-pressure side refrigerant discharged from the gas cooler 12 through the internal heat exchanger 45 and cooling it. Accordingly, the inside of the receiving room 3 can be cooled at a lower temperature, making it possible to increase a cooling efficiency. Subsequently, the refrigerant flows out of the evaporator 18, and combines with the refrigerant from the evaporator 17 which flows through the refrigerant pipe 38.

The combined refrigerant passes through the internal heat exchanger 45, and draws heat from the aforementioned high-pressure side refrigerant to receive a heating effect. Here, the refrigerant evaporated by each of the evaporators 17, 18 to become low in temperature and fed out therefrom may be set not in a completely gas state but in a liquid mixed state. However, the refrigerant is passed through the internal heat exchanger 45 to be heat-exchanged with the high-pressure side high-temperature refrigerant, thereby being superheated. At this time, a superheating degree of the refrigerant is secured, causing the refrigerant to become a complete gas.

Accordingly, the refrigerant out of each of the evaporators 17, 18 can be surely gasified, making it possible to assure prevention of a liquid-back, i.e., suction of a liquid refrigerant into the compressor 11, and to prevent a problem of damaging of the compressor 11 by liquid compression without disposing any accumulators or the like on the low-pressure side. Thus, it is possible to improve reliability of the heating/cooling system 100.

It should be noted that the refrigerant heated by the internal head exchanger 45 repeats a cycle of being sucked through the refrigerant introduction pipe 30 into the first rotary compression element of the compressor 11.

As described above, the solenoid valve 76 is closed to close the refrigerant pipe 52, and the solenoid valve 74 is opened to allow flowing of the refrigerant compressed by the first rotary compression element to the radiator 152. Thus, it is possible to use the receiving room 3 as a cooling chamber for cooling articles.

(2) Mode of using receiving room 3 as heating chamber

Next, referring to FIG. 34, description will be made of an operation of the heating/cooling system 100 on a mode of using the receiving room 3 as a heating chamber for heating articles. FIG. 34 is a refrigerant circuit diagram showing a flow of a refrigerant on this mode.

The control device closes the solenoid valve 74, and opens the solenoid valve 76 to open the intermediate cooling circuit 150 and the refrigerant pipe 52. Accordingly, refrigerants discharged form the compressor 11 all flow from the midway of the refrigerant discharge pipe 34 to the refrigerant pipe 52 without flowing to the radiator 152. Additionally, the control device closes the solenoid valve 63 to close the bypass circuit 42.

The control device starts running of the fans 22, 27 and 28, and drives the driving element of the compressor 11. Accordingly, a low-pressure refrigerant gas is sucked through the refrigerant introduction pipe 30 into the first rotary compression element (not shown) of the compressor 11, compressed to become an intermediate pressure gas, and discharged into the sealed container 11A. The refrigerant discharged into the sealed container 11A is discharged through the refrigerant introduction pipe 32 to the outside of the sealed container 11A, and enters the intermediate cooling circuit 150. The solenoid valve 74 is closed while the solenoid valve 76 is opened as described above. Thus, all the refrigerants enter the refrigerant pipe 52 without passing through the radiator 152, and flow into the heat exchanger 14 installed in the receiving room 3. There, heat is released from the intermediate-pressure refrigerant that has flown into the heat exchanger 14. It should be noted that air heated as a result of heat releasing from the refrigerant by the radiator 14 is circulated in the receiving room 3 to heat the inside thereof by running the fan 28.

Here, the refrigerant compressed by the first rotary compression element directly flows to the heat exchanger 14, whereby heat is released from a refrigerant of a relatively high temperature at the heat exchanger 14. Thus, the receiving room 3 can be sufficiently heated. Further, according to the invention, carbon dioxide is used for the refrigerant. Thus, the refrigerant compressed by the second rotary compression element is set in a supercritical state, causing a heat exchanging efficiency to be extremely high. Therefore, when the inside of the receiving room 3 is heated by the high-temperature and high-pressure refrigerant compressed by the second rotary compression element of the compressor 11, there is a problem that a temperature becomes excessively high in the receiving room 3 depending on its use situation.

However, if the receiving room 3 is heated by the intermediate-pressure refrigerant compressed by the first rotary compression element, the inside of the receiving room 3 can be heated to a proper temperature.

The refrigerant compressed by the first rotary compression element is cooled by the heat exchanger 14, and then sucked into the second rotary compression element, whereby a temperature of a refrigerant gas discharged from the second rotary compression element of the compressor 11 can be reduced. Thus, since an evaporation temperature of the refrigerant at the evaporator 17 is reduced, the cooling chamber 2 can be cooled to a lower temperature. As a result, it is possible to increase an efficiency of the evaporator 17 to cool the cooling chamber 2.

On the other hand, the refrigerant out of the heat exchanger 14 is sucked through the refrigerant introduction pipe 32 into the second rotary compression element of the compressor 11, compressed, and discharged through the refrigerant discharge pipe 34 to the outside of the compressor 11. By this time, the refrigerant has been compressed to proper supercritical pressure. The refrigerant gas discharged from the compressor 11 flows through the refrigerant discharge pipe 34 into the gas cooler 12.

Here, the high-temperature and high-pressure refrigerant compressed by the compressor 11 is not condensed, by the fans are run in the supercritical state of the refrigerant gas. Then, the high-temperature and high-pressure refrigerant gas enters the internal heat exchanger 45 after heat is released therefrom by the gas cooler 12. There, the heat of the refrigerant is drawn by low-pressure side refrigerant out of the evaporator 17, and the refrigerant is further cooled. The presence of the internal heat exchanger 45 causes the low-pressure side refrigerant to draw the heat from the refrigerant which goes out of the gas cooler 12 and passes through the internal heat exchanger 45. A supercooling degree of the refrigerant is increased by a corresponding amount. Thus, a cooling efficiency of the evaporator 17 is increased.

The high-pressure side refrigerant gas cooled by the internal heat exchanger 45 reaches the expansion valve 16. It should be noted that the refrigerant gas is still in the supercritical state at the inlet of the expansion valve 16. The refrigerant is set in a 2-phase mixed state of a gas/a liquid by a drop in pressure of the expansion valve 16. Then, the refrigerant set in the 2-phase mixed state by the expansion valve 16 flows into the evaporator 17 installed in the cooling chamber 2. The refrigerant is evaporated there, and absorbs heat from ambient air to exhibit a cooling effect. It should be noted that the air cooled by the evaporation of the refrigerant at the evaporator 17 is circulated in the cooling chamber 2 by running the fan 27 to cool the inside thereof.

The refrigerant evaporated at the evaporator 17 repeats a cycle of flowing out of the evaporator 17, entering the refrigerant pipe 38, passing through the internal heat exchanger 45, drawing heat from the high-pressure side refrigerant, receiving a heating effect to become a complete gas, and being sucked through the refrigerant introduction pipe 30 into the first rotary compression element of the compressor 11.

As described above, the solenoid valve 76 is opened, and the heat is released from the refrigerant compressed by the first rotary compression element at the heat exchanger 14. Accordingly, the receiving room 3 can be heated. As a result, it is possible to use the receiving room 3 as a heating chamber for heating articles.

As described above in detail, the carbon dioxide of good heating characteristics is used for the refrigerant. Accordingly, the inside of the receiving room 3 can be heated by the internal heat exchanger 14, and cooled by the evaporator 18. Thus, the receiving room 3 can be heated by the refrigerant circuit 10 without installing any heating elements such as electric heaters or any special heating devices. As a result, it is possible to greatly reduce power consumption of the heating/cooling system 100.

Hot air and cold air can be switched to be used in the receiving room 3 by controlling refrigerant circulation through the solenoid valves 63, 74 and 76 of the aforementioned modes. Thus, by switching opening/closing of each solenoid valves 63, 74 and 76, it is possible to freely control hot air/cold air in the receiving room 3.

According to the embodiment, the solenoid valves 74 and 76 are disposed to control refrigerant circulation for the radiator 152 and the heat exchanger 14. However, the invention is not limited to this. A three-way valve may be disposed to switch refrigerant circulation between the radiator 152 and the heat exchanger 14.

According to the embodiment, the gas cooler 12 and the radiator 152 are constituted integrally. However, the invention is not limited to this. The gas cooler 12 and the radiator 152 may be installed separately.

In the case of the mode of using the receiving room 3 as the heating chamber for heating articles, by running the electric heater 80 installed therein, heating may be executed by the electric heater 80 to supplement the heating by the heat exchanger 14. Especially, when the receiving room 3 is heated by the intermediate-pressure refrigerant compressed by the first rotary compression element as in the case of the embodiment, in a normal state, the inside of the receiving room 3 can be heated to a proper temperature. However, there is a fear that the inside of the receiving room 3 cannot be sufficiently heated due to a shortage of a heating efficiency in winter or the like.

However, the inside of the receiving room 3 is heated by the electric heater 80 in addition to the heating by the heat exchanger 14. Accordingly, the aforementioned problem can be prevented. Thus, the inside of the receiving room 3 can always be heated to an optimal temperature. As a result, it is possible to improve performance and reliability of the heating/cooling system 100.

The electric heater 80 supplements the heating by the heat exchanger 14. Accordingly, a capacity of the electric heater 80 can be reduced. As a result, it is possible to reduce power consumption compared with the case of heating only by the electric heater.

Furthermore, according to the embodiment, the heat exchanger 14 and the evaporator 18 are installed in the receiving room 3, and refrigerant circulation is controlled by opening/closing the solenoid valves 63, 74 and 76, thereby controlling heating/cooling of the receiving room 3. However, the invention is not limited to this. For example, a duct may be disposed outside the receiving room, a heat exchanger and an evaporator may be installed in the duct. By switching fan blowing or the like, hot or cold air may be blown to the receiving room to switch heating/cooling.

According to the embodiment, the rotary compressor of the internal intermediate 2-stage compression type is used. However, a compressor usable by the invention is not limited to this. As long as a constitution is such that the refrigerant compressed by the first compression element is sucked into the second compression element, any compression forms, any number of stages or the like may be employed.

What is claimed is:

1. A heating/cooling system having a receiving room capable of using hot air and cold air in a switching manner, comprising:

a refrigerant circuit which comprises a compressor, a radiator, a pressure reducing device, and an evaporator, in which carbon dioxide is sealed as a refrigerant, and whose high pressure side becomes supercritical pressure, wherein the inside of the receiving room is heated by the radiator and cooled by the evaporator, and wherein said radiator is separate from said evaporator.

2. The heating/cooling system according to claim 1, further comprising a plurality of receiving rooms, pluralities of radiators and evaporators for heating and cooling the receiving rooms, and flow path control means for controlling refrigerant circulation for the radiators and the evaporators.

3. The heating/cooling system having a receiving room capable of using hot air and cold air in a switching manner, comprising:

a refrigerant circuit which comprises a compressor, a radiator, a pressure reducing device, and an evaporator, in which carbon dioxide is sealed as a refrigerant, and whose high pressure side becomes supercritical pressure, wherein the inside of the receiving room is heated by the radiator and cooled by the evaporator, and the refrigerant circuit further comprises a gas cooler disposed separately from the radiator to release heat from the refrigerant, an auxiliary evaporator disposed separately from the evaporator to evaporate the refrigerant, and flow path control means for controlling refrigerant circulation for the radiator, the evaporator, the gas cooler, and the auxiliary evaporator.

4. The heating/cooling system according to claim 3, wherein the auxiliary evaporator is arranged on a leeward side of the gas cooler.

5. A heating/cooling system having a receiving room capable of using hot air and cold air in a switching manner, comprising:

a refrigerant circuit which comprises a 2-stage compression type compressor having first and second compression elements, a radiator, a pressure reducing device, and an evaporator, in which carbon dioxide is sealed as a refrigerant, and whose high pressure side becomes supercritical pressure, wherein the inside of the receiving room is heated by the radiator and cooled by the evaporator, an intermediate cooling circuit is provided to cool a refrigerant compressed by the first compression element of the compressor and to suck the refrigerant into the second compression element, and when the inside of the receiving room is heated by the radiator, the cooling of the refrigerant by the intermediate cooling circuit is made substantially invalid.

6. The heating/cooling system according to claim 5, further comprising a gas cooler disposed separately from the radiator to release heat from the refrigerant, an auxiliary evaporator disposed separately from the evaporator the evaporate the refrigerant, a heat exchanger which releases heat from the refrigerant at the intermediate cooling circuit, a bypass pipe which bypasses the heat exchanger, and flow path control means for controlling refrigerant circulation for the radiator, the evaporator, the gas cooler, the auxiliary evaporator, the heat exchanger and the bypass pipe.

7. The heating/cooling system according to any one of claims 3, 4 and 6, further comprising a plurality of receiving rooms, pluralities of radiators and evaporators for heating and cooling the receiving rooms.

8. A heating/cooling system having a receiving room capable of using hot air and cold air in a switching manner, comprising:

a refrigerant circuit which comprises a 2-stage compression type compressor having first and second compression elements, a gas cooler, a pressure reducing device, and an evaporator, in which carbon dioxide is sealed as a refrigerant, and whose high pressure side becomes supercritical pressure, and an intermediate cooling circuit which comprises a heat exchanger to cool a refrigerant compressed by the first compression element of the compressor and then to suck the refrigerant into the second compression element, wherein the inside of the receiving room is heated by heat releasing from the heat exchanger and cooled by the evaporator.

9. The heating/cooling system according to claim 8, further comprising a radiator disposed in the intermediate cooling circuit, and flow path control means for controlling flowing of the refrigerant discharged from the first compression element to the heat exchanger or the radiator.

10. The heating/cooling system according to claim 9, wherein the radiator is constituted integrally with the gas cooler.

11. The heating/cooling system according to any one of claims 8 to 10, further comprising an evaporator which evaporates the refrigerant, and flow path control means for controlling refrigerant circulation for both of the evaporators.

12. The heating/cooling system according to any one of claims 1-6 and 8-9, further comprising an electric heater which heats the inside of the receiving room.

* * * * *